US008581679B2

(12) United States Patent
Min et al.

(10) Patent No.: US 8,581,679 B2
(45) Date of Patent: Nov. 12, 2013

(54) SWITCH WITH INCREASED MAGNETIC SENSITIVITY

(75) Inventors: Tang Min, Singapore (SG); Olivier Le Neel, Singapore (SG); Ravi Shankar, Singapore (SG)

(73) Assignees: STMicroelectronics Asia Pacific Pte. Ltd., Singapore (SG); STMicroelectronics N.V., Amsterdam (NL)

( * ) Notice: Subject to any disclaimer, the term of this patent is extended or adjusted under 35 U.S.C. 154(b) by 232 days.

(21) Appl. No.: 12/713,390

(22) Filed: Feb. 26, 2010

(65) Prior Publication Data

US 2011/0210808 A1 Sep. 1, 2011

(51) Int. Cl.
*H01H 51/22* (2006.01)
*H01H 57/00* (2006.01)

(52) U.S. Cl.
USPC ..... 335/78; 200/181

(58) Field of Classification Search
USPC ..... 335/78; 200/181
See application file for complete search history.

(56) References Cited

U.S. PATENT DOCUMENTS 5,629,918 A * 5/1997 Ho et al. ..... 310/40 MM
5,726,480 A * 3/1998 Pister ..... 257/415
6,040,748 A * 3/2000 Gueissaz ..... 335/78
6,153,839 A * 11/2000 Zavracky et al. ..... 200/181
6,307,169 B1 * 10/2001 Sun et al. ..... 200/181
6,384,353 B1 * 5/2002 Huang et al. ..... 200/181
6,469,602 B2 * 10/2002 Ruan et al. ..... 335/78
6,633,212 B1 * 10/2003 Ruan et al. ..... 335/78
6,714,105 B2 * 3/2004 Eliacin et al. ..... 333/262
6,728,017 B2 * 4/2004 Park ..... 359/224.1
6,985,058 B2 * 1/2006 D'Amico et al. ..... 335/78
7,242,273 B2 * 7/2007 Isobe et al. ..... 335/78
7,446,634 B2 * 11/2008 Jeong et al. ..... 335/78
7,546,677 B2 * 6/2009 Lee et al. ..... 29/622
7,692,521 B1 * 4/2010 Cohn ..... 335/78
7,833,484 B2 * 11/2010 Gueissaz et al. ..... 422/402
7,893,798 B2 * 2/2011 Foster et al. ..... 335/78
2002/0196112 A1 * 12/2002 Ruan et al. ..... 335/78
2004/0061579 A1 * 4/2004 Nelson ..... 335/78
2005/0007218 A1 * 1/2005 Shen et al. ..... 335/78
2005/0099252 A1 * 5/2005 Isobe et al. ..... 335/78
2005/0104694 A1 * 5/2005 Cho et al. ..... 335/78
2006/0049900 A1 * 3/2006 Ruan et al. ..... 335/78
2006/0181377 A1 * 8/2006 Kweon et al. ..... 335/78
2007/0018760 A1 * 1/2007 Jeong et al. ..... 335/78
2007/0018761 A1 * 1/2007 Yamanaka et al. ..... 335/78
2008/0106360 A1 * 5/2008 Paineau et al. ..... 335/78

* cited by examiner

*Primary Examiner* — Alexander Talpalatski
(74) *Attorney, Agent, or Firm* — Wolf, Greenfield & Sacks, P.C.

(57) ABSTRACT

Switches that are actuated through exposure to a magnetic field are described. A mobile element of a switch includes one or more anchoring members that are in electrical contact with one of the conductive portions. The mobile element also has a beam that is attached to the one or more anchoring members. The beam can be attached to the one or more anchoring members by flexures. The beam has an end portion that is configured to move toward the other conductive portion when exposed to an external force, such as a magnetic field. Various configurations of anchoring members may significantly decrease initial upward beam deformation upon manufacture of the mobile element, resulting in an increased sensitivity upon exposure to a magnetic field. Methods for manufacturing switches that exhibit increased sensitivity to magnetic fields are also disclosed.

31 Claims, 51 Drawing Sheets

SWITCH WITH INCREASED MAGNETIC SENSITIVITY

BACKGROUND

1. Field

Aspects described herein relate to a switch having a high magnetic sensitivity and methods of manufacturing the same.

2. Discussion of Related Art

Switches may be actuated in a number of ways. One method of actuation is through use of an external magnetic field to move a mobile element toward a conductive element to establish an electrical connection. When the mobile element is placed in electrical contact with the conductive element, current is able to flow between the mobile element and the conductive element, and the switch is in a closed configuration. Challenges exist in the manufacture of mobile elements that are used for switching. For example, portions of mobile elements may tend to build up residual stresses during manufacture, resulting in undesirable deformation of the mobile element. Such deformation may lead to the mobile element requiring a greater magnetic field strength than is otherwise desired in order to close the switch.

Reed switches are electronic components that may be used to control electrical circuits with minimal power consumption. Such switches include one or more flexible reeds that are made of a magnetic material and are sealed with an inert gas in a glass tube. Reeds, which commonly overlap and are separated by a small gap, are actuated upon application of a magnetic field. Reed switches are often unreliable, delicate, and can take up space.

SUMMARY

In one illustrative embodiment, a switch is provided. The switch includes a substrate having a first conductive portion and a second conductive portion; and a mobile element disposed on the substrate. The mobile element includes a plurality of anchoring members disposed on the substrate and in contact with the first conductive portion of the substrate, wherein the plurality of anchoring members are spaced apart from one another; and a beam extending from the plurality of anchoring members, the beam having an end portion that is adapted to move toward the second conductive portion upon exposure to an external force, wherein when the end portion of the beam is in contact with the second conductive portion, an electrical pathway is formed between the first and second conductive portions of the substrate, wherein the plurality of anchoring members cooperate to minimize deformation resulting from residual stress in the mobile element.

In another illustrative embodiment, a method of manufacturing a switch. The method includes providing a substrate; forming a first conductive portion and a second conductive portion on the substrate; and forming a mobile element. The method of forming a mobile element includes forming a plurality of spaced-apart anchoring members on the first conductive portion in a manner to minimize deformation resulting from residual stress in the mobile element; and forming a beam on and extending from the plurality of anchoring members, wherein the beam includes an end portion on a region of the beam that is opposite from the plurality of anchoring members, the end portion of the beam being adapted to move toward the second conductive portion such that when the end portion of the beam is in contact with the second conductive portion, an electrical pathway is formed between the first and second conductive portions on the substrate.

In a different illustrative embodiment, a switch is provided. The switch includes a substrate having a first conductive portion and a second conductive portion; and a mobile element disposed on the substrate. The mobile element includes an anchoring member disposed on the substrate and in contact with the first conductive portion of the substrate; and a beam attached to the anchoring member, the beam including a plurality of strips, each strip being attached to another strip by a connection portion, and the beam having an end portion that is adapted to move toward the second conductive portion upon exposure to an external force, wherein when the end portion of the beam is in contact with the second conductive portion, an electrical pathway is formed between the first and second conductive portions of the substrate.

In a further illustrative embodiment, a switch is provided. The switch includes a substrate having a first conductive portion and a second conductive portion; and a mobile element disposed on the substrate. The mobile element includes an anchoring member disposed on the substrate and in contact with the first conductive portion of the substrate; a plurality of flexures attached to the anchoring member; and a beam attached to the plurality of flexures, the plurality of flexures being attached to the beam at a side portion of the beam, and the beam having an end portion that is adapted to move toward the second conductive portion upon exposure to an external force, wherein when the end portion of the beam is in contact with the second conductive portion, an electrical pathway is formed between the first and second conductive portions of the substrate.

In yet another illustrative embodiment, a method of manufacturing a switch is provided. The method includes providing a substrate; forming a first conductive portion and a second conductive portion on the substrate; and forming a mobile element. Forming mobile element includes forming an anchoring member on the first conductive portion; forming a plurality of flexures attached to the anchoring member; and forming a beam attached to the plurality of flexures, wherein the beam includes a plurality of strips, each strip being attached to another strip by a connection portion, and wherein the beam includes an end portion on a region of the beam that is opposite from the anchoring member, the end portion of the beam being adapted to move toward the second conductive portion such that when the end portion of the beam is in contact with the second conductive portion, an electrical pathway is formed between the first and second conductive portions on the substrate.

Various embodiments provide certain advantages. Not all embodiments share the same advantages and those that do may not share them under all circumstances.

Further features and advantages as well as the structure of various embodiments are described in detail below with reference to the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. Various embodiments will now be described, by way of example, with reference to the accompanying drawings, in which:

FIG. 10A is a schematic representation of a side section view of a substrate and substrate surface having a trench;

FIG. 10T is a schematic representation of an etch step removal of another conductive material from the wafer depicted in FIG. 10S;

FIG. 11A is a schematic representation of a side section view of a substrate and substrate surface;

FIG. 11P is a schematic representation of an etch step removal of another conductive material from the wafer depicted in FIG. 11O;

DETAILED DESCRIPTION

Figure 1B:
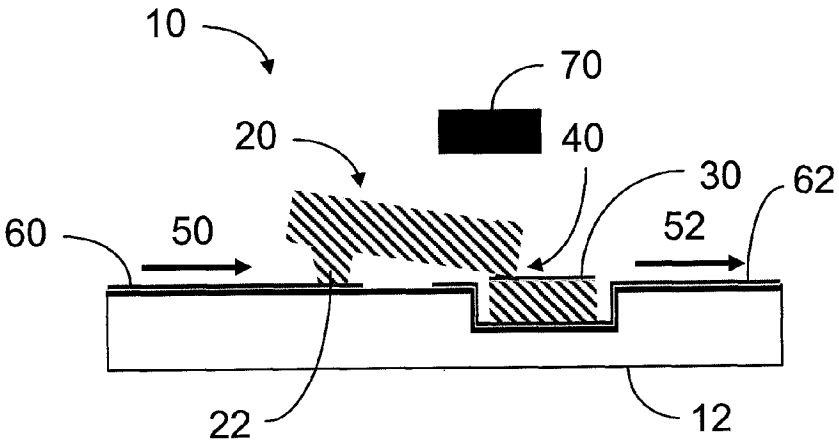
FIG. 1B is a schematic representation of a section view of the switch of FIG. 1A in a closed configuration.

Aspects herein are not limited in their application to the details of construction and the arrangement of components set forth in the following description or illustrated in the drawings. Other embodiments may be employed and aspects may be practiced or be carried out in various ways. Also, the phraseology and terminology used herein is for the purpose of description and should not be regarded as limiting. The use of "including," "comprising," "having," "containing," "involving," and/or variations thereof herein, is meant to encompass the items listed thereafter and equivalents thereof as well as additional items.

Switches described herein include a mobile element that is electrically connected with a first conductive member, where an electrical connection between the first conductive member and a second conductive member is established when the mobile element is actuated toward the second conductive member to form an electrical contact. In an embodiment, mobile elements described include a plurality of anchoring members that are formed such that the anchoring members are spaced apart from one another. However, it can be appreciated that, in some embodiments, mobile elements include a single anchoring member. Mobile elements discussed also include a beam that is attached at each of the anchoring members. The beam extends from the anchoring members, where an end portion of the beam is adapted to move toward a mating conductor in a substantially vertical direction when the beam is exposed to an external force, such as a magnetic field. A substantially vertical direction, in one embodiment, may include pivoting of a horizontally oriented beam about a plurality of anchoring members. Exposure of the end portion of the beam to a sufficient amount of external force may give rise to the end portion of the beam being actuated in a manner that brings the mobile element and the second conductive member into electrical contact. It can be appreciated that a sufficient amount of external force is required for the mobile element to be actuated enough so that an electrical connection is established between the mobile element and the second conductive member, resulting in a closed switch configuration.

In one embodiment, fabrication of a mobile element in switches described involves a step where a layer is provided for use as a template through which the structure of the mobile element may be formed. In one embodiment, this layer may be an insulating layer. Once the overall structure of the mobile element is formed, the layer is removed so as to expose the structure of the mobile element. Although removal of the layer may expose structure of the mobile element, such removal may result in a portion of the mobile element experiencing deformation caused by a residual stress gradient. In one embodiment, when the mobile element only includes a single anchoring member, the presence of residual stresses upon removal of the layer may result in an initial upward deformation in a beam portion of the mobile element. Such an initial upward deformation can be up to 20 microns and, in turn, may result in the mobile element having a decreased sensitivity to an external force, such as a magnetic field. As a result, greater external forces than is desired may be required for the mobile element to actuate in a manner that brings the switch to a closed configuration.

In some embodiments of a mobile element, in providing a plurality of anchoring members for increased magnetic sensitivity, the overall contact surface area with an underlying conductive member is reduced when compared to employing a single anchoring member contacting the same conductive member while covering the same space. That is, where the space allotted for anchoring members is the same regardless of the number of anchoring members, the sum of the contact surface areas between a plurality of anchoring members and an underlying conductive member is less than the contact surface area between a single anchoring member and the underlying conductive member. In this regard, in forming the plurality of anchoring members for a mobile element, while the contact surface areas between anchoring members and a conductive member is decreased as compared to in the case of a single anchoring member, the overall surface area of the anchoring members may give rise to an increased resistance to initial beam deformation from residual stress build up. As a result, a mobile element having a plurality of anchoring members may give rise to a switch with increased magnetic sensitivity as compared to a mobile element having a single anchoring member that covers the same surface area on a conductive member.

In view of the foregoing, upon manufacture of switches described, a plurality of anchoring members on a mobile element may significantly decrease initial upward deformation that is caused by residual stresses present in the mobile element. In an embodiment, the plurality of anchoring members cooperate with one another in minimizing deformation that results from residual stress in the mobile element. In various embodiments, decreased initial deformation may result in an increased overall sensitivity of a switch to external magnetic fields. For example, the mobile element may be actuated so that the switch reaches a closed switch configuration upon exposure to a relatively low strength magnetic field.

Methods of manufacturing a switch having a mobile element are also contemplated. For example, switches described may be manufactured by semiconductor fabrication techniques. In some embodiments, a substrate may be provided where the substrate includes first and second conductive portions. The first and second conductive portions may be formed to be separate from one another so that no electrical pathway is initially provided between the two. In one embodiment, a plurality of anchoring members are formed on the first conductive portion in a spaced-apart relation. The plurality of anchoring members may function in a manner to minimize deformation resulting from residual stresses in the mobile element. In addition, a beam may be formed on the anchoring members such that the beam extends from the anchoring members, where the beam has an end portion that is opposite the anchoring members. The end portion may be adapted to move toward the second conductive portion such that when the end portion of the beam electrically contacts the second conductive portion, an electrical pathway is formed between the first and second conductive portions. In some embodiments, the beam includes a magnetic material so that exposure of the beam to a magnetic field results in beam actuation toward the second conductive portion.

It can be appreciated that conductive portions of a switch may refer to any conductive material on the switch. In some embodiments, conductive members such as conductive tracks may be considered as conductive portions of a switch. In addition, the combination of a conductive member and a mobile element, which includes anchoring members and a beam, may also be considered as a conductive portion of a switch. In one embodiment, the combination of conductive members and a fixed element is also considered to be a conductive portion. Indeed, switches described herein may include multiple conductive portions.

Figure 1A:
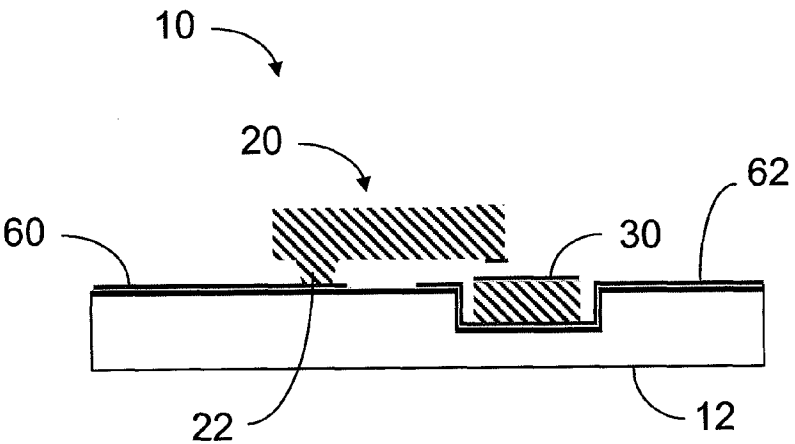
FIG. 1A is a schematic representation of a section view of a switch in an open configuration.

FIGS. 1A and 1B depict a side view illustration of a switch 10 that includes a mobile element 20 and a fixed element 30 disposed on a substrate 12. Mobile element 20 includes a single anchoring member 22 that is in electrical contact with a conductive member 60 on the substrate 12. Fixed element 30 is in electrical contact with another conductive member 62 on the substrate 12. As illustrated in FIG. 1A, in the absence of an appropriate external magnetic field, no electrical pathway is provided through mobile element 20 and fixed element 30 and, hence, no current travels through conductive members 60 and 62.

FIG. 1B illustrates magnet 70 shown in relatively close proximity with mobile element 20. Magnet 70 provides an external magnetic field that is of sufficient intensity to actuate a beam portion of mobile element 20 to pivot about anchoring member 22 toward fixed element 30 to form an electrical connection 40. As a result, electrical current, as depicted by numerals 50 and 52 is able to travel between conductive members 60 and 62 through the connection 40 between mobile element 20 and fixed element 30.

In one embodiment, when an electrical connection between conductive elements is established, the electrical resistance between conductive elements (e.g., between mobile and fixed elements) can be measured to be less than 10 ohms. In an embodiment, when electrical contact does not occur between conductive elements, the electrical resistance between elements can be greater than 100 Mohms.

Figure 2A:
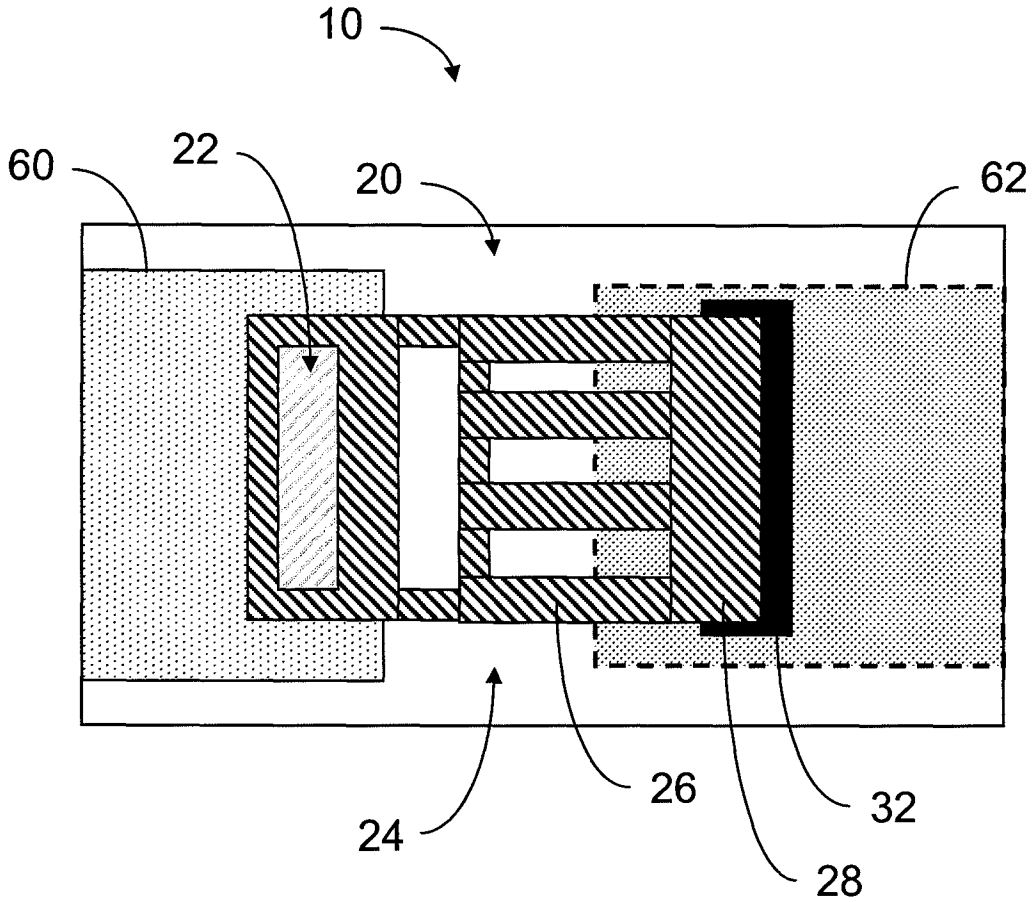
FIG. 2A is a schematic representation of a top view of a switch configuration.

FIG. 2A shows a top view illustration of a switch 10 that includes a mobile element 20 having a single anchoring member 22 and a beam 24. Beam 24 may incorporate strips 26, as shown in FIG. 2A. It can be appreciated that any appropriate combination or configuration of strips 26 may be included in a beam 24, if at all. An end portion 28 of beam 24 is generally disposed above a conductive contact 32 of a fixed element 30. Conductive portion 60 is in electrical contact with mobile element 20 and conductive portion 62, through fixed element 30, is in electrical contact with conductive contact 32. When no external magnetic field is applied to mobile element 20, no actuation of beam 24 occurs, hence, no electrical connection is established between mobile element 20 and fixed element 30.

Figure 2B:
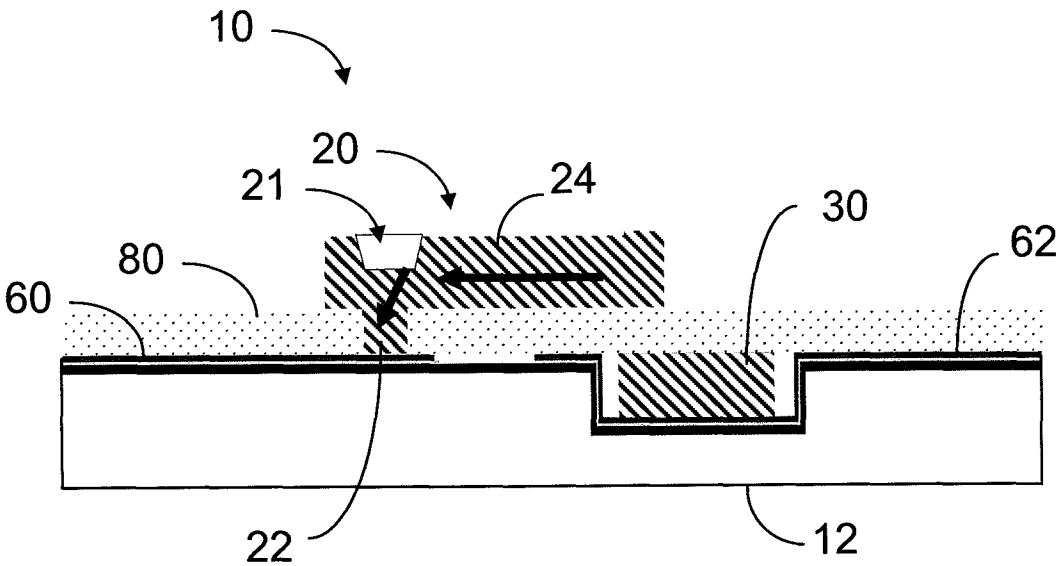
FIG. 2B is a schematic representation of a side section view showing residual stresses present in a switch prior to an oxide etch step.
Figure 2C:
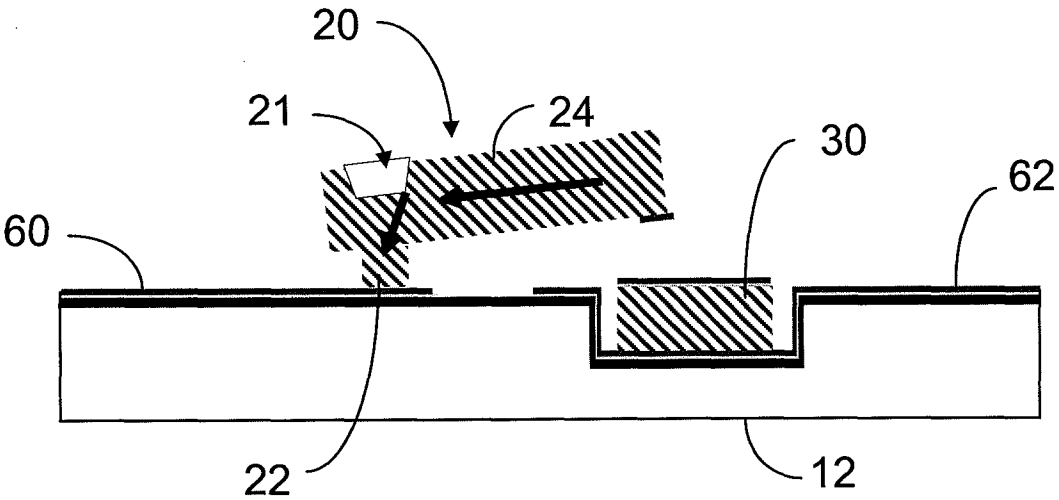
FIG. 2C is a schematic representation of a side section view showing deformation resulting from residual stresses present in the switch of FIG. 2B after an oxide etch step.

FIGS. 2B and 2C show a section view illustration that depicts the presence of residual stresses in mobile element 20 having a single anchoring member 22 prior to and after removal of a layer 80. Residual stresses are illustrated by the arrows within mobile element 20 as present through beam 24 and anchoring element 22. In some instances, as shown in FIGS. 2B and 2C, mobile element 20 may include a trench 21 above anchoring element 22. For example, upon fabrication, trench 21 may be formed proximate to anchoring element 22 as a step-up region. In some cases, residual stresses in a mobile element 20 having a trench 21 may give rise to larger deformation upon removal of layer 80 than a mobile element 20 without a trench. FIG. 2C illustrates the device after removal of the layer 80 and deposition of conductive contacts on both the mobile element 20 and the fixed element 30. Upon removal of the layer, mobile element 20 has a structure that behaves similar to a cantilever pivot about anchoring member 22. In addition, residual stresses present in mobile element 20 cause the beam 24 of mobile element 20 to, initially, deflect in an upward direction away from fixed element 30. Such initial deformation may result in an overall reduction of sensitivity in the switch to an external magnetic field. As discussed, the presence of trench 21 may give rise to increased initial deformation of mobile element 20. Although illustrated in some figures, it should be understood that not all embodiments of mobile elements presented will include a trench.

Turning now to other aspects, upon manufacture of a mobile element, in order to counteract tendencies for initial beam deformation, a plurality of anchoring members may be used. In one embodiment, employing a plurality of anchoring members substantially decreases the occurrence of initial beam deformation when the mobile element is manufactured. When the tendency for initial beam deformation is decreased, the switch may then exhibit an increased sensitivity to external magnetic fields. As a result, a low intensity magnetic field may be sufficient to actuate the switch.

Figure 3A:
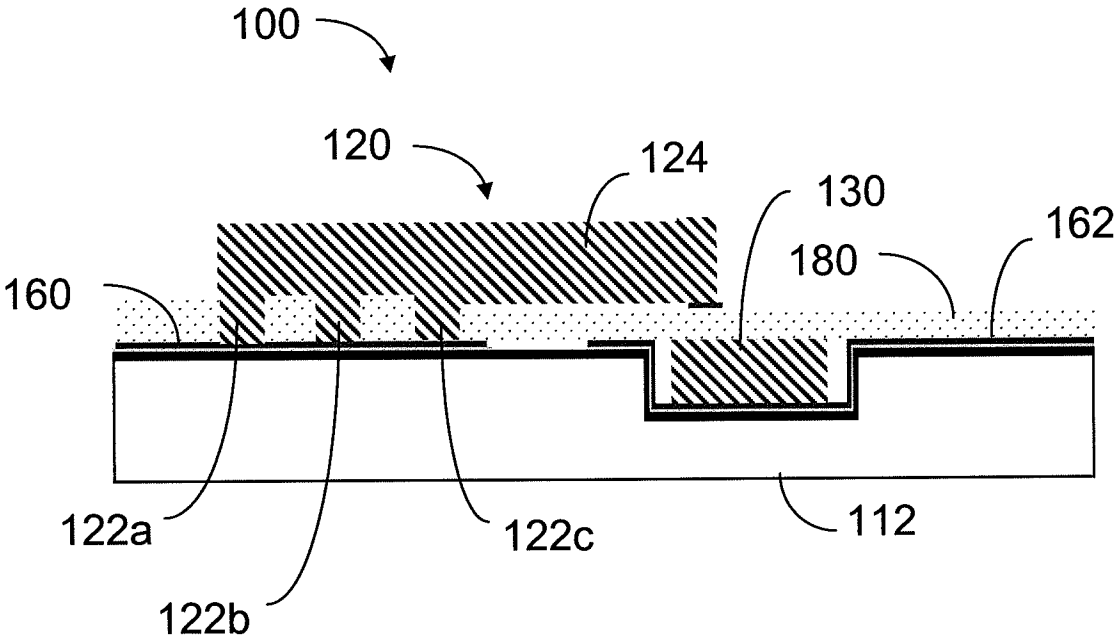
FIG. 3A is a schematic representation of a side section view of one embodiment of a switch prior to an oxide etch step.

To illustrate a schematic embodiment of a switch having a plurality of anchoring members, FIG. 3A shows a switch 100 including a layer 180. In some embodiments, layer 180 may be insulative. Mobile element 120 includes a beam 124 and a plurality of anchoring members 122*a*, 122*b*, and 122*c* that are spaced apart from one another. Each of anchoring members 122*a*, 122*b*, and 122*c* are electrically connected to conductive member 160 by a contact surface area. In some embodiments, upon fabrication, a mobile element 120 having multiple anchoring members may give rise to a substantially flat top surface (without a trench), giving rise to decreased initial deformation upon removal of layer 180.

Figure 3B:
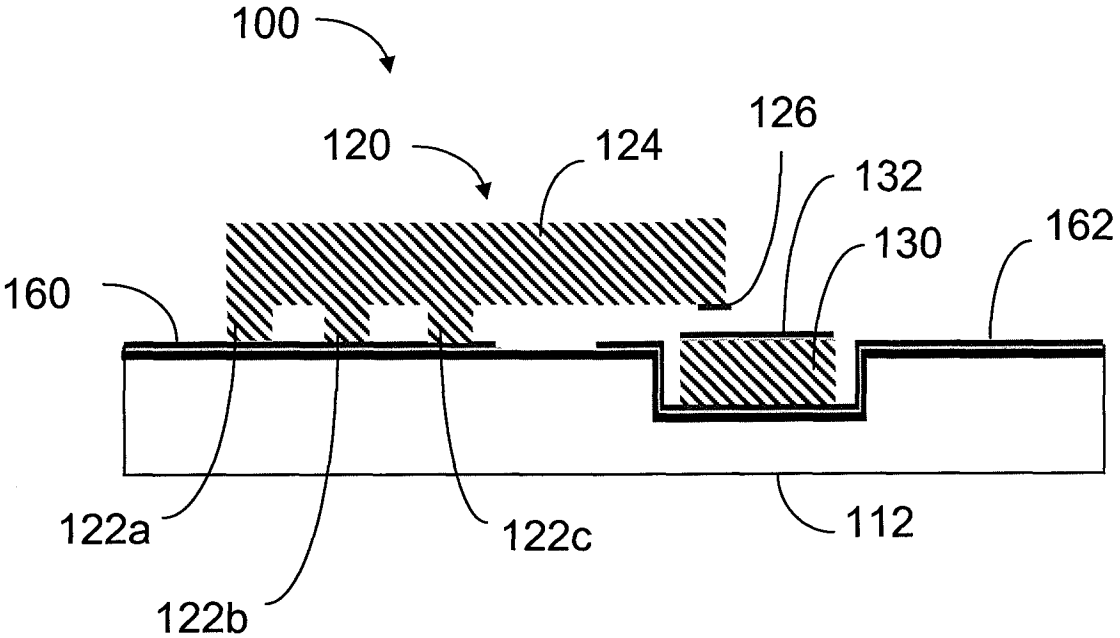
FIG. 3B is a schematic representation of a side section view of the switch of FIG. 3A after the oxide etch step.

As used herein, a contact surface area between two objects is the area of contact between those objects. It can be appreciated that a contact surface area arises when two objects contact each other, by virtue of the area of contact between the two objects. For example, a contact surface area between an anchoring member and a conductive member is the area of contact between the anchoring member and the surface of the conductive member. Similarly, for example, contact surface areas may also exist between anchoring members and a beam, as such contact surface areas may be the area of contact between each anchoring member and the beam. Another example is the contact surface area between a fixed element 130 and an underlying conductive member 162, which is the electrical connection formed between fixed element 130 and conductive member 162. In FIGS. 3A and 3B, the contact surface area between fixed element 130 and conductive member 162 is the entire bottom surface of fixed element 130.

Continuing with the schematic illustrated in FIG. 3B, when layer 180 is removed, although residual stresses may be present in mobile element 120, the initial upward deflection of beam 124 is significantly lessened as compared to a similar switch having a single anchoring member. In one embodiment, in addition to removal of layer 180, conductive material 126 is deposited on a portion of a bottom surface of the beam 124 of mobile element 120. Conductive material 132 is also deposited on a portion of the top surface of fixed element 130. Once an external force, such as a magnetic field, is applied to mobile element 120 that is sufficient to actuate mobile element 120 in a manner that brings conductive material 126 of mobile element 120 into electrical contact with conductive material 132 of fixed element 130, the switch is closed.

When in an open state, electrical current is unable to pass through each conductive portion. Yet, in a closed state, electrical current may travel through multiple conductive portions of the switch. In one embodiment, conductive member 160 makes up one conductive portion of switch 100 and is in electrical contact with mobile element 120. In one embodiment, conductive member 162, fixed element 130, and conductive material 132 make up another conductive portion of switch 100. In one embodiment, mobile element 120 is actuated to establish an electrical connection with conductive member 162, fixed element 130, and conductive member 162 so that current may flow between the conductive members 160 and 162.

Figure 4A:
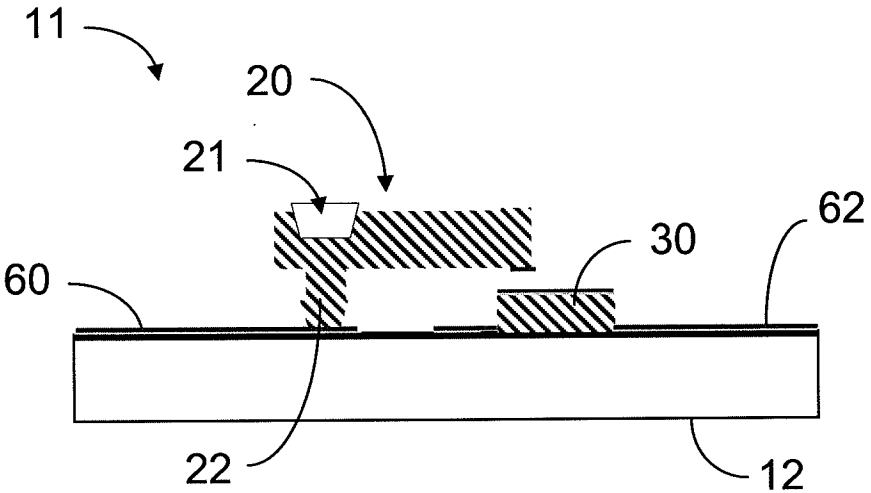
FIG. 4A is a schematic representation of a side section view of another embodiment of a switch in an open configuration.

FIG. 4A depicts a side view illustration of a switch 11 that includes a mobile element 20 and a fixed element 30 disposed on a substrate 12. In contrast to FIG. 1A, substrate 12 does not include a trench for fixed element 30 to be disposed within. Mobile element 20 includes a single anchoring member 22 that is in electrical contact with a conductive member 60 on the substrate 12. In some embodiments, as shown in FIG. 4A, mobile element 20 may include a trench 21. Fixed element 30 is in electrical contact with another conductive member 62 on the substrate 12. As illustrated, in the absence of an appropriate external force (e.g., magnetic field), no electrical pathway is provided through mobile element 20 and fixed element 30 and, hence, no current travels through conductive members 60 and 62. In one embodiment, the switch 11 of FIG. 4A may be considered to be a reed relay.

Figure 4B:
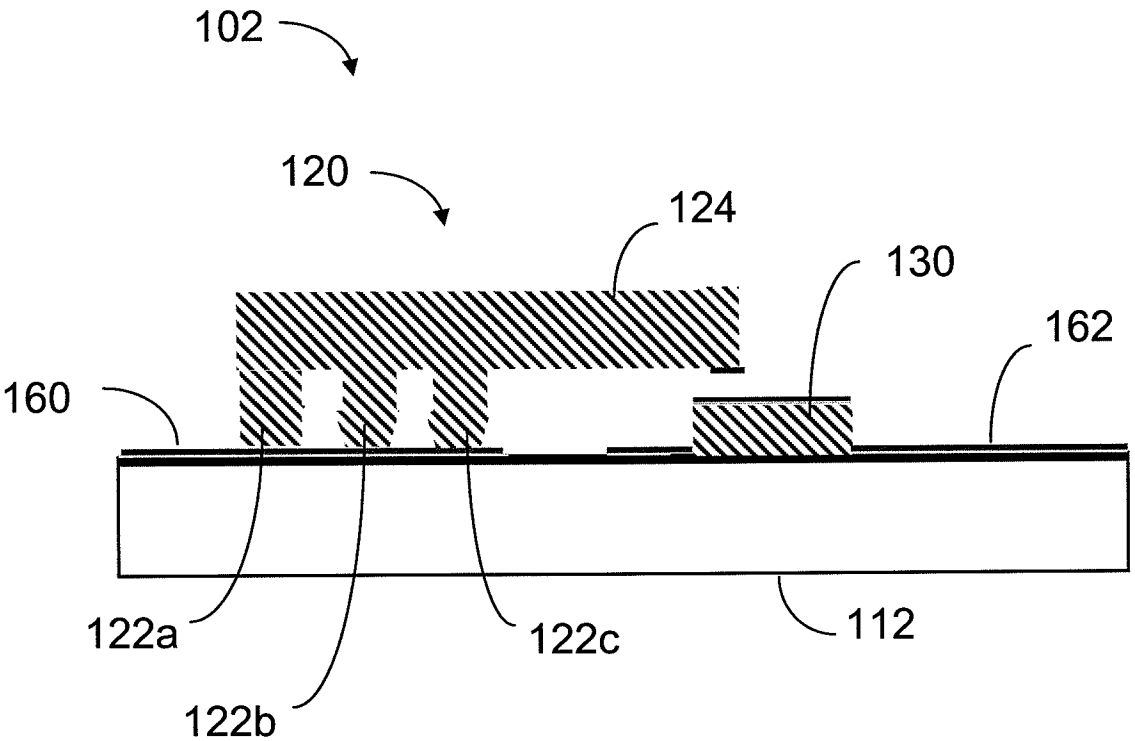
FIG. 4B is a schematic representation of a side section view of a further embodiment of a switch in an open configuration.

FIG. 4B illustrates a schematic embodiment of a switch 102 having a substrate 112 without a trench. A plurality of anchoring members 122*a*, 122*b*, and 122*c* are attached to beam 124 of mobile element 120. The plurality of anchoring members 122*a*, 122*b*, and 122*c* are spaced apart from one another and electrically connected to conductive member 160 by a contact surface area. In one embodiment, an initial upward deflection of beam 124 is lessened as compared to a single anchoring member embodiment. When an external force is applied to mobile element 120 that is sufficient to actuate mobile element 120 in a manner that brings mobile element 120 into electrical contact with fixed element 130, the switch is closed.

Figure 5A:
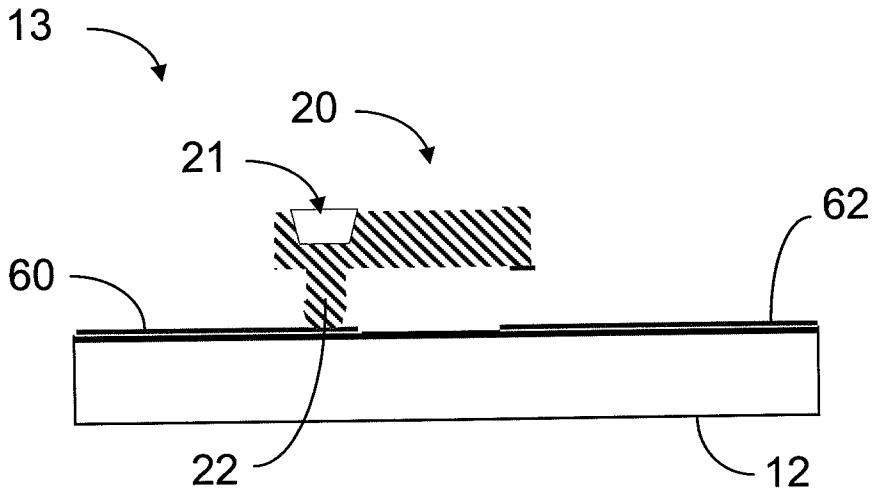
FIG. 5A is a schematic representation of a side section view of yet another embodiment of a switch in an open configuration.

In addition, FIG. 5A depicts a side view illustration of a switch 13 that includes a mobile element 20 and a substrate 12 without a fixed element disposed on the surface. Mobile element 20 includes a single anchoring member 22 that is in electrical contact with a conductive member 60 on the substrate 12. In some embodiments, as shown in FIG. 5A, mobile element 20 may include a trench 21. In the absence of an appropriate external force (e.g., magnetic field), no electrical pathway is provided through mobile element 20 and conductive member 62 and, hence, no current travels through conductive members 60 and 62. In one embodiment, the switch 13 of FIG. 5A may be considered to be a reed relay.

Figure 5B:
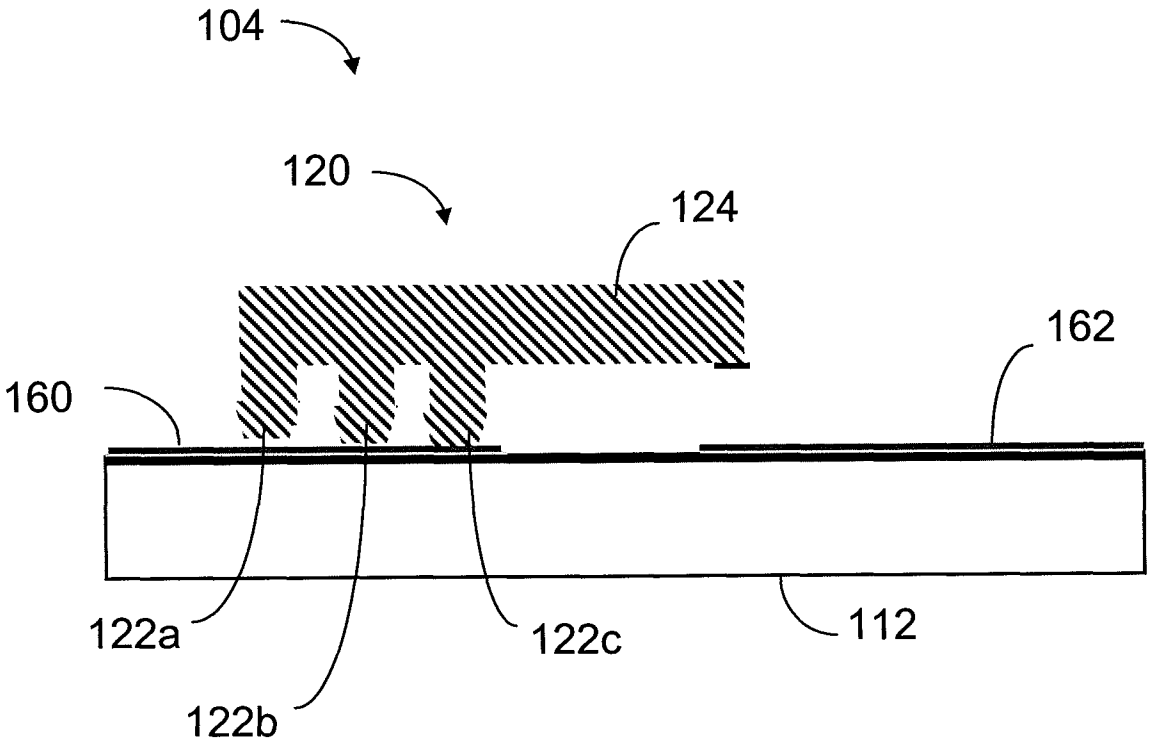
FIG. 5B is a schematic representation of a side section view of another embodiment of a switch in an open configuration.

FIG. 5B illustrates a schematic embodiment of a switch 104 having a substrate 112 without a fixed element disposed on the surface. A plurality of anchoring members 122*a*, 122*b*, and 122*c* are attached to beam 124 of mobile element 120. The plurality of anchoring members 122*a*, 122*b*, and 122*c* are spaced apart from one another and electrically connected to conductive member 160 by a contact surface area. In one embodiment, an initial upward deflection of beam 124 is lessened as compared to a single anchoring member embodiment. When an external force is applied to mobile element 120 that is sufficient to actuate mobile element 120 toward conductive portion 162 to form an electrical connection between conductive portions 160 and 162, the switch is closed.

As discussed above, actuation of mobile element may occur through exposure to an external magnetic field. It can be appreciated that mobile elements may include any appropriate magnetic material or combination of materials so as to be susceptible to external magnetic fields. In one embodiment, mobile elements include a soft NiFe material. As will be described below, magnetic materials such as NiFe, for example, may be deposited by electroplating on to a substrate and/or into vias. As a result, in one embodiment, deposition of NiFe into vias may give rise to anchoring members for a mobile element. In one embodiment, which will be described in more detail below, deposition of NiFe onto vias that are already filled with NiFe may give rise to a beam for a mobile element.

While mobile elements described may be actuated by an external magnetic field, other external forces may also be contemplated for mobile element actuation. In one embodiment, exposure to a physical force may actuate the mobile element. In some embodiments, exposure to a positive or a negative mechanical pressure may actuate the mobile element. For example, application of a fluid pressure on the mobile element could be sufficient to actuate the mobile element downward toward a fixed element of a conductive portion. Similarly, an outside vacuum pressure may be used to actuate the mobile element toward a fixed element of a conductive portion.

Turning back to the figures, it can be appreciated that mobile element 120 can include any suitable plurality of anchoring members that are formed in any appropriate pattern. For example, as shown in FIG. 6, embodiments include mobile elements that have a plurality of anchoring members 222 that are patterned in a grid-type configuration.

Figure 6:
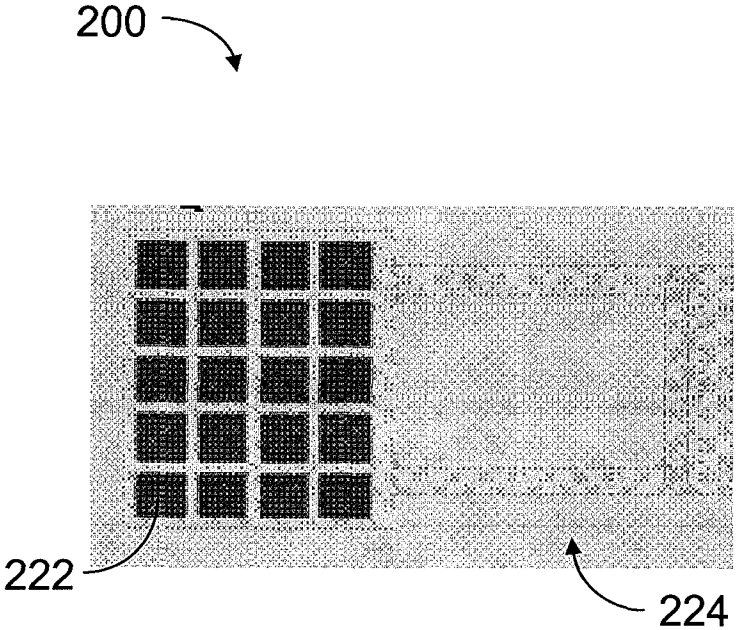
FIG. 6 is a schematic representation of a top view of one embodiment of a switch configuration.

In one embodiment, shown as a schematic top view in FIG. 6, a switch includes a mobile element 220 that includes a beam 224 and a plurality of anchoring members 222 that are patterned in a 4×5 grid. In another embodiment, a switch has a mobile element that includes anchoring members that are patterned in a 3×4 grid. In a further embodiment, a switch has a mobile element that includes anchoring members that are patterned in a 5×6 grid. It should be understood that other grid patterns not explicitly shown or described are also contemplated.

As illustrated in FIG. 6, contact surface areas of each anchoring member with a conductive member are substantially equal to one another. However, it can also be appreciated that contact surface areas of anchoring members are not required to be substantially equal, as portions of each anchoring member can have any appropriate size. In some embodiments, the grid pattern of anchoring members in FIG. 6 can be contrasted with a single anchoring member that takes up the same volume of space (not shown). As discussed above, the grid pattern of anchoring members has a decreased contact surface area with the underlying conductive member than in the case with a single anchoring member. However, the grid pattern of anchoring members, in addition to other arrangements of pluralities of anchoring members, may give rise to decreased beam deformation in the mobile element. Despite less overall material incorporated in the plurality of anchoring members, having more surface area in the anchoring members may have beneficial effects that result in increased switch sensitivity.

Figure 7:
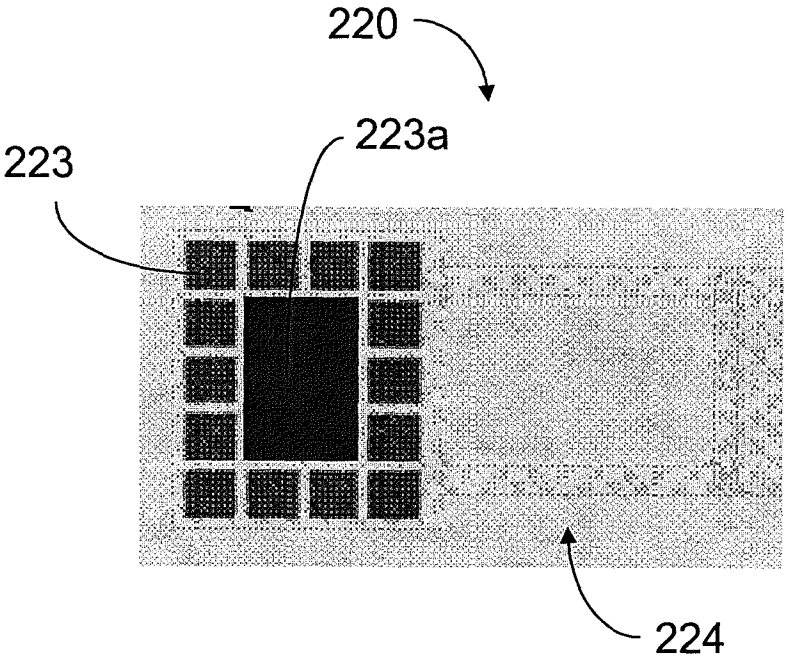
FIG. 7 is a schematic representation of a top view of another embodiment of a switch configuration.

In another embodiment, schematically shown in FIG. 7, a mobile element 220 includes a beam 224 and a plurality of anchoring members 223 that surround a central anchoring member 223*a*. Anchoring member 223*a* is illustrated as having a substantially larger contact surface area on an underlying conductive member than other surrounding anchoring members 222. It can be appreciated that contact surface areas of anchoring members in a mobile element with an underlying conductive member may vary in size, as appropriately desired.

In addition to the contemplated size variation of contact surface areas in anchoring members, anchoring members may also be disposed in any appropriate arrangement. As discussed above, in some embodiments, anchoring members are disposed in a grid-like configuration where anchoring members have contact surface areas that are similar in size. It can be appreciated that anchoring members disposed in a grid-like configuration are not required to have contact surface areas having similar sizes. In other embodiments, anchoring members are not arranged in a grid formation. In some embodiments, anchoring members are symmetrically arranged. In further embodiments, anchoring members are arranged in a gradient-type configuration. For example, anchoring members may have contact surface areas that are larger or smaller depending on the proximity of the anchoring members to portions of the beam on the mobile element. In yet more embodiments, anchoring members are arranged in an irregularly patterned configuration.

Figure 8:
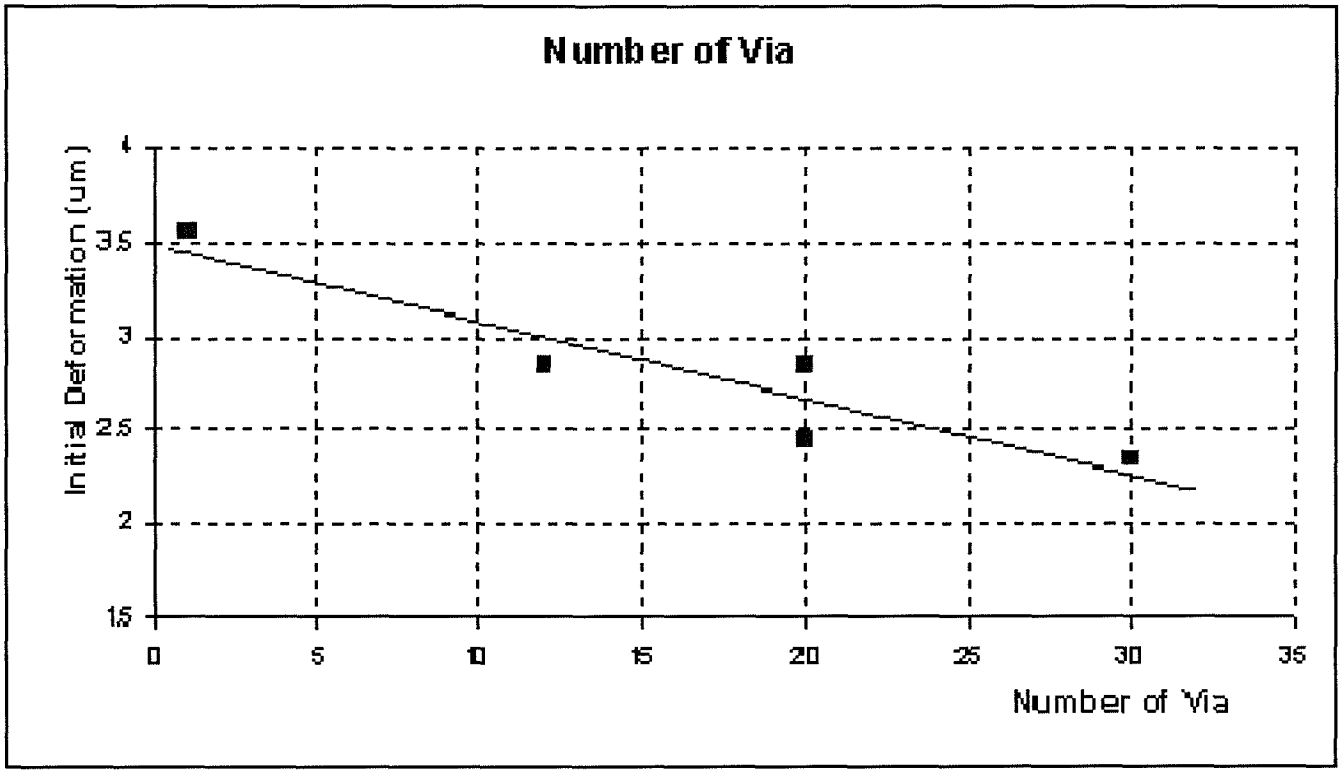
FIG. 8 is a schematic representation of a graph of the relationship between the number of vias and an initial deformation on various switch configurations.
Figure 9:
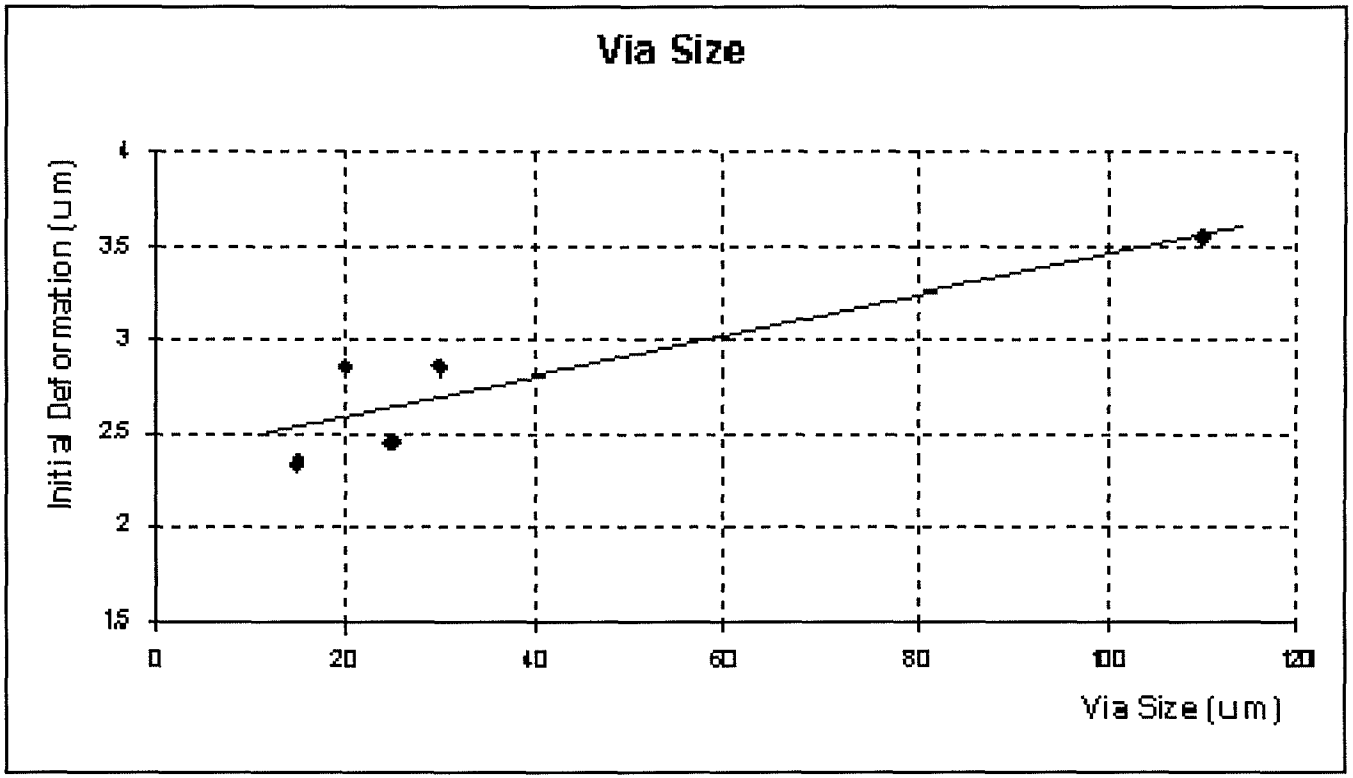
FIG. 9 is a schematic representation of a graph of the relationship between the size of a via and an initial deformation on various switch configurations.

As will be described further below, vias may be formed in a layer where material deposited in those vias may give rise to anchoring members. FIG. 8 depicts a graph that illustrates, for an embodiment having a grid pattern, a relationship between the number of vias formed in a layer and an initial deformation of a mobile element upon manufacture. As shown, the greater the number of vias formed in the layer, the less the initial deformation of the mobile element upon manufacture. For example, in a switch having one anchoring member, the initial deformation is greater than 3.5 microns. However, in a switch having 30 anchoring members, the initial deformation is less than 2.5 microns. In one embodiment, for a switch having 12 anchoring members, the initial deformation is between 2.5 and 3 microns. In one embodiment, for a switch having 20 anchoring members, the initial deformation is between 2.5 and 3 microns. In another embodiment, for a switch having 20 anchoring members, the initial deformation is less than 2.5 microns. As alluded to above, when the number of anchoring members is increased, the overall contact surface area with the underlying conductive member is decreased. However, an overall increase in surface area of portions of anchoring members that do not directly contact the conductive member may mitigate tendencies for beam deformation resulting from residual stresses. It can be appreciated that results may vary according to other arrangements of anchoring members. For example, anchoring members having different amounts of contact surface area with a conductive member may give rise to varying values of initial deformation.

Where the number of vias formed in a grid pattern within a layer affects the initial deformation of a mobile element upon manufacture, it follows that the size of the vias formed in a grid pattern within a layer would also affect initial deformation. FIG. 9 depicts another graph that illustrates, for embodiments with anchoring members disposed in a grid pattern, a general trend between the size of vias formed in a layer and an initial deformation upon manufacture of mobile elements. In the embodiments shown in FIG. 9, size of the vias is measured as the width of the vias in microns. However, it can be appreciated that via size can be recorded by any appropriate measure.

FIG. 9 illustrates that the initial deformation of the mobile elements increases as the size of the vias formed in the layer increases. For example, in a switch having one large via that gives rise to a single anchoring member, having a large contact surface area with an underlying conductive member, the initial deformation is greater than 3.5 microns. However, in a mobile element having several anchoring members, where the contact surface areas are smaller (e.g., width of less than 20 microns), the initial deformation is less than 2.5 microns. As discussed above, results may be different according to various anchoring member arrangements. For example, in mobile elements where the contact surface areas of anchoring members and an underlying conductive member vary, the graph in FIG. 9 is less applicable.

In addition to fabricating mobile elements having a plurality of anchoring members, to reduce deformation resulting from residual stresses, the residual stress itself may be mitigated by employing low temperature stress release techniques. As a result, minimal deformation occurs. In some embodiments, an alloy compatible with magnetic material(s) used to form the switch is incorporated with the magnetic material(s) and subject to a process of stress relaxation. In some embodiments, a switch may be exposed to an increased temperature for a predetermined time for stress relaxation to occur. For example, a switch may be exposed to temperatures near 250 C for approximately 1 hour. It can be appreciated that a combination of techniques described above may be used to minimize initial beam deformation. For example, a mobile element that is manufactured to have a plurality of anchoring members may also incorporate alloys that are used for stress relaxation.

Approaches described herein may substantially improve the overall performance of switches. In some embodiments, switches described may be more sensitive to external magnetic fields than other switches. In some cases, an electrical pathway between separate conductive portions of a switch may be formed from electrical contact between a mobile element and a fixed element when the magnetic field is less than about 20 mT; less than about 10 mT; less than about 5 mT; or about 2 mT. In some embodiments, the initial upward deformation of a beam upon manufacture of the mobile element may be minimized. For example, an initial upward deformation of the beam may be less than about 20 microns; less than about 10 microns; less than about 5 microns; or less than about 3 microns.

Various embodiments for manufacturing of switches will now be described in connection with FIGS. 10A-10T, which depict section views of illustrative embodiments of fabrication procedures for switches that may be actuated by an external magnetic field.

Figure 10A:
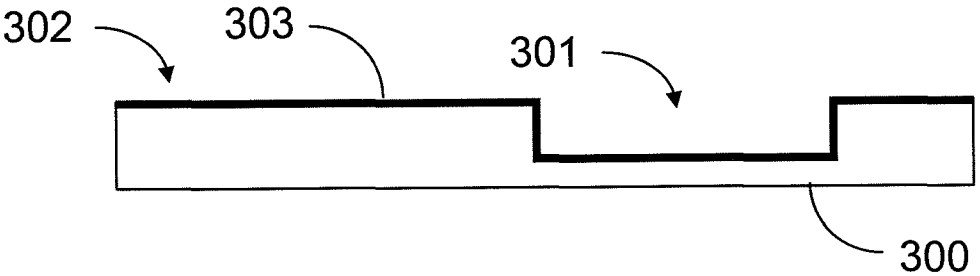
FIGS. 10A-10T show various stages of embodiment(s) of a switch, where.

FIG. 10A illustrates a substrate 300 with a top surface 302 and a trench 301 etched into the substrate. In some embodiments, trench 301 may be etched into the substrate 300 so that conductive and/or magnetic material may be later deposited into the trench 301. In one embodiment, a significant portion of substrate 300 is formed of silicon. In one embodiment, trench 301 is formed by reactive ion etching using an inductively coupled plasma etcher. Suitable etchers are available, for example, from Surface Technology Systems, Inc. It should be understood that the methods presented herein are not limited in this respect, as other suitable techniques and systems for etching may be employed.

In some embodiments, surface 302 may be covered with one or more oxide and/or nitride layers 303 that are deposited on the substrate 300. Oxide and/or nitride layers 303 may be present to better facilitate the adherence of conductive materials to be deposited on to the device wafer in subsequent steps. In one embodiment, layer 303 is deposited on the surface 302 of substrate 300 as a thermal oxide having a thickness of approximately 300 angstroms. In one embodiment, layer 303 is deposited by low-pressure chemical vapor deposition on the surface 302 as a silicon nitride layer having a thickness of approximately 1,500 angstroms; or 1,000 angstroms. It can be appreciated that other materials having layers of appropriate thicknesses may be suitable for use in surface 302 on the substrate. It can also be appreciated that, for some embodiments, no additional layer 303 is deposited and surface 302 is primarily made up of the same material as substrate 300, for example, silicon.

Figure 10B:
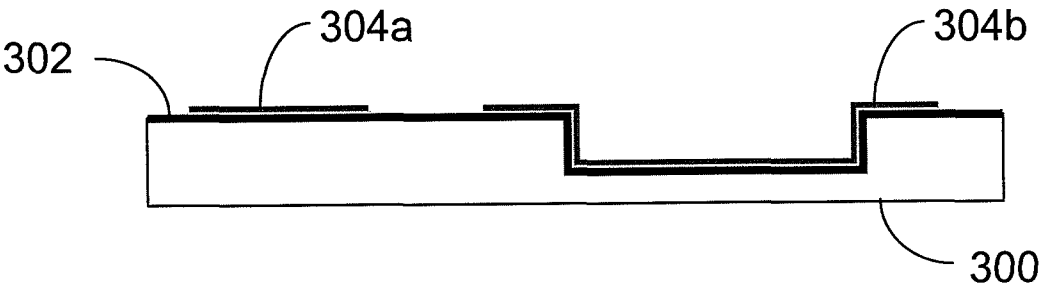
FIG. 10B is a schematic representation of a deposition of a conductive material on the substrate of FIG. 10A.

In FIG. 10B, conductive materials 304*a* and 304*b* are deposited on the substrate surface 302. In an embodiment, upon manufacture of the switch, conductive material 304*a* forms a conductive portion that is electrically connected to a mobile element and conductive material 304*b* forms a conductive portion that is electrically connected to a fixed element. That is, in an open configuration, conductive materials 304*a* and 304*b* are not in electrical contact with one another. However, in a closed configuration, an electrical pathway is established between conductive materials 304*a* and 304*b*. In one embodiment, the conductive materials 304*a* and 304*b* are sputtered and patterned on to a silicon surface 302 as a signal line and a bonding pad. Conductive materials 304*a* and 304*b* may be deposited by any appropriate method, for example, through use of a resist mask. In one embodiment, conductive materials 304*a* and 304*b* include a Cr layer that is approximately 300 angstroms thick. In one embodiment, conductive materials 304*a* and 304*b* include an Au layer that is approximately 5,000 angstroms thick.

Figure 10C:
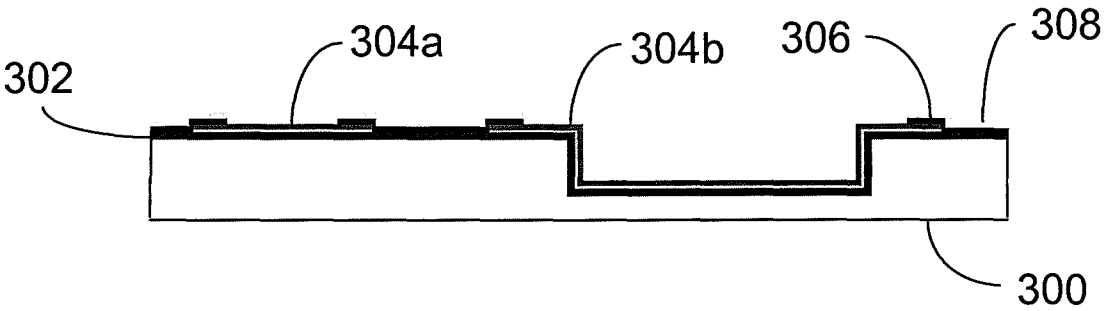
FIG. 10C is a schematic representation of deposition of another conductive material on the conductive material of FIG. 10B.

FIG. 10C shows another conductive material 306 that is deposited on to portions of conductive materials 304*a* and 304*b* and a further conductive material 308 that is deposited on to conductive material 306. Conductive materials 306 and 308 provide for a temporary seed layer above which a photoresist and/or a layer can be deposited for further processing. After the layer is removed, conductive materials 306 and 308 can also be removed. In one embodiment, conductive material 306 is sputtered and patterned as a Ti coating using a wet etch technique. In one embodiment, conductive material 308 is sputtered and patterned as a Cu coating also using a wet etch technique. In one embodiment, conductive material 306 includes a Ti layer that is approximately 300 angstroms thick. In one embodiment, conductive material 308 includes a Cu layer that is approximately 1,000 angstroms thick. It can be appreciated that conductive materials 306 and 308 may be deposited by any suitable technique, such as through use of appropriate masking methods.

Figure 10D:
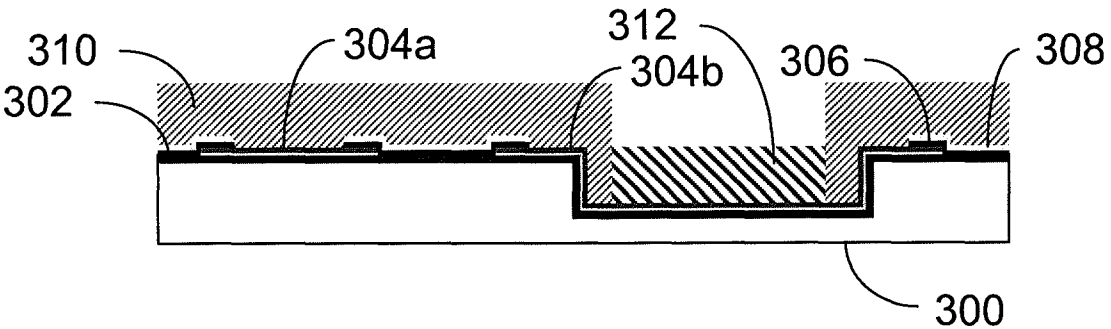
FIG. 10D is a schematic representation of deposition of a photoresist and a magnetic material on the conductive materials of FIGS. 10B and 10C.

As depicted in FIG. 10D, a photoresist 310 is then deposited on portions of conductive materials 304*a*, 304*b*, and 308. In an embodiment, photoresist 310 is patterned on to conductive materials 304*a*, 304*b*, and 308 so that a magnetic material 312 may be selectively deposited on a region of conductive material 304*b* that is within trench 301. In one embodiment, magnetic material 312 is an electrically plated NiFe alloy having a thickness of about 5-8 microns. In one embodiment, photoresist 310 may be approximately 10 microns thick.

In one embodiment, magnetic material 312 forms a significant portion of a fixed element for switches described herein. In some embodiments, magnetic material 312 is approximately 8 microns thick. However, it can be appreciated that magnetic material 312 can formed of any suitable material and in any dimension. Indeed, magnetic material 312, although described in some embodiments as inherently magnetic, may be formed of a material that exhibits conductive properties, yet does not exhibit magnetic properties.

Figure 10E:
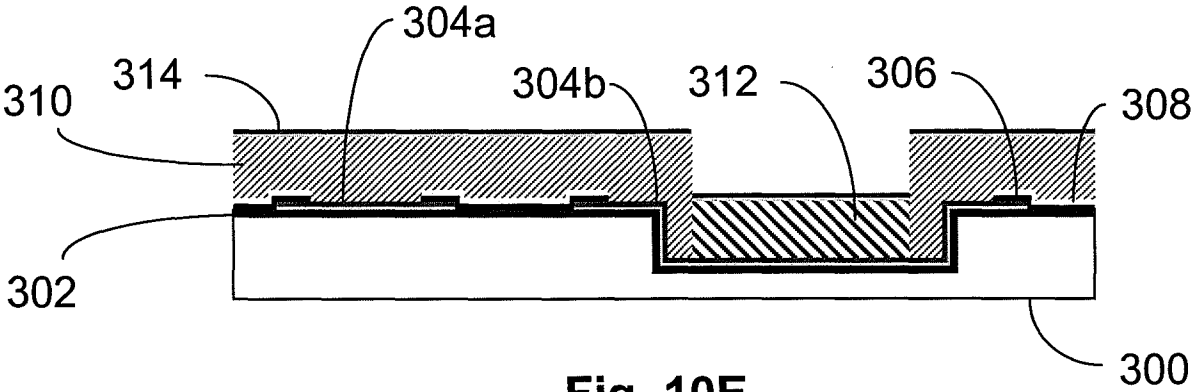
FIG. 10E is a schematic representation of deposition of a conductive material on the magnetic material and the photoresist of FIG. 10D.

Moving to FIG. 10E, in an embodiment, to form a top conductive surface of a fixed element in a switch, conductive material 314 is deposited on photoresist 310 and magnetic material 312. In one embodiment, conductive material 314 is Cr/Au and is evaporated on to photoresist 310 and magnetic material 312. As described, conductive material 314 provides a region of contact for a conductive portion of a switch where an electrical connection is established with an end portion of a mobile element when the switch is actuated to a closed configuration. In some embodiments, conductive material 314 may include gold having a thickness of approximately 1,000 angstroms. In one embodiment, conductive material 314 also may include Cr having a thickness of approximately 300 angstroms. As described in the next step, upon removal of photoresist 310, magnetic material disposed on the photoresist 310 is also removed.

Figure 10F:
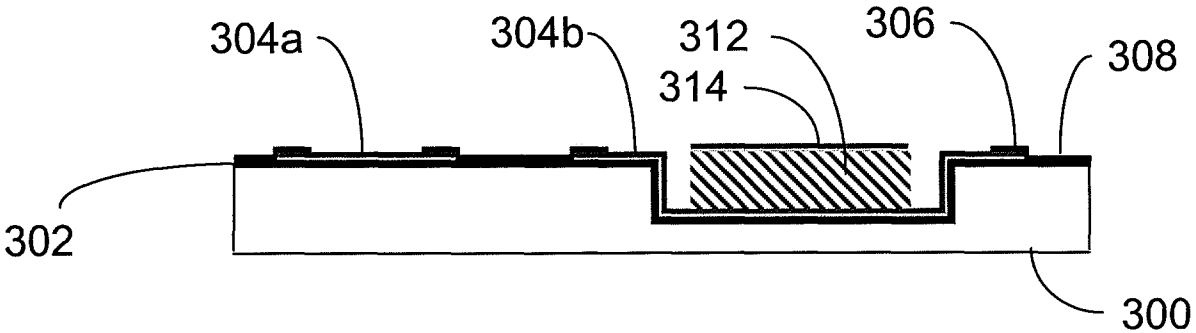
FIG. 10F is a schematic representation of removal of the photoresist of FIGS. 10D and 10E with a portion of a conductive material remaining on the magnetic material.

Photoresist 310 and portions of magnetic material 314 that do not cover magnetic material 312 are removed, shown in FIG. 10F. As a result, while the portion of conductive material 314 that was deposited on photoresist 310 is removed, the portion of conductive material 314 that was deposited on magnetic material 312 remains. In one embodiment, photoresist 310 is removed by sonication. For example, the wafer may be placed in an ultrasonic machine where parameters are adjusted so as to remove the photoresist.

Figure 10G:
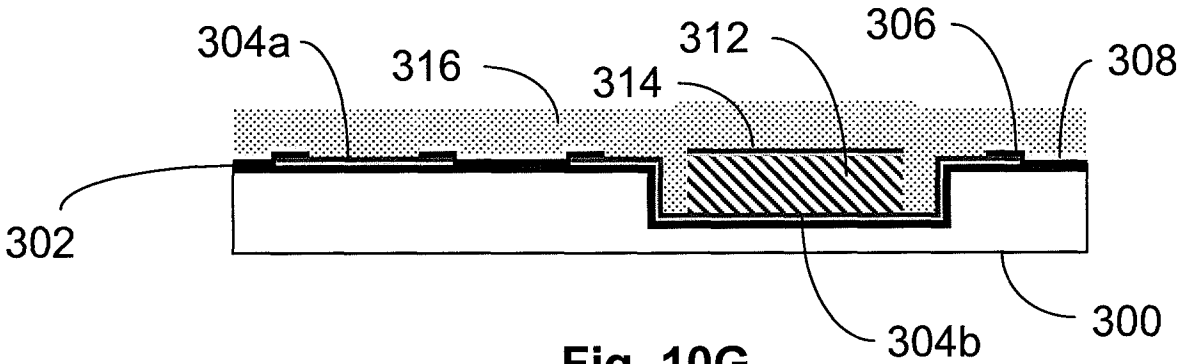
FIG. 10G is a schematic representation of deposition of an insulation layer on the wafer shown in FIG. 10F.

After photoresist 310 is removed, a layer 316 may be deposited on the device wafer, as illustrated in FIG. 10G. In an embodiment, and as described above, layer 316 is used as a template in which vias and subsequent anchoring members may be formed. In one embodiment, the layer 316 is an amorphous silicate material, such as for example, an undoped silicate glass. In an embodiment, undoped silicate glass is deposited at low stress on the device wafer on to conductive materials 304*a*, 304*b*, 306, and 314. In one embodiment, layer 316 includes undoped silicate glass having a thickness of approximately 5 microns. It can be appreciated that any suitable material may be deposited as layer 316 and by an appropriate method.

Figure 10H:
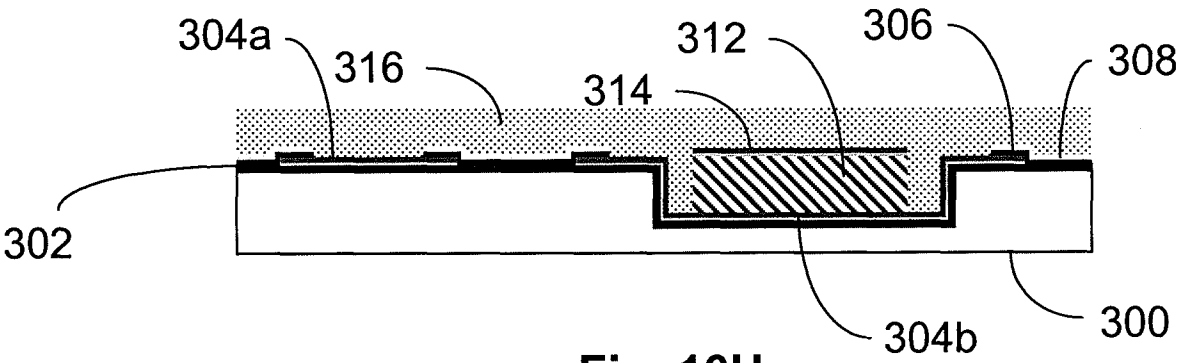
FIG. 10H is a schematic representation of a step of planarizing the insulation layer of FIG. 10G.

FIG. 10G also illustrates uneven surfaces that may arise upon deposition of a layer 316. So that further device fabrication may occur, the surface of layer 316 may be planarized, as shown in FIG. 10H. Once layer 316 is appropriately planarized, further deposition may occur.

In one embodiment, layer 316 is planarized using an oxide chemical mechanical polishing technique. However, it can be appreciated that any suitable planarization technique may be used. In one embodiment, after planarization, layer 316 may have a thickness of approximately 4 microns.

Figure 10I:
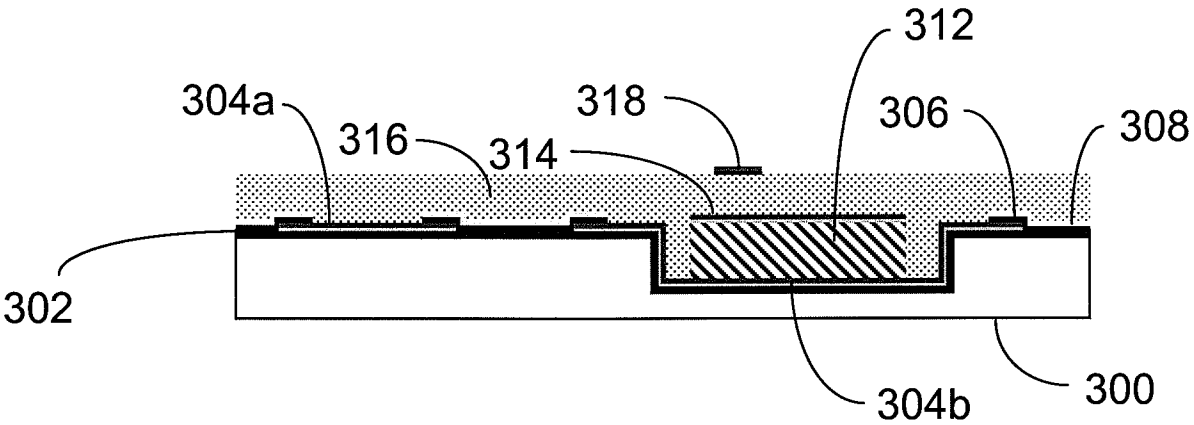
FIG. 10I is a schematic representation of deposition of another conductive material on the insulation layer of FIG. 10H.

FIG. 10I depicts a conductive material 318 that is deposited on a portion of the planarized layer 316. In one embodiment, the conductive material 318 makes up a region on an end portion of a beam for mobile elements that are described above. The region on the end portion of the beam where conductive material 318 is disposed faces toward conductive material 314 such that when the finished switch is in a closed configuration, conductive materials 314 and 318 are in electrical contact. In an embodiment, conductive material 318 is made up of Ti/Au that is sputtered and patterned on to the layer 316. It can be appreciated that any appropriate masking or patterning technique may be used. In some embodiments, conductive material 318 includes Au having a thickness of approximately 1,000 angstroms. In one embodiment, conductive material 318 includes Ti having a thickness of approximately 200 angstroms.

Figure 10J:
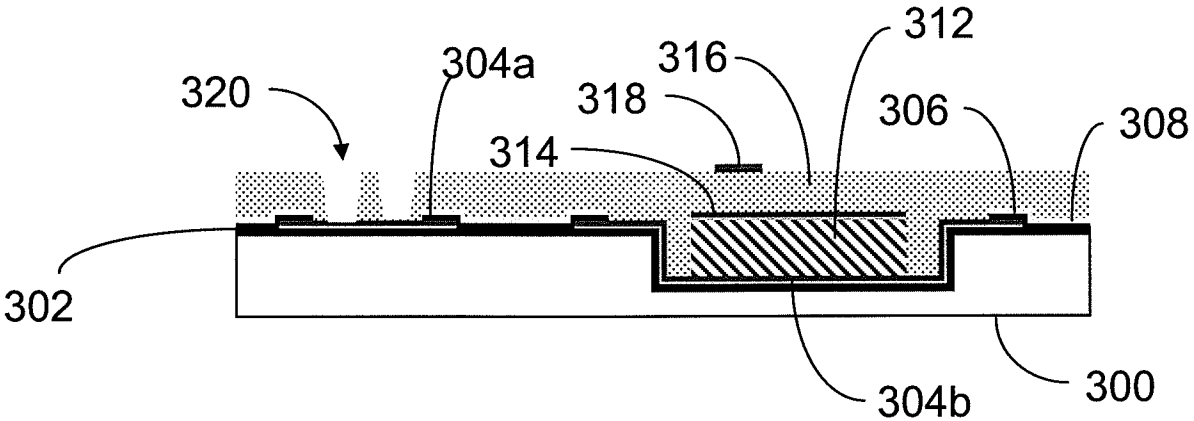
FIG. 10J is a schematic representation of vias that are etched into the insulation layer of FIG. 10I.

As mentioned previously, vias may be formed in a layer so that a plurality of anchoring members may be formed in the vias. FIG. 10J depicts a plurality of vias 320 that are etched into the layer 316. In an embodiment, vias 320 expose regions of conductive material 304*a*, where those regions of conductive material 304*a* give rise to contact surface areas of anchoring members. It can be appreciated that any arrangement of vias may be etched into the layer 316 using any appropriate method, such as through etching.

As discussed above with respect to the formation of anchoring members, vias are formed by any suitable pattern in the layer. Vias may also be spaced apart from one another, in turn, giving rise to anchoring members that are spaced apart from one another. As a result, contact surface areas of anchoring members and underlying conductive regions are also spaced apart from one another. In some embodiments, a number of vias may be formed in the layer in a grid-type pattern (e.g., 3×4, 4×5, or 5×6 grids). In some embodiments, a number of vias may be formed having surface areas that are relatively equal to one another. In some embodiments, a number of vias may be formed having surface areas that are unequal from one another. In view of anchoring members illustrated in FIG. 7, in one embodiment, vias may be formed such that a central via is provided adjacent to other vias where the central via has a surface area that is greater than the surface area of other surrounding vias. It can be appreciated that any suitable number of vias may be formed in a layer where the vias have any appropriate surface area and distribution in the layer. It can also be appreciated that surface areas of vias may correspond to contact surface areas between anchoring members and conductive regions that are in contact with the anchoring members.

For example, as depicted in FIG. 10J, vias are smaller in surface area at the region where conductive material 304*a* is exposed than at the opening region near the top of layer 316. It should be understood that vias may have any suitable geometry and respective surface area. For example, vias may have a substantially equal surface area at the region where conductive material 304*a* is exposed compared to the surface area at the opening region near the top of layer 316. Indeed, the surface area at the region where conductive material 304*a* is exposed may be greater than the surface area at the opening region near the top of layer 316.

Figure 10K:
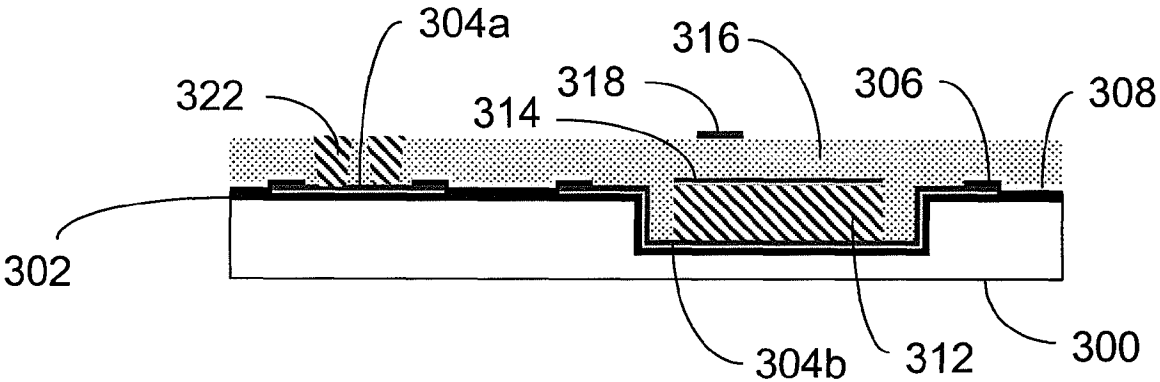
FIG. 10K is a schematic representation of deposition of a magnetic material in the vias of FIG. 10J.

Next, a suitable material may be deposited into the vias so as to give rise to the formation of anchoring members. FIG. 10K illustrates deposition of a magnetic material 322 into vias 320. In one embodiment, NiFe alloy is deposited into the vias by electrical plating techniques. Magnetic material 322 forms a substantial portion of anchoring members for a mobile element. Indeed, for an embodiment, when a plurality of vias are provided in the layer 316, magnetic material 322 may be deposited into each of the vias so as to form a plurality of anchoring members of a mobile element. Once magnetic material 322 is deposited in the plurality of vias 320 within layer 316, the beam portion of a mobile element may subsequently be formed.

Figure 10L:
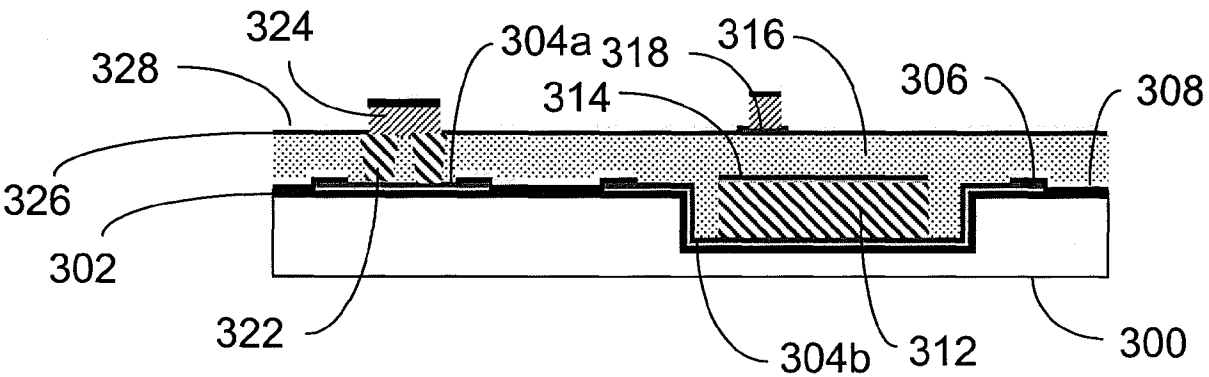
FIG. 10L is a schematic representation of deposition of a photoresist and another conductive material on the magnetic material and conductive material of FIGS. 10I and 10K.

In forming the beam portion of the mobile element, in one embodiment, the beam contacts both magnetic material 322 and conductive material 318. FIG. 10L depicts deposition of a photoresist 324 over the vias that contain magnetic material 322 as well as over conductive material 318. Photoresist 324 serves to provide a method where one end of the beam contacts the anchoring members and the other end of the beam contacts the conductive material 318.

In addition, FIG. 10L illustrates conductive materials 326 and 328 that are successively deposited on layer 316 and photoresist 324. Conductive materials 326 and 328 provide for a seed layer where further layers of deposition may occur. In particular, an additional photoresist 334 and a magnetic material 336 are contemplated for deposition on the seed layer provided by conductive materials 326 and 328, as described further below. In one embodiment, conductive material 326 is Ti and conductive material 328 is Cu. In some embodiments, conductive materials 326 and 328 are deposited by e-beam evaporation. In one embodiment, conductive material 326 includes Ti having a thickness of approximately 100 angstroms. In one embodiment, conductive material 328 includes Cu having a thickness of approximately 1,000 angstroms. It can be appreciated that conductive materials 326 and 328 may include a suitable material that is deposited by an appropriate method.

Figure 10M:
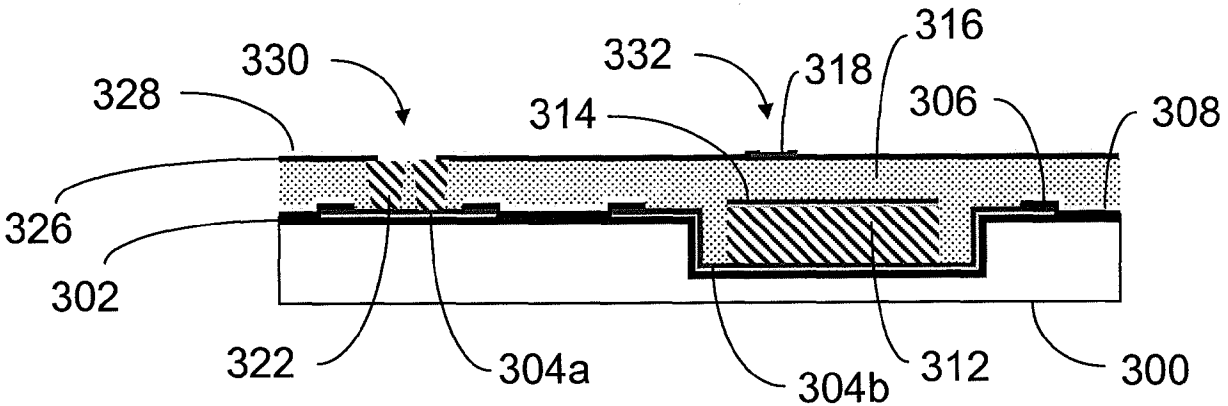
FIG. 10M is a schematic representation showing removal of the photoresist shown in FIG. 10L.

FIG. 10M illustrates locations 330 and 332 that indicate regions of contact for the beam of a mobile element. In order to expose locations 330 and 332, photoresist 324 and the conductive materials 326 and 328 that are deposited on top of the photoresist are appropriately removed. It can be seen, however, that regions of conductive materials 326 and 328 remain on other portions of the wafer as seed layers for further deposition. It can be appreciated that photoresist 324 may be removed by any appropriate technique. In one embodiment, photoresist 324 is removed by sonication through use of an ultrasonic machine.

Figure 10N:
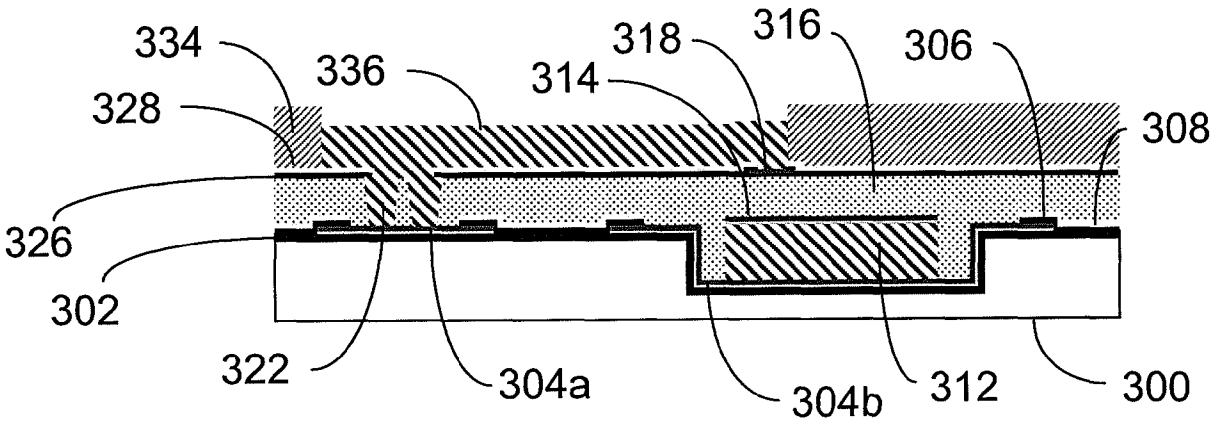
FIG. 10N is a schematic representation of deposition of another magnetic material and a photoresist on the wafer of FIG. 10M.

Next, so that the rest of the mobile element may be formed, a photoresist 334 is appropriately patterned on to conductive material 328 so as to provide a template for additional magnetic material to be deposited. Illustrated in FIG. 10N, for an embodiment, once photoresist 334 is appropriately deposited, magnetic material 336 is subsequently deposited in regions where the photoresist 334 is not present. Magnetic material 336 is deposited on to magnetic material 322 and on to conductive materials 318, 326, and 328. In one embodiment, magnetic material 336 is a NiFe alloy that is plated on to magnetic material 322 and conductive materials 318, 326, and 328. Upon fabrication of switches described, magnetic material 336 forms a substantial portion of a beam in a mobile element. In this regard, the mobile element includes the beam that is formed by magnetic material 336 which extends away from anchoring members that are formed by magnetic material 322. In some embodiments, magnetic material 336 is approximately 8 microns thick.

At this point during manufacture, since the overall structure of the mobile element has, for the most part, been fabricated, further processing steps presented involve removal of material so as to expose the structure of the switch as well as the inclusion of added features.

Figure 10O:
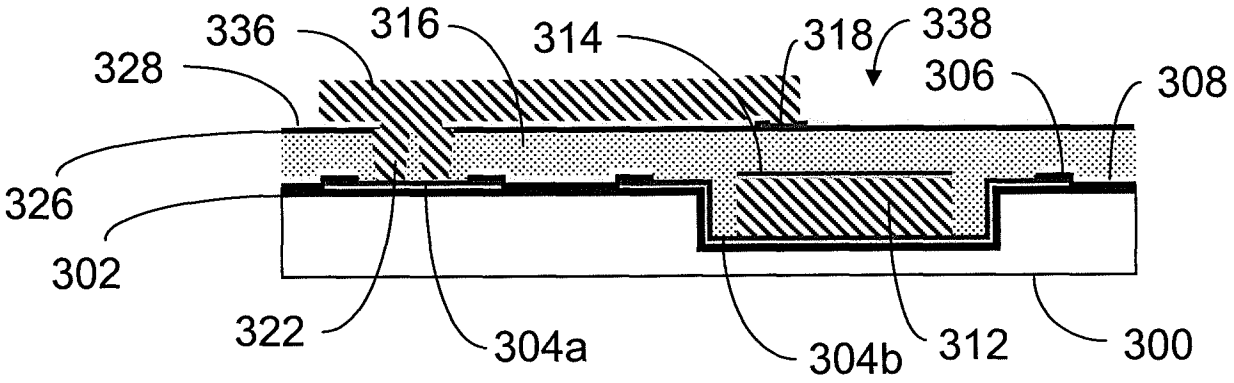
FIG. 10O is a schematic representation of removal of the photoresist of FIG. 10N.

In one embodiment, after magnetic material 336 has been deposited, photoresist 334 is removed from a location 338 to better expose magnetic material 336, as shown in FIG. 10O. It can be appreciated that photoresist 334 may be removed by any appropriate technique. In one embodiment, photoresist 334 is removed by sonication through use of an ultrasonic machine. In one embodiment, the wafer may be subject to an annealing step in order to remove residual stress gradients. For example, an anneal step may include temperatures of approximately 250 C for about 2 hours.

Figure 10P:
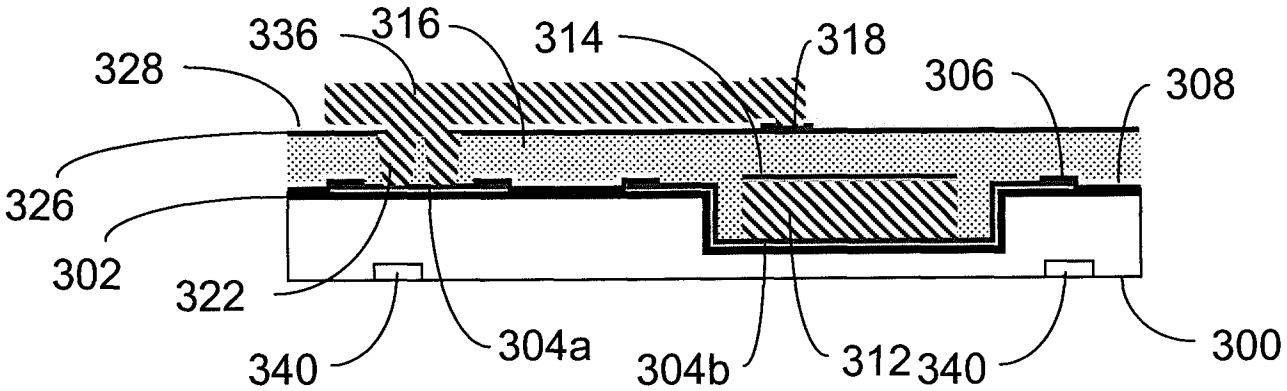
FIG. 10P is a schematic representation of backside patterning of the wafer of the step of FIG. 10O.

In some embodiments, as shown in FIG. 10P, backside patterning 340 may be employed so that electrical components may be further incorporated into the overall device according to a pattern or desired configuration. In one embodiment, the substrate 300 is thinned from the backside, and the backside is patterned accordingly. In some embodiments, the substrate 300 is etched on the backside. It can be appreciated that backside patterning 340 is not a necessary step in fabrication of switches described herein and can be performed at any suitable process step during device fabrication.

Figure 10Q:
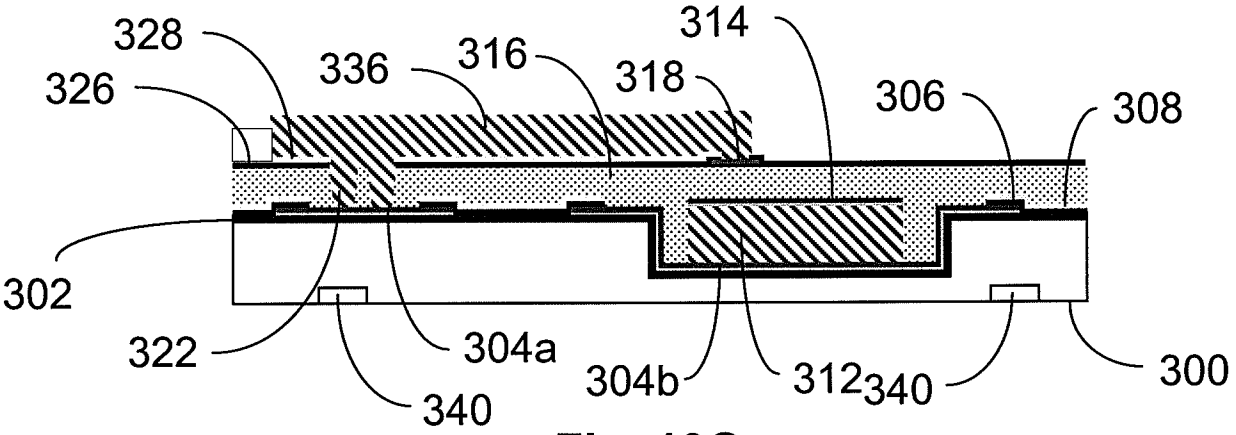
FIG. 10Q is a schematic representation of an etch step removal of a conductive material from the wafer depicted in FIG. 10P.

To release more structure of the switch, FIG. 10Q illustrates removal of exposed portions of conductive material 328. As shown, while portions of conductive material 328 remain in regions that are below magnetic material 336, portions of conductive material 328 that are exposed (not below magnetic material 336) have been removed. In one embodiment, conductive material 328 is subject to an etchant, such as a Cu etchant. In some embodiments, after removal of exposed portions of the conductive material 328, an annealing step is performed. In some cases, annealing may be performed to reduce stress gradient(s) that may be present in the magnetic material. Such stress gradient reduction may result in increased repeatability of the switch. Subsequently, conductive material 326 and layer 316 may then be removed.

Figure 10R:
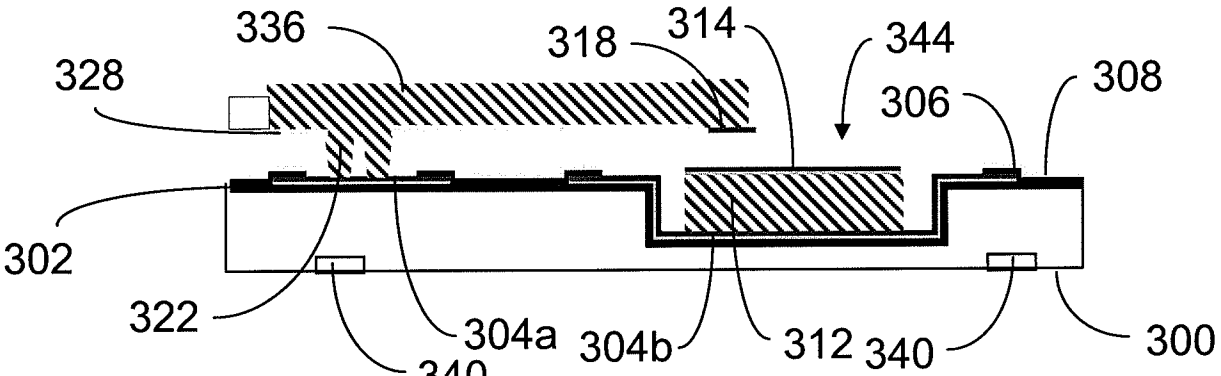
FIG. 10R is a schematic representation of removal of the insulation layer and a conductive material from the wafer shown in FIG. 10Q.

To further expose structure of the switch, FIG. 10R illustrates the removal of conductive material 326 and layer 316. In one embodiment, conductive material 326 is etched, for example, with a Ti etchant. In one embodiment, layer 316 is etched, using an appropriate etching technique, for example, a method used to remove an undoped silicate glass. As a result, with the removal of layer 316, a significant portion of the switch is exposed.

Figure 10S:
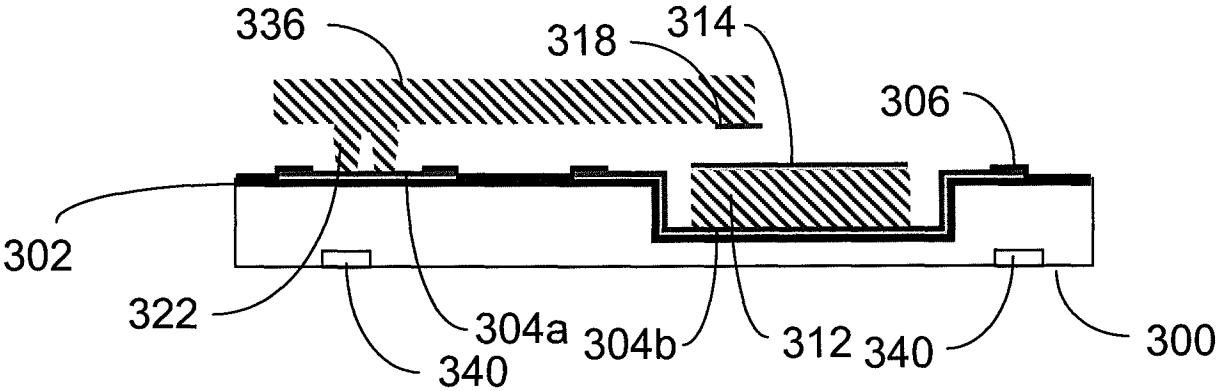
FIG. 10S is a schematic representation of an etch step removal of a conductive material from the wafer depicted in FIG. 10R.

Although the mobile element of the switch is now shown in a cantilever configuration, with the presence of conductive materials 306 and 308, conductive materials 304*a* and 304*b* are not yet electrically separated. FIG. 10S illustrates removal of conductive materials 308 and 328. In one embodiment, conductive materials 308 and 328 are etched using a Cu etchant. In other embodiments, conductive materials 308 and 328 are separately removed. Although conductive materials 308 and 328 are removed, with the presence of conductive material 306, conductive materials 304*a* and 304*b* are still not yet electrically separated.

Figure 10T:
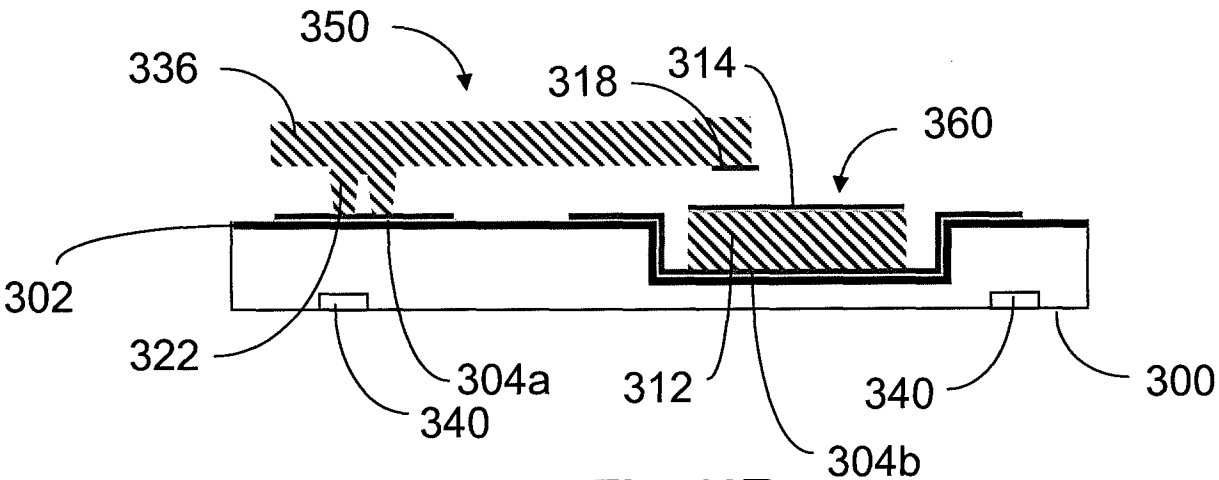

To electrically separate conductive materials 304*a* and 304*b*, conductive material 306 is removed, as shown in FIG. 10T. In one embodiment, conductive material 306 is removed using a Ti etch. In one embodiment, the device undergoes critical point drying. For example, after a rinse with deionized water, drying occurs using a carbon dioxide critical point dryer system. As a result, once conductive material 306 is removed, the switch of the illustrated embodiment having a plurality of anchoring members is formed.

Resulting from the embodiment illustrated by steps FIGS. 10A-10T, a switch that can be actuated by exposure to an external magnetic field is formed. As FIGS. 10A-10T illustrate only one embodiment where a switch is manufactured, it can be appreciated that switches described herein may be fabricated using any number of appropriate methods, including various techniques used for semiconductor manufacture. For example, FIGS. 11A-11P illustrate section views of another embodiment for the manufacture of a different switch that may be actuated by an external magnetic field.

Figure 11A:
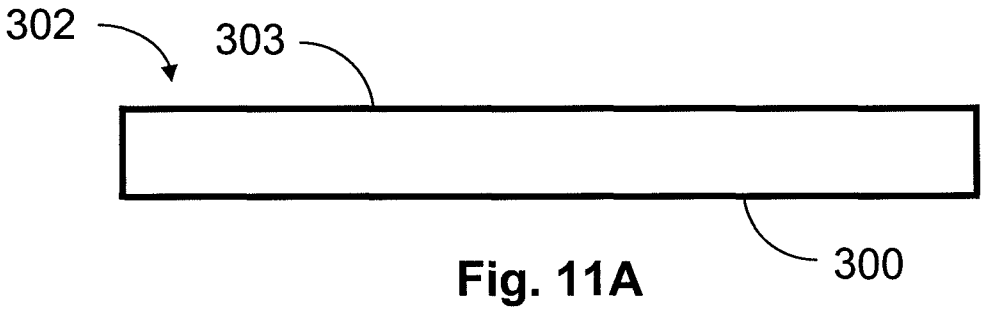
FIGS. 11A-11P show various stages of other embodiment(s) of a switch, where.

FIG. 11A illustrates a substrate 300 with a top surface 302. In some embodiments, surface 302 may be covered with one or more oxide and/or nitride layers 303 that are deposited on the substrate 300. In some instances, oxide and/or nitride layers 303 may be present to better facilitate the adherence of conductive materials to be deposited on to the device wafer in subsequent steps. It can be appreciated that any suitable material having an appropriate thickness may be suitable for use in surface 302 on the substrate. In some embodiments, no additional layer 303 is deposited. In one embodiment, surface 302 is primarily made up of the same material as substrate 300, for example, silicon.

Figure 11B:
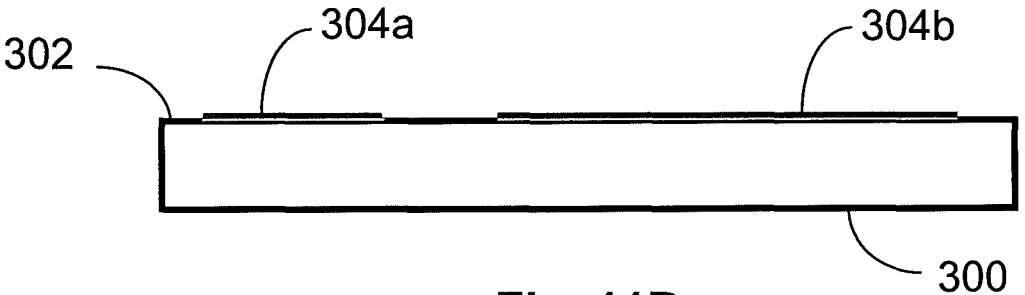
FIG. 11B is a schematic representation of a deposition of a conductive material on the substrate of FIG. 11A.

In FIG. 11B, conductive materials 304*a* and 304*b* are deposited on the substrate surface 302. Upon manufacture of the switch, conductive material 304*a* forms a conductive portion that is electrically connected to a mobile element and conductive material 304*b* forms another conductive portion. In an open configuration, conductive materials 304*a* and 304*b* are not in electrically contact with one another. However, in a closed configuration, an electrical pathway is established between conductive materials 304*a* and 304*b*.

Figure 11C:
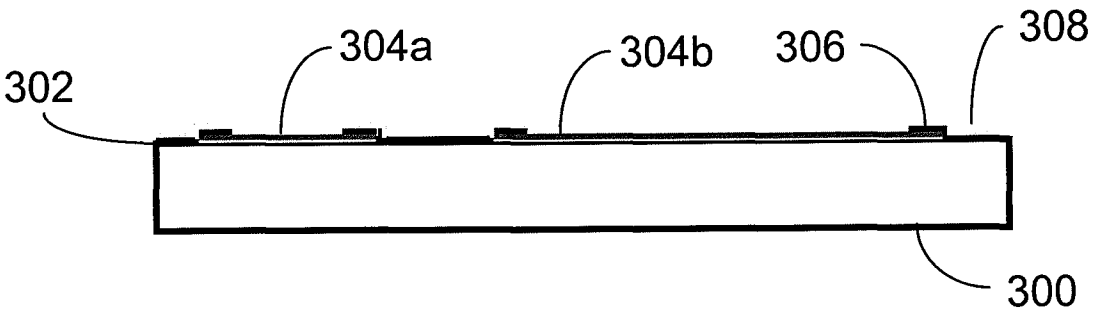
FIG. 11C is a schematic representation of deposition of another conductive material on the conductive material of FIG. 11B.

FIG. 11C shows another conductive material 306 that is deposited on to portions of conductive materials 304*a* and 304*b* and a further conductive material 308 that is deposited on to conductive material 306.

Figure 11D:
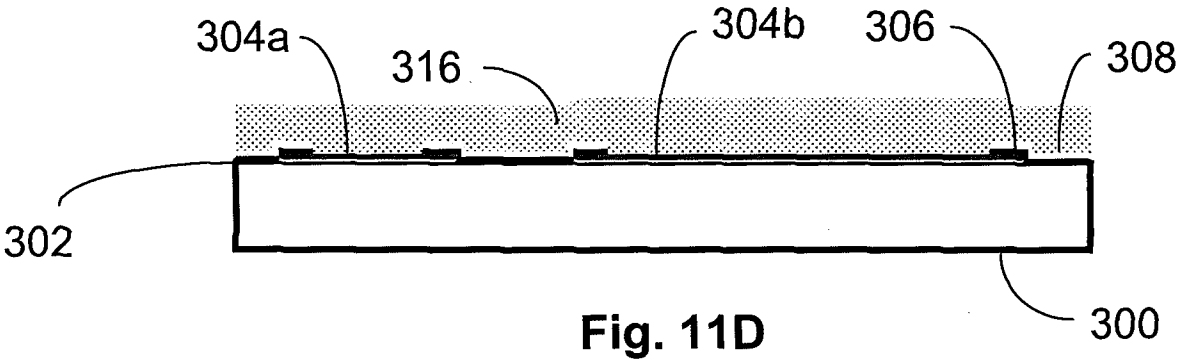
FIG. 11D is a schematic representation of deposition of an insulation layer on the wafer shown in FIG. 10C.
Figure 11E:
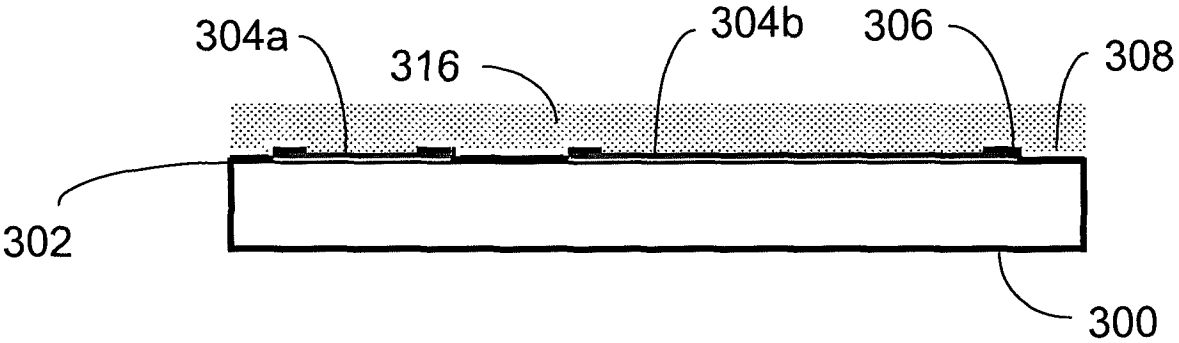
FIG. 11E is a schematic representation of a step of planarizing the insulation layer of FIG. 11D.

FIG. 11D illustrates deposition of a layer 316 on the device wafer. In an embodiment, layer 316 is deposited on to conductive materials 304*a*, 304*b*, 306, and 308. In one embodiment, layer 316 is used as a template in which vias and subsequent anchoring members may be formed. In one embodiment, the layer 316 is an amorphous silicate material, such as for example, an undoped silicate glass. Similarly to that described above, the surface of layer 316 may be appropriately planarized, as shown in FIG. 11E.

Figure 11F:
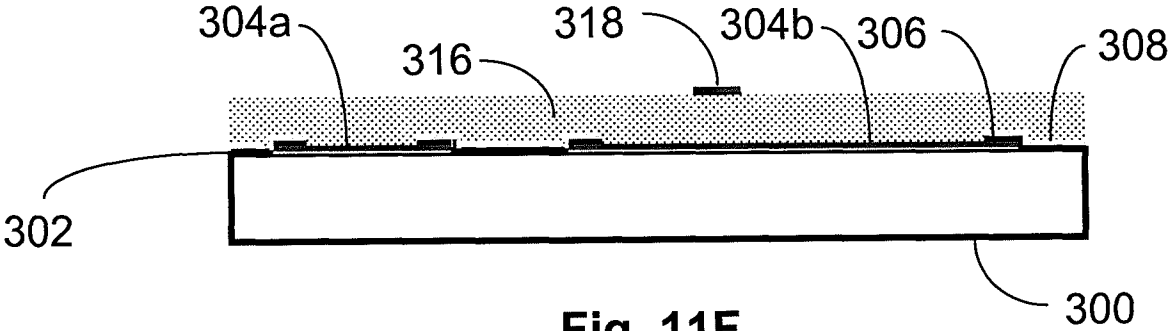
FIG. 11F is a schematic representation of deposition of another conductive material on the insulation layer of FIG. 11E.

FIG. 11F depicts a conductive material 318 that is deposited on a portion of the planarized layer 316. In one embodiment, the conductive material 318 makes up a region on an end portion of a beam for mobile elements that are described above. The region on the end portion of the beam where conductive material 318 is disposed faces toward conductive material 304*b* such that when the finished switch is in a closed configuration, conductive materials 304*b* and 318 are in electrical contact.

Figure 11G:
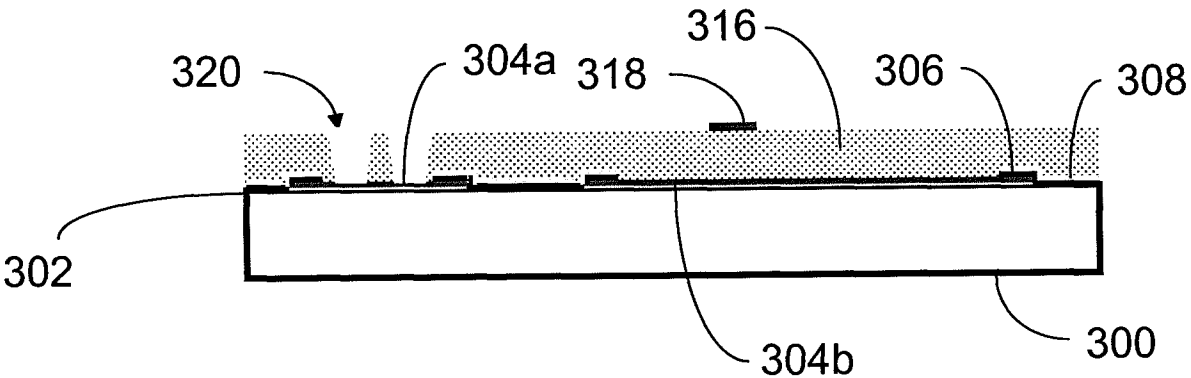
FIG. 11G is a schematic representation of vias that are etched into the insulation layer of FIG. 11F.

Vias may be formed in a layer so that a plurality of anchoring members may be formed in the vias. FIG. 11G depicts a plurality of vias 320 that are etched into the layer 316. In an embodiment, vias 320 expose regions of conductive material 304*a*, where those regions of conductive material 304*a* give rise to contact surface areas of anchoring members. It can be appreciated that any arrangement of vias may be formed into the layer 316 using any appropriate method. As discussed above with respect to the formation of anchoring members, vias are formed by any suitable pattern in the layer and with any suitable geometry.

Figure 11H:
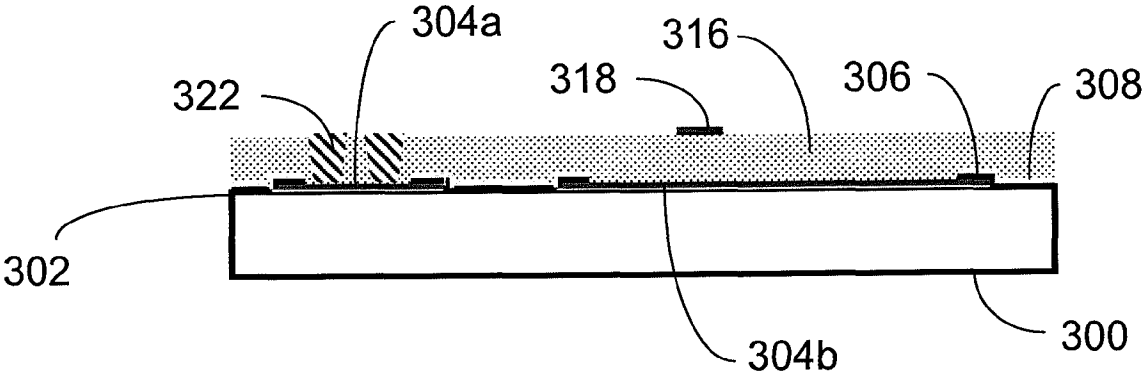
FIG. 11H is a schematic representation of deposition of a magnetic material in the vias of FIG. 11G.

FIG. 11H illustrates deposition of a magnetic material 322 into vias 320. Magnetic material 322 forms a substantial portion of anchoring members for a mobile element. In an embodiment, when a plurality of vias are provided in the layer 316, magnetic material 322 may be deposited into each of the vias so as to form a plurality of anchoring members of a mobile element. Once magnetic material 322 is deposited in the plurality of vias 320 within layer 316, the beam portion of a mobile element may subsequently be formed.

Figure 11I:
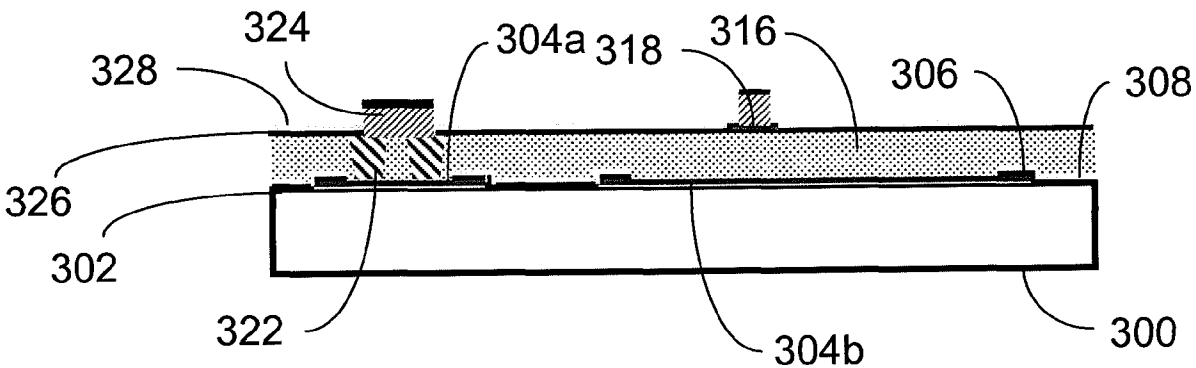
FIG. 11I is a schematic representation of deposition of a photoresist and another conductive material on the magnetic material and conductive material of FIGS. 11F and 11H.

In forming the beam portion of the mobile element, in one embodiment, the beam contacts both magnetic material 322 and conductive material 318. FIG. 11I depicts deposition of a photoresist 324 over the vias that contain magnetic material 322 as well as over conductive material 318. Photoresist 324 serves to provide a method where one end of the beam contacts the anchoring members and the other end of the beam contacts the conductive material 318.

In addition, FIG. 11I illustrates conductive materials 326 and 328 that are successively deposited on layer 316 and photoresist 324. Conductive materials 326 and 328 may provide for a seed layer where further layers of deposition may occur.

Figure 11J:
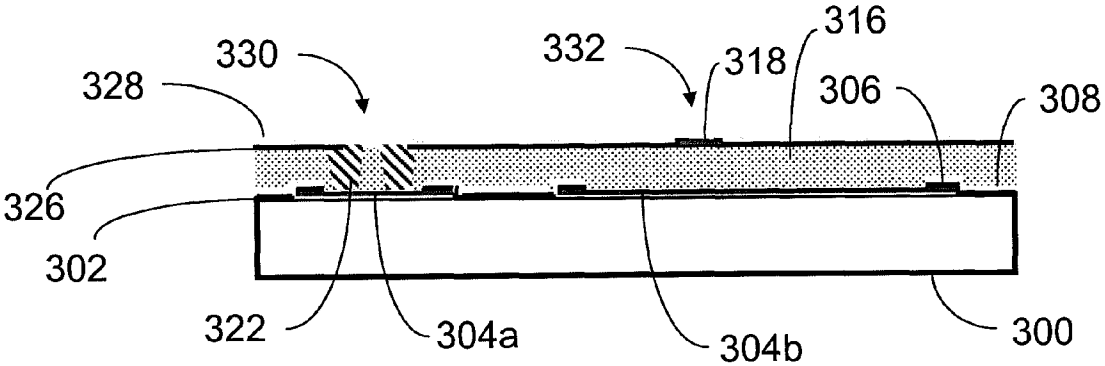
FIG. 11J is a schematic representation showing removal of the photoresist shown in FIG. 11I.

FIG. 11J illustrates locations 330 and 332 that indicate regions of contact for the beam of a mobile element. In order to expose locations 330 and 332, photoresist 324 and the conductive materials 326 and 328 that are deposited on top of the photoresist are appropriately removed. It can be seen, however, that regions of conductive materials 326 and 328 remain on other portions of the wafer as seed layers for further deposition.

Figure 11K:
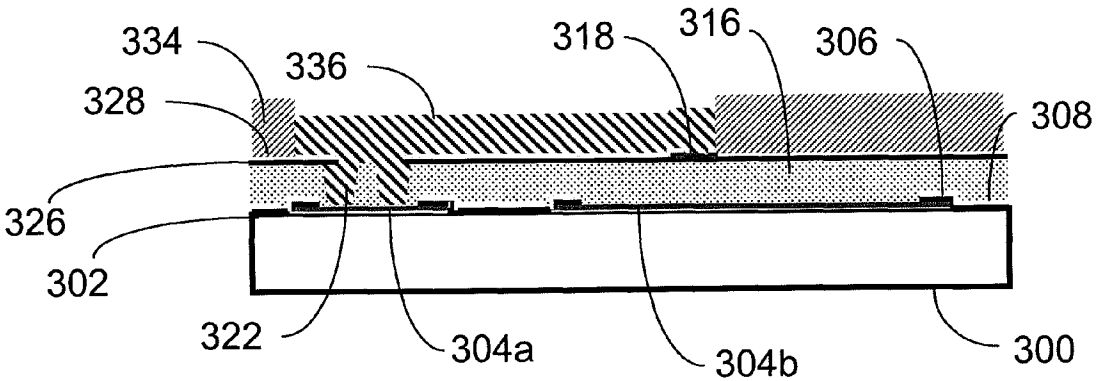
FIG. 11K is a schematic representation of deposition of another magnetic material and a photoresist on the wafer of FIG. 11J.

Next, a photoresist 334 is appropriately patterned on to conductive material 328 so as to provide a template for additional magnetic material to be deposited. Illustrated in FIG. 11K, for an embodiment, once photoresist 334 is appropriately deposited, magnetic material 336 is subsequently deposited in regions where the photoresist 334 is not present. Magnetic material 336 is deposited on to magnetic material 322 and on to conductive materials 318, 326, and 328. In one embodiment, magnetic material 336 is a NiFe alloy that is plated on to magnetic material 322 and conductive materials 318, 326, and 328. Upon fabrication of switches described, magnetic material 336 forms a substantial portion of a beam in a mobile element. In this regard, the mobile element includes the beam that is formed by magnetic material 336 which extends away from anchoring members that are formed by magnetic material 322.

Figure 11L:
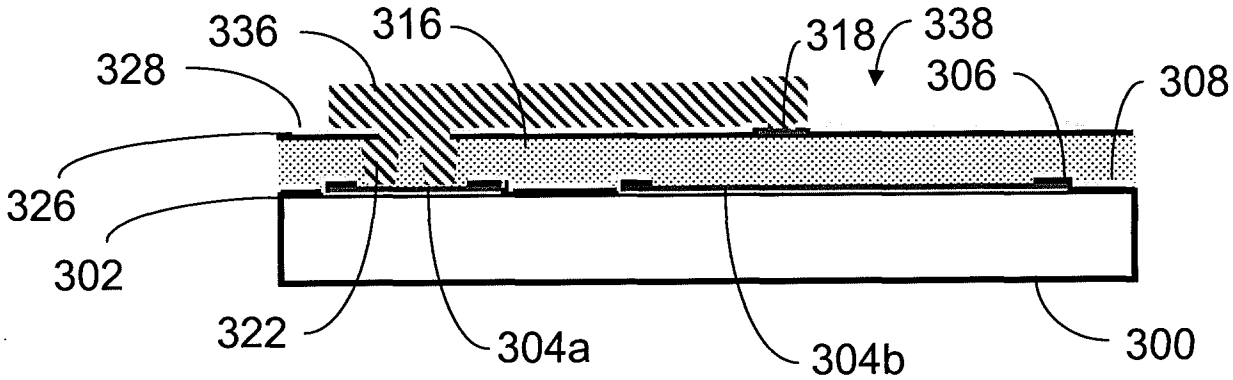
FIG. 11L is a schematic representation of removal of the photoresist of FIG. 11K.
Figure 11M:
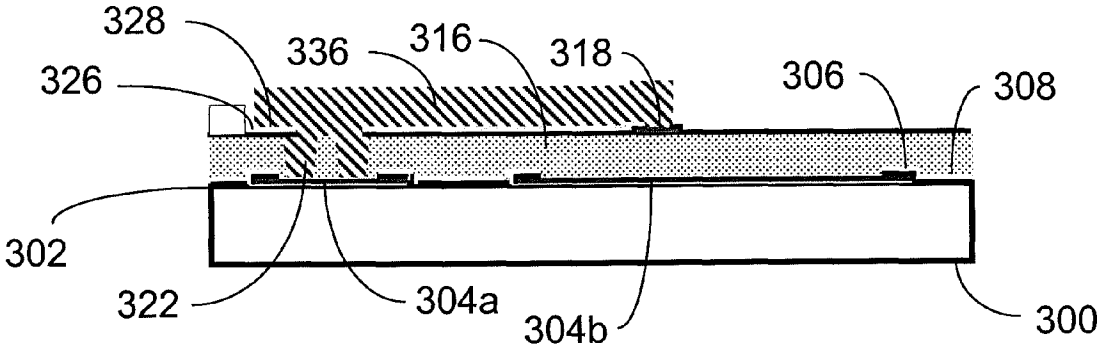
FIG. 11M is a schematic representation of an etch step removal of a conductive material from the wafer depicted in FIG. 11L.

After magnetic material 336 has been deposited, photoresist 334 may be removed from a location 338 to better expose magnetic material 336, as shown in FIG. 11L. To release more structure of the switch, FIG. 11M illustrates removal of exposed portions of conductive material 328. As shown, while portions of conductive material 328 remain in regions that are below magnetic material 336, portions of conductive material 328 that are exposed (not below magnetic material 336) have been removed.

Figure 11N:
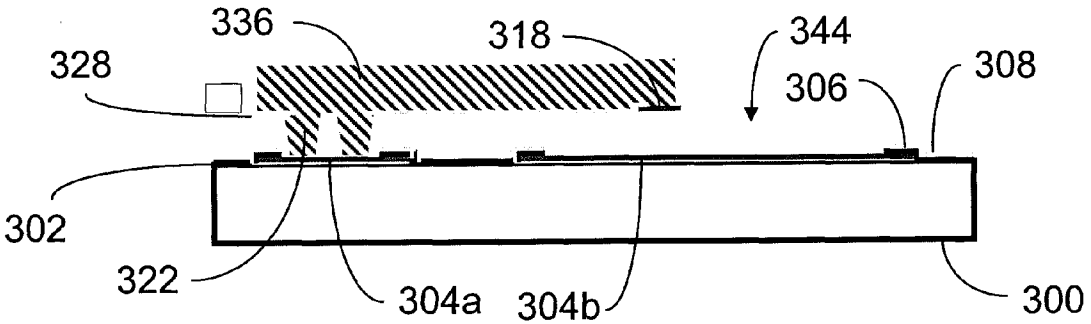
FIG. 11N is a schematic representation of removal of the insulation layer and a conductive material from the wafer shown in FIG. 11M.

To further expose structure of the switch, FIG. 11N illustrates the removal of conductive material 326 and layer 316. At this point, conductive materials 304*a*, 304*b*, and 318 are exposed once more.

Figure 11O:
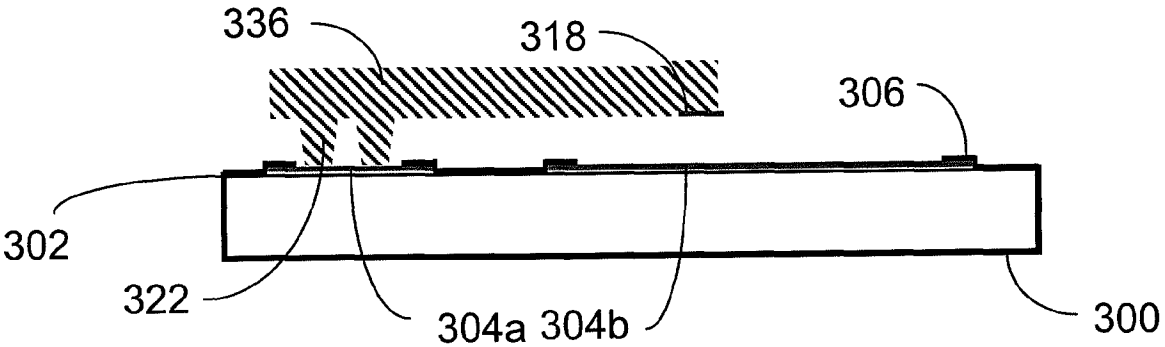
FIG. 11O is a schematic representation of an etch step removal of a conductive material from the wafer depicted in FIG. 11N.
Figure 11P:
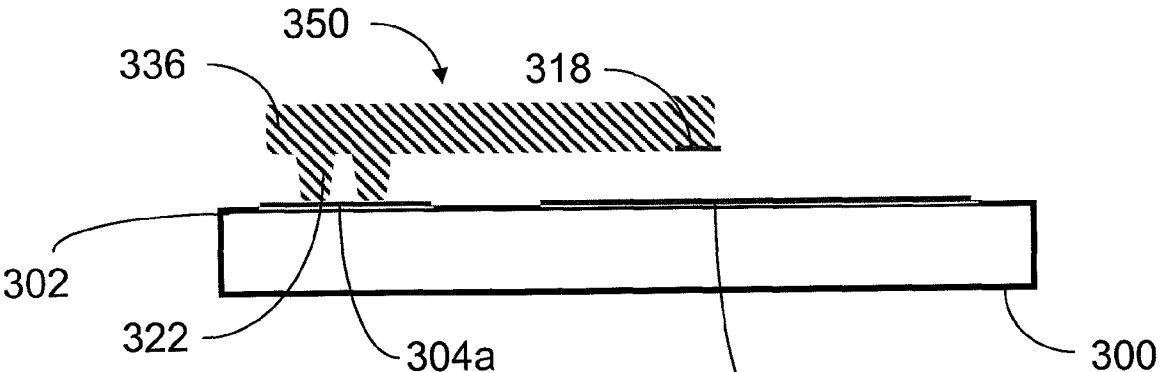

Although the mobile element of the switch is now shown in a cantilever configuration, with the presence of conductive materials 306 and 308, conductive materials 304*a* and 304*b* are not yet electrically separated. FIG. 11O illustrates removal of conductive materials 308 and 328. To electrically separate conductive materials 304*a* and 304*b*, conductive material 306 is removed, as shown in FIG. 11P. Once conductive material 306 is removed, the switch of the illustrated embodiment having a plurality of anchoring members is formed.

Figure 12:
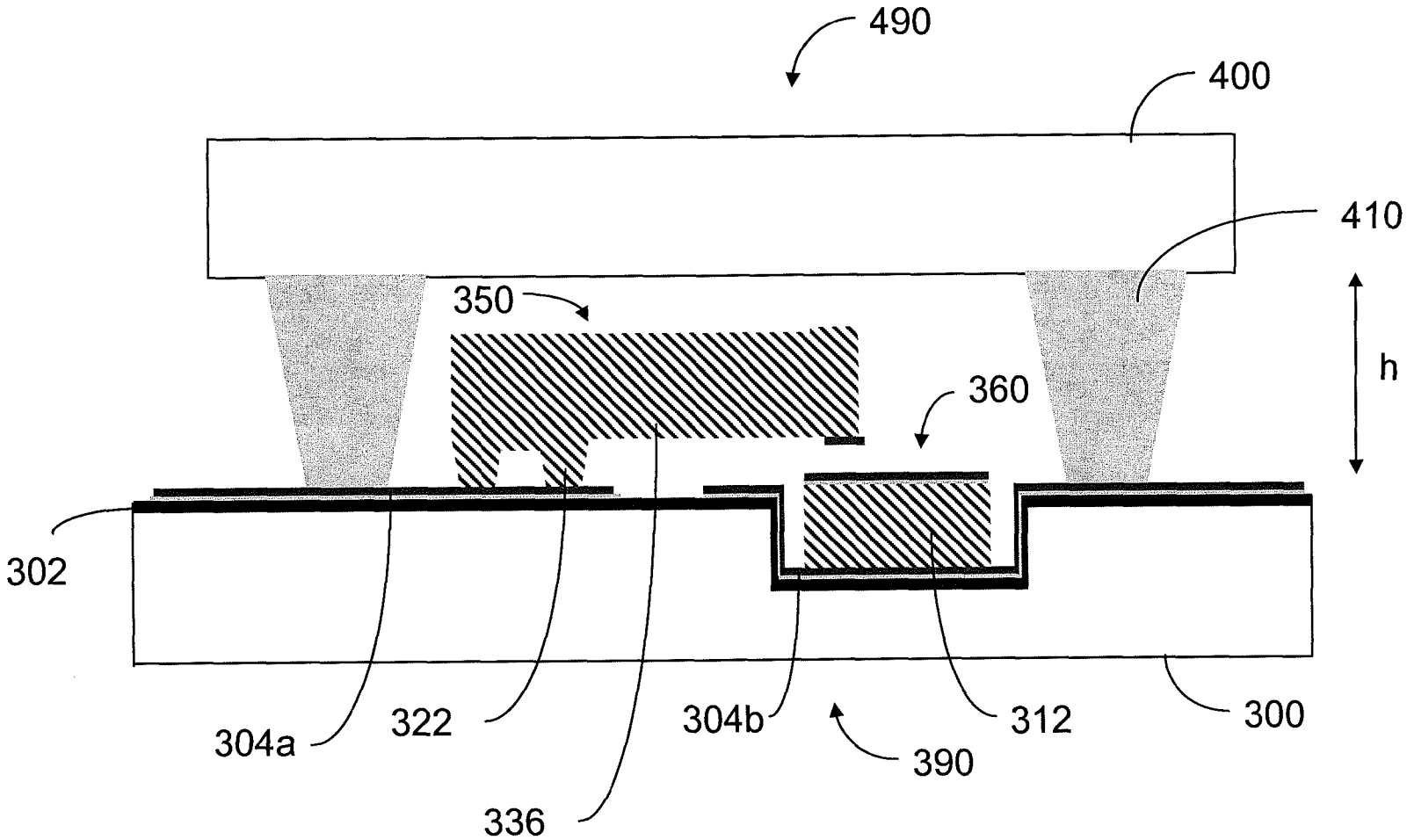
FIG. 12 is a schematic representation of a side section view of an embodiment of a cap wafer disposed on a device wafer with an embodiment of a switch.

Looking to FIG. 12, the switch is provided as a device wafer 390 having a mobile element 350 and a fixed element 360 disposed in a trench of substrate 300. Mobile element 350 includes a plurality of anchoring members, formed by magnetic material 322. Mobile element 350 also includes a beam portion, formed by magnetic material 336. Fixed element 360 is formed by magnetic material 312. In an open configuration of the switch, an electrical pathway is not yet formed between conductive materials 304*a* and 304*b*. In one embodiment, conductive material 304*a* is included in a first conductive portion of a switch, where conductive material 304*a* electrically contacts the plurality of anchoring members. In one embodiment, conductive material 304*b* is in electrical contact with fixed element 360 in forming a second conductive portion of a switch.

Figure 13:
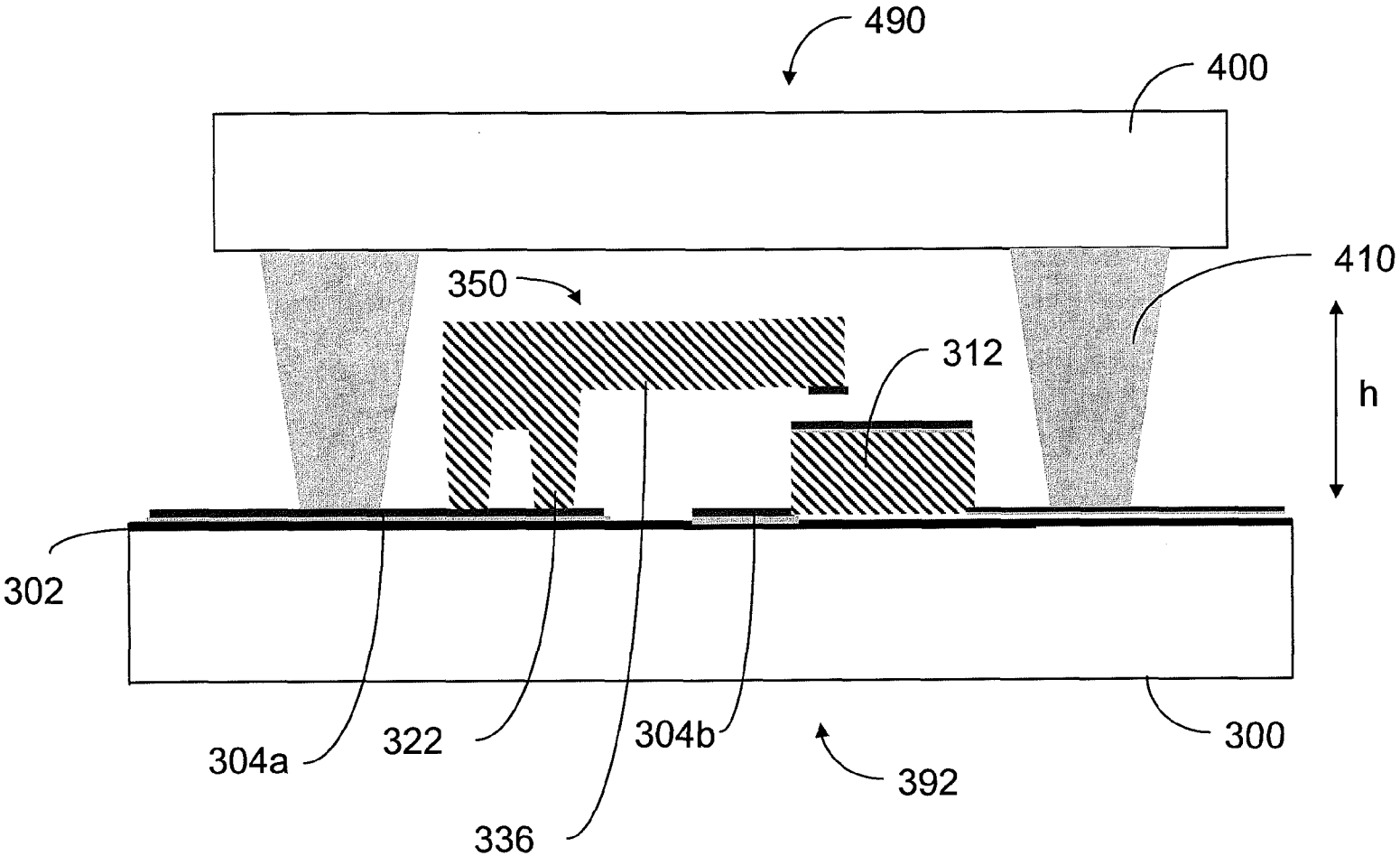
FIG. 13 is a schematic representation of a side section view of an embodiment of a cap wafer disposed on a device wafer with another embodiment of a switch.

In addition, FIG. 13 depicts an embodiment of a switch including a device wafer 392 having a mobile element 350 and a fixed element 360 disposed on a top surface of substrate 300, where the substrate does not include a trench. Mobile element 350 includes a plurality of anchoring members, formed by magnetic material 322. Mobile element 350 also includes a beam portion, formed by magnetic material 336. Fixed element 360 is formed by magnetic material 312.

Figure 14:
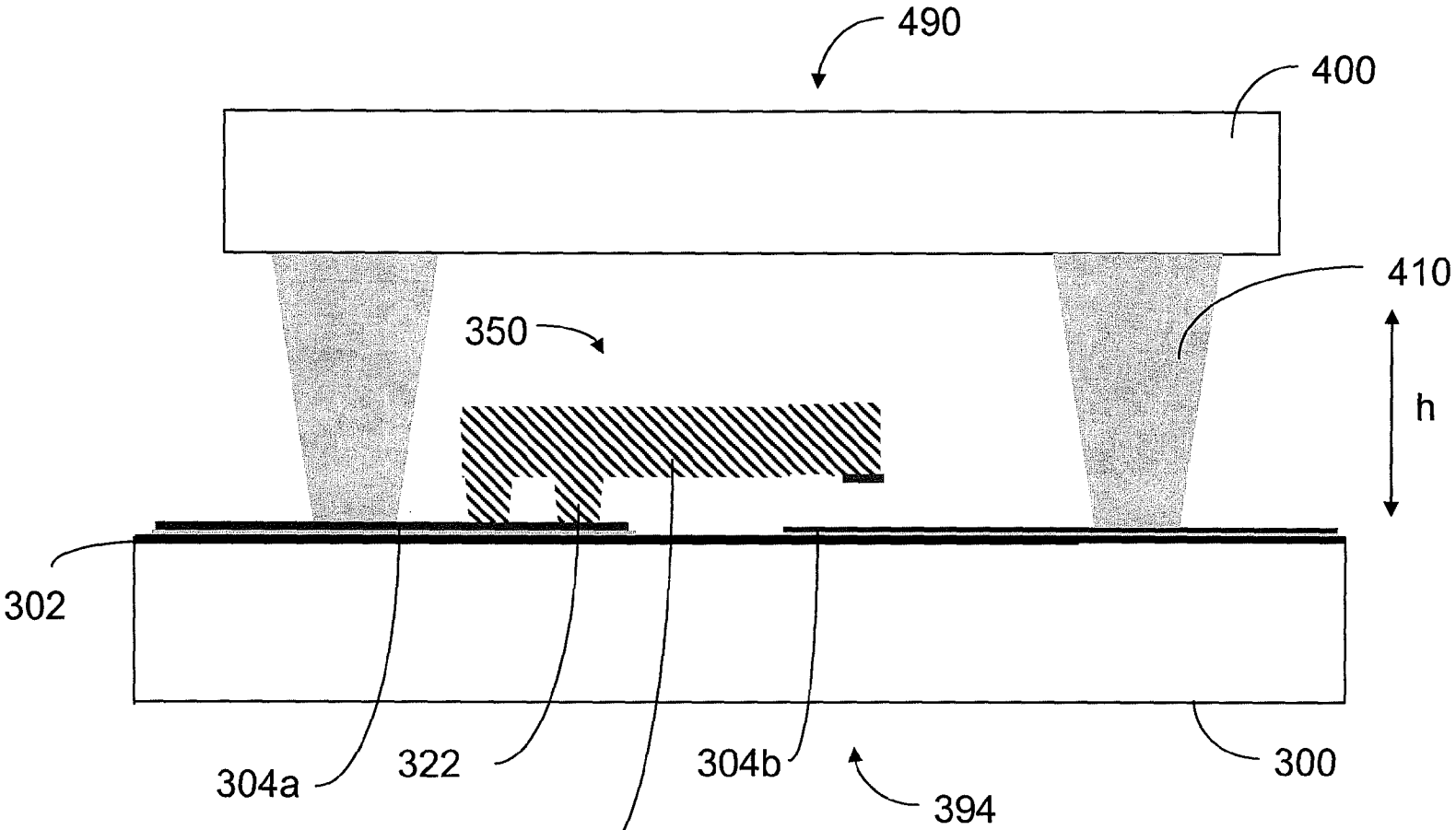
FIG. 14 is a schematic representation of a side section view of an embodiment of a cap wafer disposed on a device wafer with a further embodiment of a switch.

FIG. 14 illustrates an embodiment of a switch including a device wafer 394 having a mobile element 350 without a fixed element, but a conductive material 304*b* forming a conductive portion on the substrate 300. Mobile element 350 includes a plurality of anchoring members, formed by magnetic material 322. Mobile element 350 also includes a beam portion, formed by magnetic material 336. In an open configuration of the switch, an electrical pathway is not yet formed between conductive materials 304*a* and 304*b*. In one embodiment, conductive material 304*a* is included in a first conductive portion of a switch, where conductive material 304*a* electrically contacts the plurality of anchoring members.

In some embodiments, and as illustrated in FIGS. 12-14, switches described herein may also include a cap wafer 490 disposed above a device wafer 390. FIGS. 12-14 show embodiments of device wafers that are covered by a cap wafer 490, where cap wafer 490 includes a substrate 400 and polymer 410. In various embodiments, a cap wafer 490 may useful for protecting elements of the switch, particularly mobile element 350, as the cantilevered nature of the mobile element can give rise to increasing wear and, possibly, eventual failure. In some embodiments, polymer 410 provides a spacing height h of approximately 20 microns between the cap wafer 490 and the device wafer. In one embodiment, cap wafer 490 and the device wafer are bonded together by thermal compression of polymer 410. Steps are depicted, in FIGS. 15A-15E below, for fabrication of a cap wafer 490.

Figure 15A:
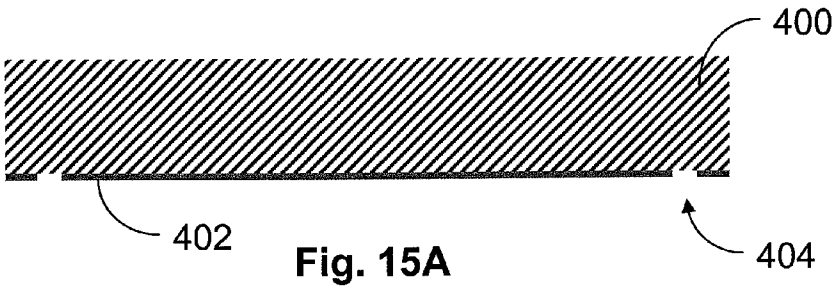
FIG. 15A is a schematic representation of a side section view of a photoresist coating on the backside of a substrate for manufacture of an embodiment of a cap wafer.

FIG. 15A illustrates a substrate 400 that is coated from the backside by a photoresist 402. In some embodiments, photoresist 402 provides a template where backside device patterning may occur. In one embodiment, photoresist 402 is patterned with an alignment mark and a dicing line to form openings 404. In one embodiment, photoresist 402 is spin coated on to a silicon substrate.

Figure 15B:
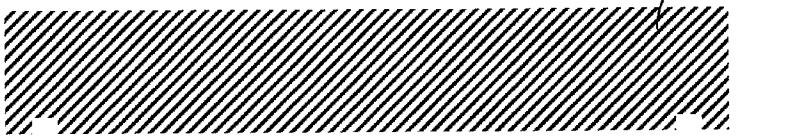
FIG. 15B is a schematic representation of removal of the photoresist of FIG. 15A.

FIG. 15B depicts substrate 400 having been etched where photoresist 402 is removed. Once appropriate backside patterning has occurred, photoresist 402 may be suitably eliminated. Substrate etching and photoresist removal may occur by any appropriate technique. For example, photoresist may be removed by sonication methods.

Figure 15C:
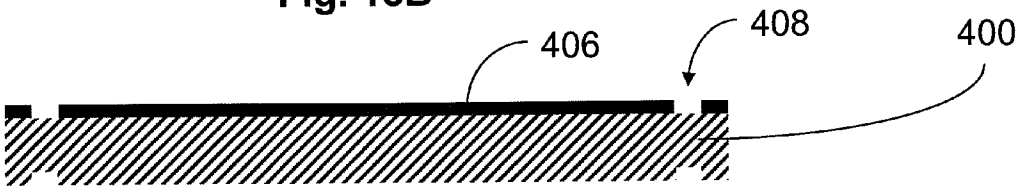
FIG. 15C is a schematic representation of deposition of a nitride material and pre-cut patterning on the wafer shown in FIG. 15B.

As illustrated in FIG. 15C, substrate 400 is thinned and a silicon nitride layer 406 is deposited on the front side of the substrate. In one embodiment, silicon nitride layer 406 may be used as a seed layer for further deposition of a polymer. Although not shown in the figures, in one embodiment, so that the silicon nitride layer 406 is selectively deposited, another photoresist layer is spin coated on to the front side of the substrate and patterned with a pre-cut line. As discussed above for photoresist materials, the photoresist layer deposited on the front side of the substrate may be removed, for example, by sonication. In another embodiment, a region 408 of the silicon nitride layer 406 is also etched out according to the patterned pre-cut line. As a result, an appropriately deposited silicon nitride layer 406 may be useful so that a suitable polymer material can be deposited on to the surface.

Figure 15D:
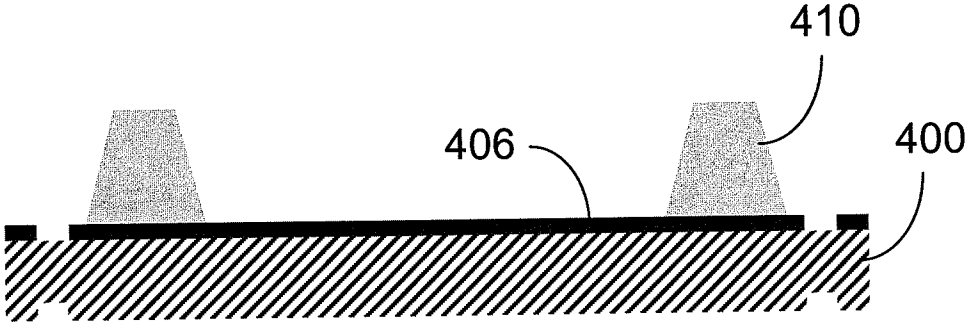
FIG. 15D is a schematic representation of deposition of a polymer on the nitride material of FIG. 15C.

As discussed, polymer 410 may be deposited on the silicon nitride layer 406, as shown in FIG. 15D. In an embodiment, polymer 410 provides spacing for device wafer 390 when the device wafer is disposed underneath cap wafer 490. In one embodiment, polymer 410 is spin coated and patterned on to the front side of the wafer on layer 406. Polymer 410 provides support for the cap wafer 490 when covering the device layer portion of the switch. In some embodiments, the polymer 410 may be SU-8.

Figure 15E:
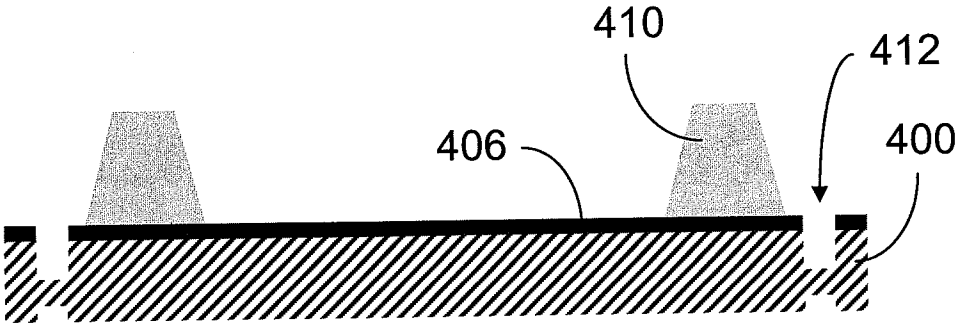
FIG. 15E is a schematic representation of pre-cut patterning on the wafer shown in FIG. 15D.

FIG. 15E illustrates a further optional processing step of the cap wafer 490, where a portion of the substrate is removed at a region 412. Region 412 coincides with region 408 of the silicon nitride layer 406 that was previously removed, and may be useful for further device processing steps. In one embodiment, region 412 is formed from a step of deep silicon dry etching. In one embodiment, a dicing machine is used to cut a pre-cut line. For example, the pre-cut line may be approximately 100 microns thick.

More switches and methods for the manufacture of switches are described. In some embodiments, switches described may transmit data through use of a magnetic field. As a result, switches discussed herein may be actuated by a magnetic field rather than through usage of electrical power. In one embodiment, the polarity of a magnetic field does not have a bearing on switch actuation. However, the switch may be affected by the intensity and the position of the magnetic field relative to various elements of the switch. For example, a switch may be placed in a closed configuration once a magnetic field providing a sufficient intensity is appropriately positioned at suitable vicinity relative to the switch.

Switches described are generally small, reliable, and sensitive. For example, a switch may have a small footprint, a large shock resistance, and exhibit stability with time. In one embodiment, the switch is a microreed switch. In another embodiment, the switch is fabricated in a batch using a micromachining process.

As discussed above, a switch may include a mobile element and a fixed element. In one embodiment, a fixed element is in contact with a substrate and is made from a ferromagnetic material. In one embodiment, a mobile element is positioned above a substrate and is made from a ferromagnetic material. For example, the mobile element may be attached to the substrate through one or more anchoring members.

In some embodiments, the mobile element of a switch may include a beam portion that can be a single plate, or alternatively, may be split into multiple strips. Strips may be appropriately shaped, for example, into long and narrow plates. As will be described in more detail below, for various embodiments, a beam portion and/or a fixed element that are composed of magnetic material may be segmented into strips in order to reduce demagnetization effects and, thus, increase overall sensitivity of the switch. In addition, a beam portion and/or a fixed element may be segmented into strips so that, in a release step during fabrication, the etching speed of the sacrificial layer may be increased.

In one embodiment, the attachment between the mobile element and one or more anchoring members includes a cantilever-beam arrangement. In another embodiment, the attachment between the mobile element and one or more anchoring members includes a crab-leg configuration. In a further embodiment, the attachment between the mobile element and one or more anchoring members includes a torsion bar. In some cases, mobile elements such as those incorporating crab-leg or torsion bar configurations may exhibit smaller initial deformation relative to a cantilever-beam arrangement. For example, crab-leg or torsion bar configurations may accommodate displacements not only in a vertical direction, but also twisting displacements as well. Switches described herein may be manufactured through any suitable method, for example, by using an integrated micromachining process.

Figure 16A:
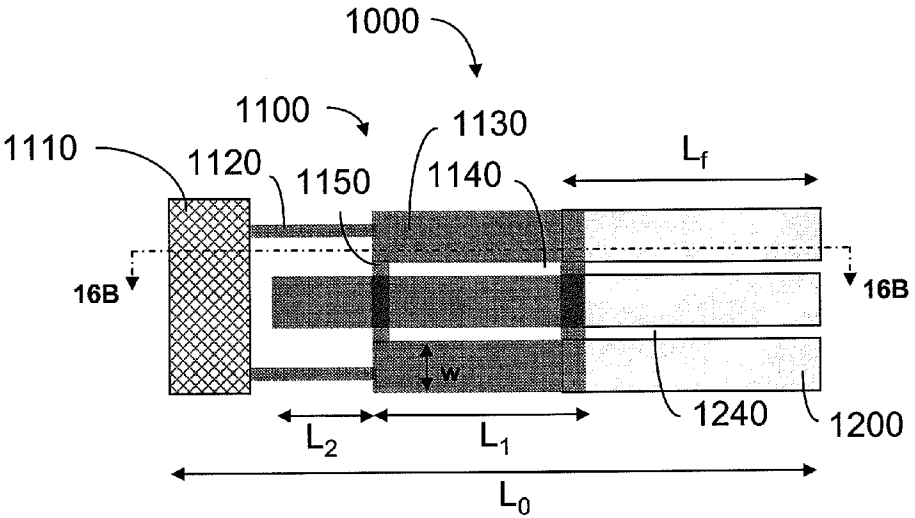
FIG. 16A is a schematic representation of a top view of an embodiment of a switch configuration.
Figure 16B:
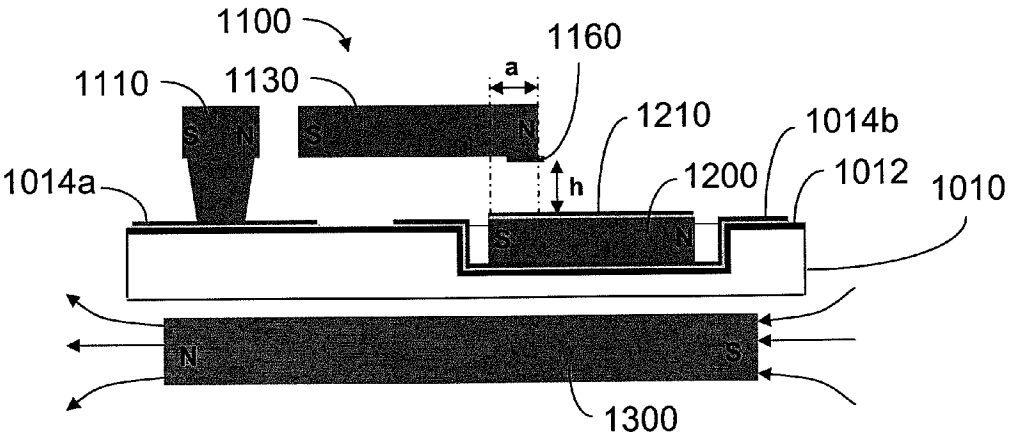
FIG. 16B is a schematic representation of a side section view of the embodiment of FIG. 16A.

FIGS. 16A-16B depict an illustrative embodiment of a switch 1000. The switch 1000 includes a mobile element 1100 and a fixed element 1200. FIG. 16A shows a top view of a mobile element 1100 having a beam portion 1130 that is attached to an anchoring portion 1110 via flexures 1120. In some embodiments, an anchoring portion may include a plurality of anchoring members, as discussed above.

In the embodiment illustrated, beam portion 1130 of mobile element 1100 and fixed element 1200 are both segmented into strips that are separated by openings 1140 and 1240, respectively. Beam strips of beam portion 1130 may also be attached to one another by connection portions 1150.

It can be appreciated that, for switches discussed herein, a beam portion and/or a fixed element are not limited in the dimension of the strip(s) and/or a number of strips. Similarly, it is not necessary for a beam portion and/or a fixed element to have the same number of strips, if the beam portion and/or the fixed element are segmented into strips at all. In an embodiment, a beam portion and/or a fixed element might be manufactured as single plates (not divided into strips), for example, to decrease the number of fabrication steps for the device. In some embodiments, beam portions and/or fixed elements that are segmented into strips may include a number of strips N that is greater than 2 strips; greater than 3 strips; and/or greater than 4 strips.

In some embodiments, strips may have a width w that ranges between approximately 20 microns and approximately 100 microns. For example, in FIG. 16A, strips shown in beam portion 1130 may have widths w that are about 50 microns wide. In some embodiments, strips may be separated by openings that range between approximately 2 microns and approximately 20 microns. In some embodiments, strips may have thicknesses that range between approximately 5 microns and approximately 50 microns. In some embodiments, the product of the multiplication between the width w and the number of strips N ranges between approximately 100 microns and approximately 400 microns.

Further, portions of switches described herein may be manufactured to any suitable length. In some embodiments, and as shown by example in FIG. 16A, the total length of a switch $L_0$ may range between approximately 600 microns and approximately 2000 microns. In some embodiments, the length of the fixed element $L_f$ ranges between approximately 200 microns and approximately 600 microns. In some embodiments, the length $L_1$ of strips in a beam portion as measured up to the flexures from an edge that overhangs a fixed element ranges between approximately 200 microns and approximately 600 microns. In other embodiments, the length $L_2$ as measured between the opposite end of a beam portion and the point where flexures meet the edges of the previously measured strips also ranges between approximately 50 microns and approximately 400 microns. In FIG. 16A, $L_2$ is shown to be less than $L_1$, yet it can be appreciated that $L_1$ being greater than $L_2$ is not a requirement.

It can also be appreciated that when a beam portion is divided into strips, not all strips are required to have the same length. For example, as illustrated in FIG. 16A, the center strip of beam portion 1130 extends further than length $L_1$ towards anchoring portion 1110. In some instances, such an increased strip length may assist to increase switch sensitivity in reducing demagnetization effects.

FIG. 16B depicts a cross-sectional view of the embodiment depicted in FIG. 16A taken through the dashed line. As illustrated, substrate 1010 includes a top surface 1012. Conductive materials 1014*a* and 1014*b* are located on the substrate surface 1012. In one embodiment, and as explained above, conductive material 1014*a* forms a conductive portion that is electrically connected to a mobile element 1100 through anchoring portion 1110. Similarly, conductive material 1014*b* forms a conductive portion that is electrically connected to a fixed element 1200. In addition, conductive material 1160 is located on a portion of a bottom surface of the beam portion 1130 of mobile element 1100. Conductive material 1210 is also located on a portion of the top surface of fixed element 1200. Beam portion 1130 of mobile element 1100 is separated from fixed element 1200 by a height h. Additionally, beam portion 1130 and fixed element 1200 overlap by a distance a.

In an open configuration, conductive materials 1014*a* and 1014*b* are not in electrical contact with one another. However, in a closed configuration, an electrical pathway is established between conductive materials 1014*a* and 1014*b* through contact between mobile element 1100 and fixed element 1200. For example, once an external force, such as a magnetic field, is applied to mobile element 1100 that is sufficient to actuate mobile element 1100 in a manner that brings conductive material 1160 of the mobile element into electrical contact with conductive material 1210 of fixed element 1200, the switch is closed. In one embodiment, members of mobile element 1100 and fixed element 1200 are made of a magnetic material, such as a NiFe alloy (e.g., $Ni_{80}Fe_{20}$). In some embodiments, conductive material contacts 1160 and 1210 are made of gold, rhodium, and/or ruthenium. Such materials may provide for low contact resistance and longer durability.

FIG. 16B further illustrates the effect on the switch when a magnet 1300 comes into close proximity with the device. As shown, when the magnetic field of magnet 1300 is parallel to the mobile and fixed elements, the materials are magnetized, inducing a south (S) pole at an edge of one element (e.g., mobile element 1100) closest to the north (N) pole of the magnet; and inducing a north (N) pole at an edge of the other element (e.g., fixed element 1200) closest to the south (S) pole of the magnet. A cascading magnetic effect is then produced as complementary edges of portions of mobile and fixed elements are induced to magnetically attract one another.

Due to mutual attraction by the magnetic poles toward one another, the mobile element 1100 moves toward the fixed element 1200. If the attractive force between poles is strong enough to overcome the elastic resistance in mobile element 1100, the mobile element 1100 will be drawn toward the fixed element 1200 until contact, closing the switch. Upon removal of the magnetic field, elasticity in the mobile element 1100 brings the mobile element 1100 away from the fixed element 1200, breaking electrical contact, and opening the switch. In some embodiments, the beam portion 1130 of the mobile element 1100 is thicker than corresponding flexures 1120, giving rise to an increased magnetic force upon exposure to a magnetic field, and hence, an increased magnetic sensitivity for the switch.

As discussed, it can be appreciated that operation of a switch is not limited to the polarity of the nearby magnet. For example, in another embodiment, an oppositely polarized magnet induces a north (N) pole at an edge of one element (e.g., mobile element 1100) closest to the south (S) pole of the magnet; and inducing a south (S) pole at an opposite edge of the other element (e.g., fixed element 1200) closest to the north (N) pole of the magnet.

Figure 16C:
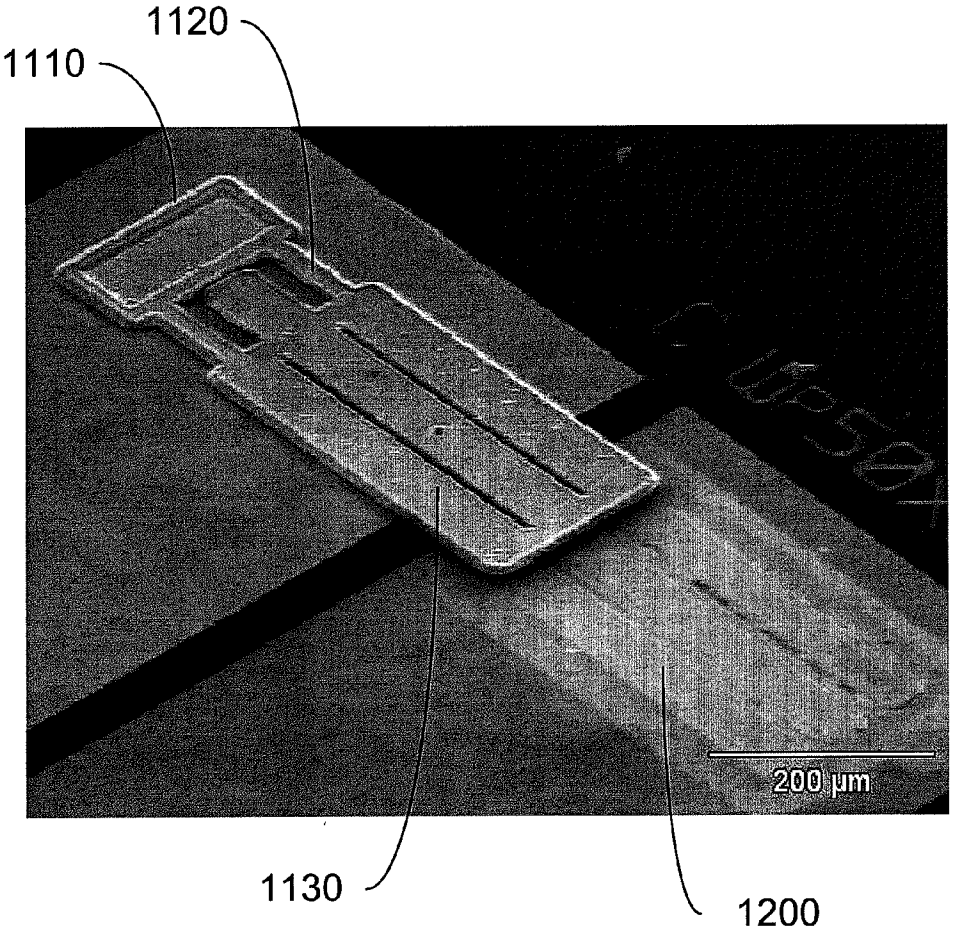
FIG. 16C is a micrograph of a cantilever-type switch.

FIG. 16C depicts an example of a switch having a mobile element and a fixed element 1200, both of which are divided into 3 strips. In addition, cantilever-type flexures 1120 connect anchoring portion 1110 and beam portion 1130 of the mobile element together. In this particular example, the width w of the strips is approximately 50 microns; the length $L_1$ of the beam portion 1130 up to flexures 1120 is approximately 400 microns; the length $L_2$ of the flexures 1120 up to the end of the beam portion 1130 closest to anchoring portion 1110 is approximately 95 microns; the length $L_f$ of fixed element 1200 is approximately 400 microns; and the length $L_0$ of the overall switch is approximately 1000 microns. The thickness of the beam portion of the mobile element is between about 7-10 microns. Flexures 1120 have a length of approximately 100 microns and a width of approximately 15 microns.

Figure 17A:
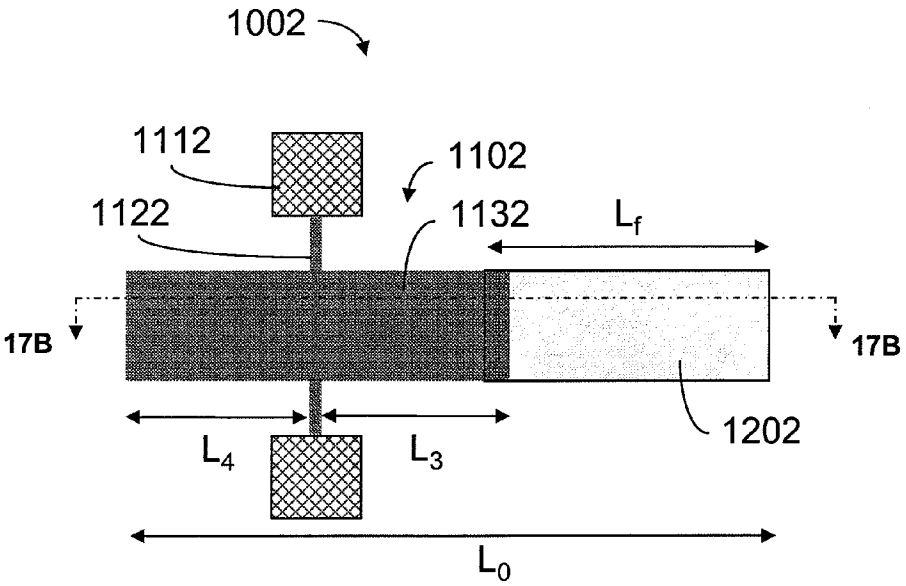
FIG. 17A is a schematic representation of a top view of another embodiment of a switch configuration.
Figure 17B:
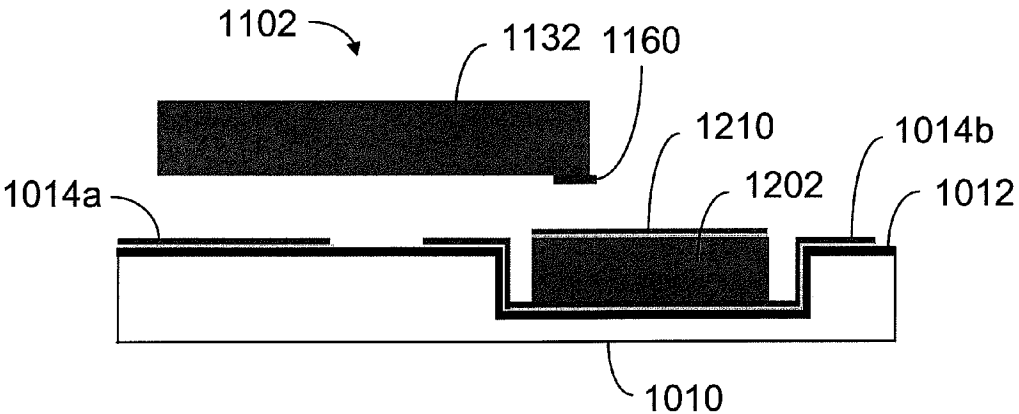
FIG. 17B is a schematic representation of a side section view of the embodiment of FIG. 17A.

FIGS. 17A-17D show more illustrative embodiments of a switch where a mobile element is supported by anchoring portions attached to flexures that are located on a side portion of the mobile element. FIGS. 17A and 17B depict top and cross-sectional views of switch 1002 having a mobile element 1102 that includes a beam portion 1132 that is attached to anchoring portions 1112 by flexures 1122. As appreciated above, in some cases, anchoring portions described may include a plurality of anchoring members.

As discussed above for the embodiment shown in FIG. 16A, switch embodiments illustrated by FIGS. 17A-17D may have elements that are manufactured to any suitable length. In some embodiments, the length $L_3$ of a beam portion from an edge closest to a fixed element up to a point where the flexures attach to the beam portion may range between approximately 200 microns and approximately 600 microns. In some embodiments, the length $L_4$ of a beam portion from the opposite edge (furthest from a fixed element) up to a point where the flexures attach to the beam portion may range between approximately 200 microns and approximately 600 microns. In FIG. 17A, $L_4$ is shown to be slightly less than $L_3$, yet it can be appreciated that any suitable variations of length may be provided.

FIG. 17B illustrates a cross-sectional view of the embodiment depicted in FIG. 17A taken through the dashed line. Substrate 1010 includes a surface 1012 on top of which conductive materials 1014*a* and 1014*b* are located. Conductive material 1014*a* forms a conductive portion that is electrically connected to a mobile element 1102 through anchoring portions 1112. Conductive material 1014*b* forms a conductive portion that is electrically connected to a fixed element 1202.

As similarly discussed above, in an open configuration, conductive materials 1014*a* and 1014*b* are not in electrical contact with one another. However, in a closed configuration, an electrical pathway is established between conductive materials 1014*a* and 1014*b* through contact between mobile element 1102 and fixed element 1202. When an appropriate external force, such as a magnetic field, is applied to mobile element 1102 that is sufficient to actuate mobile element 1102 in a manner that brings conductive material 1160 of the mobile element into electrical contact with conductive material 1210 of fixed element 1202, the switch is closed.

Figure 17C:
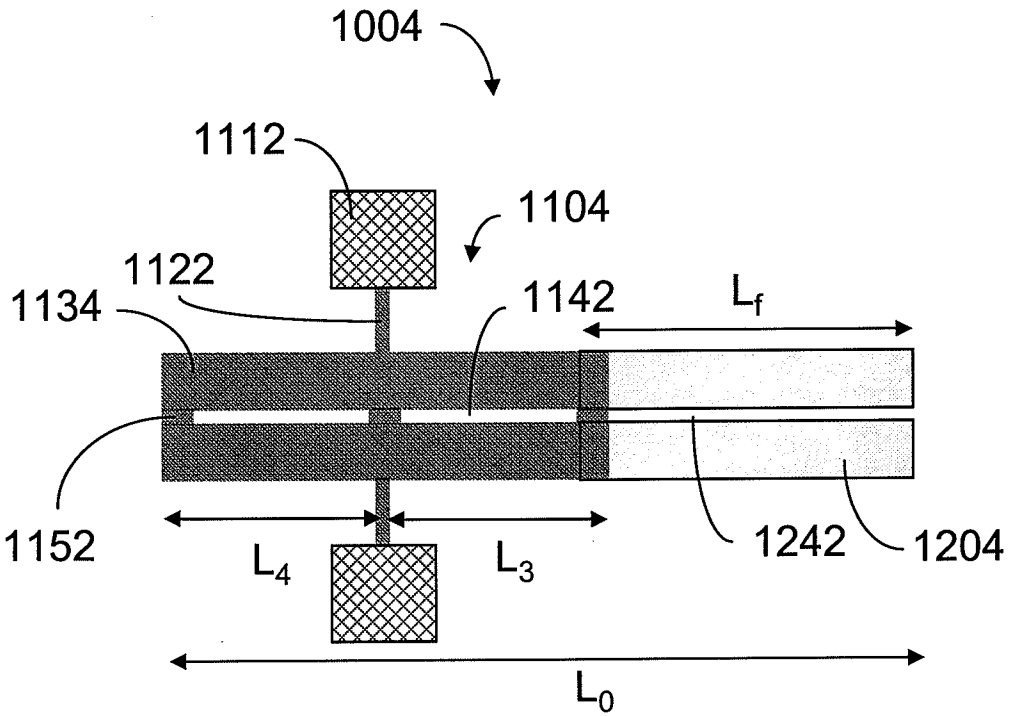
FIG. 17C is a schematic representation of a top view of a different embodiment of a switch configuration.

FIG. 17C illustrates a top view of an embodiment of a switch 1004 where a beam portion 1134 of a mobile element 1104 is divided into strips that are separated by openings 1142. Strips of beam portion 1134 may also be attached to one another by connection portions 1152. FIG. 17C also illustrates fixed element 1204 being divided into strips that correspond to the strips of beam portion 1134 and are separated by openings 1242. Although shown, it should be understood that it is not a requirement for fixed element 1204 to be divided into strips that correspond to strips of beam portion 1134.

Figure 17D:
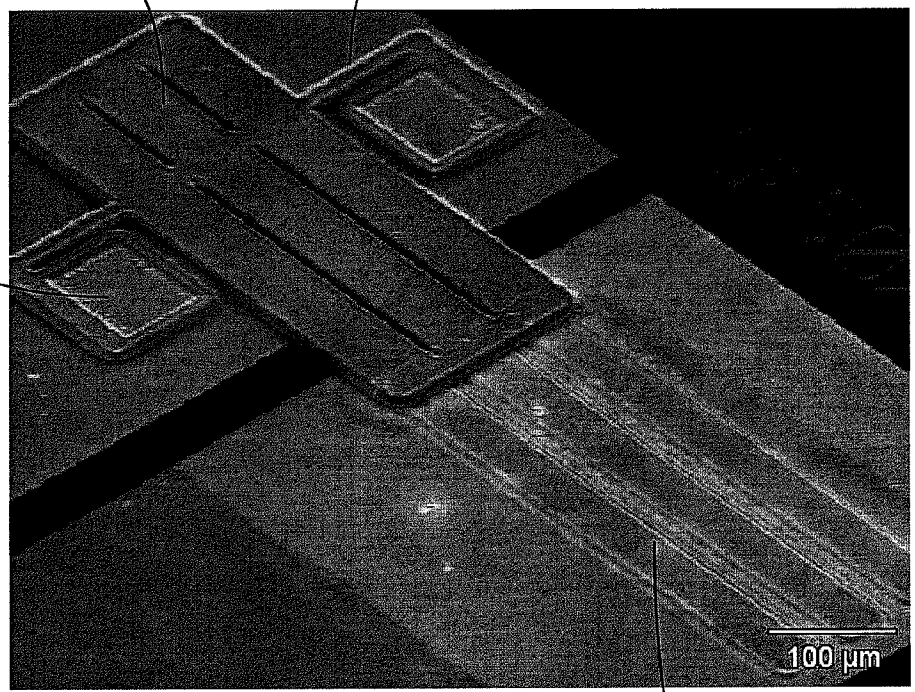
FIG. 17D is a micrograph of a torsion-type switch.

FIG. 17D shows an example of a switch having a mobile element and a fixed element 1204, both of which are divided into 3 strips. In addition, torsion-type flexures 1122 connect anchoring portions 1112 and beam portion 1134 of the mobile element together. In this particular example, the width w of the strips is approximately 50 microns; the length $L_3$ of the beam portion 1134 from the edge closest to the fixed element 1204 and up to flexures 1122 is approximately 345 microns; the length $L_4$ of the beam portion 1134 from the edge furthest from the fixed element 1204 and up to the flexures 1122 is approximately 155 microns; the length $L_f$ of fixed element 1204 is approximately 400 microns; and the length $L_0$ of the overall switch is approximately 1000 microns. The thickness of the beam portion of the mobile element is between about 7-10 microns. Torsion-type flexures 1122 have a length of approximately 100 microns and a width of approximately 10 microns.

In some embodiments, certain regions of the mobile element may be thicker than other portions of the mobile element. For example, the beam portion 1134 may be manufactured to be thicker than flexures 1122, providing for an enhanced overall magnetic force, and hence, an increased switch sensitivity. In some cases, as compared to a cantilever-type switch shown in FIGS. 16A-16C, a torsion-type switch shown in FIGS. 17A-17D may be able to achieve a greater sensitivity due to the beam portion of the mobile element being longer. In addition, in some embodiments, a torsion-type switch may give rise to a smaller initial deformation as compared to a cantilever-type switch.

Figure 18A:
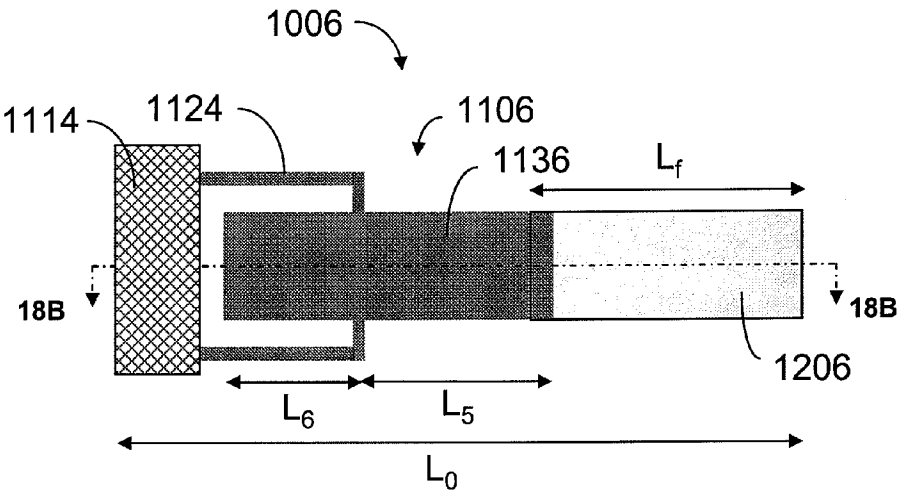
FIG. 18A is a schematic representation of a top view of yet another embodiment of a switch configuration.
Figure 18B:
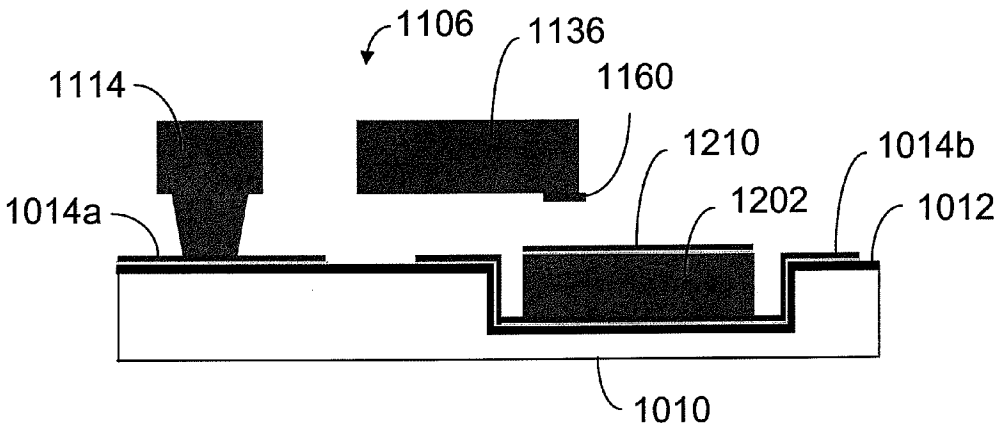
FIG. 18B is a schematic representation of a side section view of the embodiment of FIG. 18A.

FIGS. 18A-18D show other embodiments of a switch where a mobile element is supported by an anchoring portion that is attached to flexures that are located on a side portion of the mobile element. FIGS. 18A and 18B depict top and cross-sectional views of switch 1006 having a mobile element 1106 including a beam portion 1136 that is attached to anchoring portion 1114 by flexures 1124. In some instances, anchoring portions described may include a plurality of anchoring members.

As discussed above for the embodiments shown in FIGS. 16A and 17A, switch embodiments illustrated by FIGS. 18A-18D may have elements that may be manufactured to any suitable length. In some embodiments, the length $L_5$ of a beam portion from an edge closest to the fixed element up to a point where the flexures attach to the beam portion may range between approximately 200 microns and approximately 600 microns. In some embodiments, the length $L_6$ of a beam portion from an opposite edge (furthest from the fixed element) up to a point where the flexures attach to the beam portion may range between approximately 50 microns and approximately 600 microns. In FIG. 18A, $L_6$ is shown to be slightly less than $L_5$, yet it can be appreciated, similarly to embodiments discussed above, that any suitable variations of length may be provided.

FIG. 18B illustrates a cross-sectional view of the embodiment depicted in FIG. 18A taken through the dashed line. Substrate 1010 includes a surface 1012 on top of which conductive materials 1014*a* and 1014*b* are located. Conductive material 1014*a* forms a conductive portion that is electrically connected to a mobile element 1106 through anchoring portion 1114. Conductive material 1014*b* forms a conductive portion that is electrically connected to a fixed element 1202.

In an open configuration, conductive materials 1014*a* and 1014*b* are not in electrical contact with one another. However, in a closed configuration, an electrical pathway is established between conductive materials 1014*a* and 1014*b* through contact between mobile element 1106 and fixed element 1202. When an appropriate external force is applied to mobile element 1106 that is sufficient to actuate mobile element 1106 in a manner that brings conductive material 1160 of the mobile element into electrical contact with conductive material 1210 of fixed element 1202, the switch is closed.

Figure 18C:
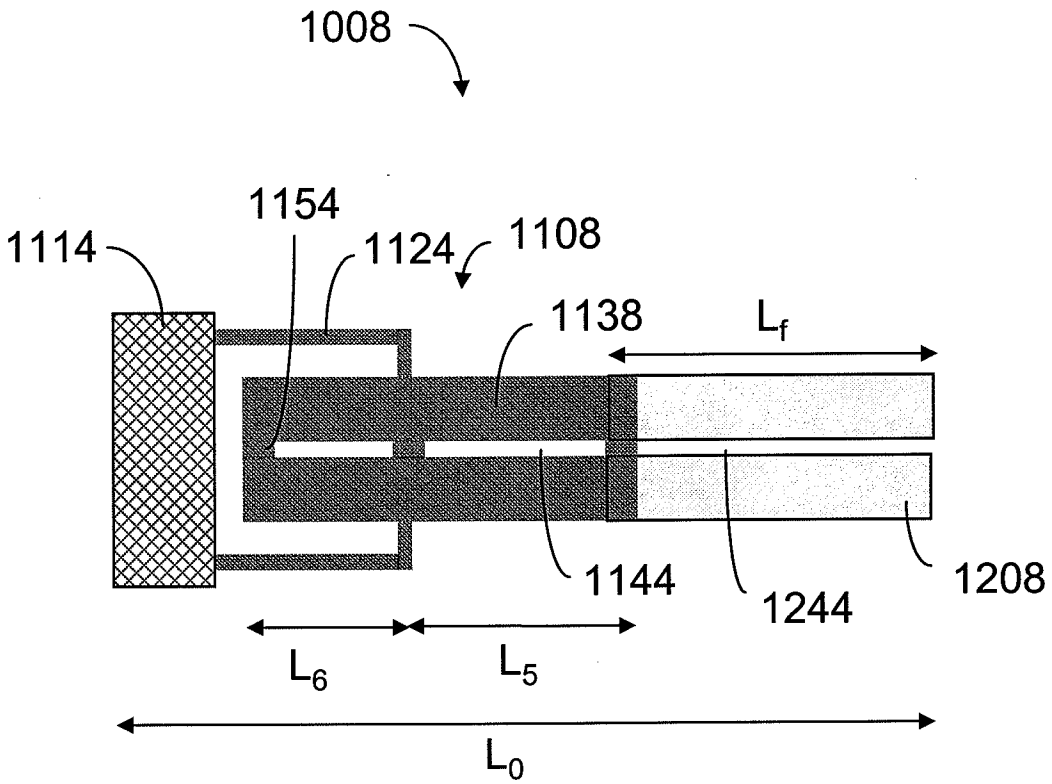
FIG. 18C is a schematic representation of a top view of a further embodiment of a switch configuration.

FIG. 18C illustrates a top view of an embodiment of a switch 1008 where a beam portion 1138 of a mobile element 1108 is divided into strips that are separated by openings 1144. Strips of beam portion 1138 may also be attached to one another by connection portions 1154. FIG. 18C also illustrates fixed element 1208 being divided into strips that correspond to the strips of beam portion 1138 and are separated by openings 1244. As discussed above for other embodiments, it can be appreciated that dividing a fixed element into strips that correspond to strips of a beam portion is not a requirement of that presented herein.

Figure 18D:
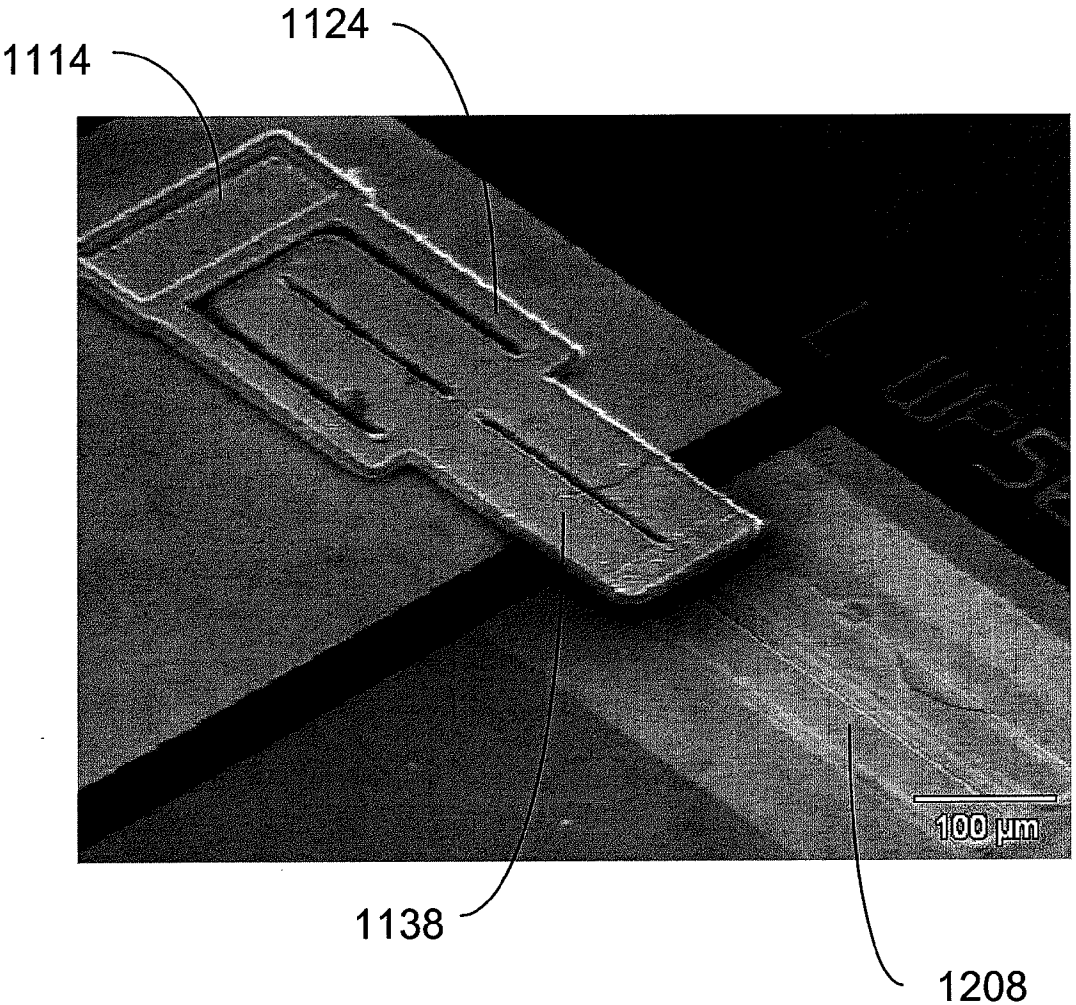
FIG. 18D is a micrograph of a crab leg-type switch.

FIG. 18D shows an example of a switch having a mobile element and a fixed element 1208, both of which are divided into 2 strips. Crab leg-type flexures 1124 connect anchoring portion 1114 and beam portion 1138 of the mobile element together. In this particular example, the width w of the strips is approximately 50 microns; the length $L_5$ of the beam portion 1138 from the edge closest to the fixed element 1208 and up to flexures 1124 is approximately 260 microns; the length $L_6$ of the beam portion 1138 from the edge furthest from the fixed element 1208 and up to the flexures 1124 is approximately 225 microns; the length $L_f$ of fixed element 1208 is approximately 400 microns; and the length $L_0$ of the overall switch is approximately 1000 microns. The thickness of the beam portion of the mobile element is between about 7-10 microns. In the example provided, crab leg-type flexures 1124 have a length that runs parallel to beam portion 1138 (that attaches to the anchoring portion) of approximately 249 microns; a length that runs perpendicular to beam portion 1138 (that attaches to the beam portion) of approximately 30 microns; and a width of approximately 20 microns.

In some embodiments, similar to that for a torsion-type switch, certain regions of the mobile element may be thicker than other portions of the mobile element. For example, the beam portion 1138 may be manufactured to be thicker than flexures 1124, which may provide for an enhanced overall magnetic force, and thus, an increased switch sensitivity. In some instances, as compared to a cantilever-type switch shown in FIGS. 16A-16C, a crab leg-type switch shown in FIGS. 18A-18D may be able to achieve an enhanced sensitivity due to the beam portion of the mobile element being longer and exhibiting a smaller initial deformation. In some cases, as compared to a torsion-type switch shown in FIGS. 17A-17C, a crab leg-type switch shown in FIGS. 18A-18D may generally be smaller in overall device size and, thus, may provide extra space for more device elements on to a wafer.

Figure 19B:
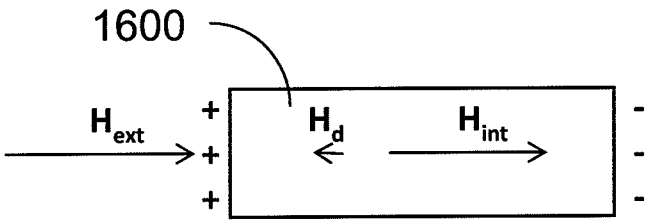
FIG. 19B is a schematic representation of another magnetic material that is exposed to an external magnetic field.
Figure 19A:
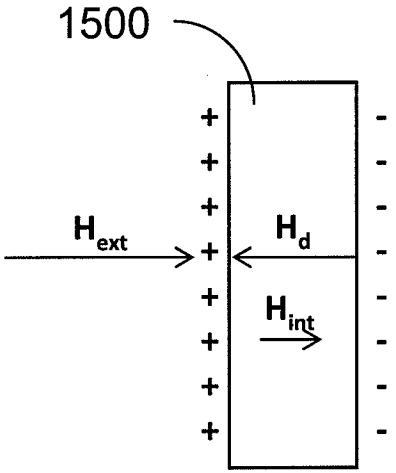
FIG. 19A is a schematic representation of a magnetic material that is exposed to an external magnetic field.

As mentioned to above, in one aspect, segmenting a beam portion of a mobile element or a fixed element into strips may provide for a reduced demagnetization effect in the elements of the switch. As schematically depicted in FIGS. 19A and 19B, application of an external magnetic field $H_{ext}$ results in magnetic charges on the surface of a ferromagnetic plate 1500 or 1600, giving rise to a magnetic field that opposes the applied external field $H_{ext}$. The opposing magnetic field is a demagnetization field $H_d$, where an internal magnetic field $H_i$ of the material is related to the external field $H_{ext}$ and the demagnetization field $H_d$ by the relation:

$$H_{int}=H_{ext}-H_d$$

Due to the separation distance between magnetic poles, a demagnetization field $H_d$ is generally greater (as shown by the arrows adjacent to each $H_d$) along a plate 1500 having a shorter axis as compared to a plate 1600 having a longer axis. The further apart the magnetic surface charges are, the weaker the demagnetization field $H_d$ becomes. Because the demagnetization field $H_d$ is smaller along the long axis of a longer plate 1600, the corresponding internal field $H_i$ accordingly, is larger along the long axis for the same external field $H_{ext}$. Thus, for a wider strip (e.g., of a beam portion or fixed element), a larger external field $H_{ext}$ must be applied as compared with a longer, more narrow strip. As a result, segmenting of portions of the mobile and/or fixed elements may give rise to increased sensitivity switching, i.e., electrical connections may be established with lower intensity magnetic fields.

More embodiments for the manufacture of switches that may be actuated by an external magnetic field are described below.

Figure 20A:
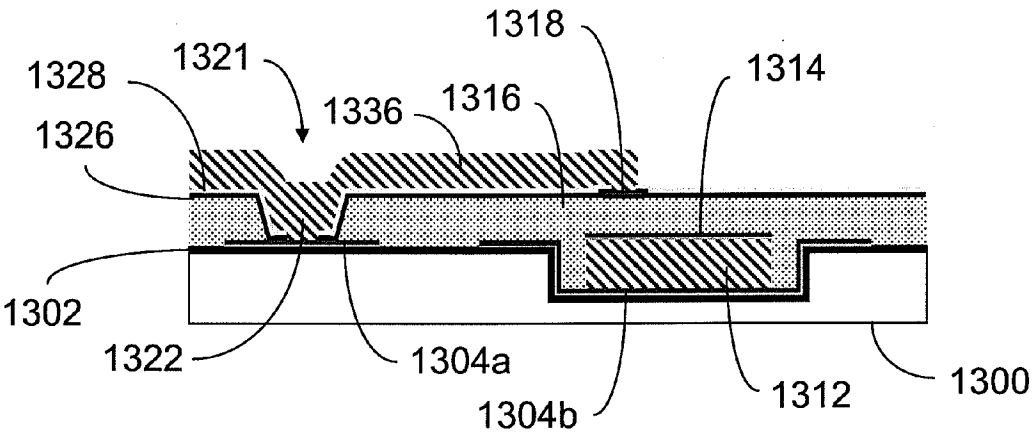
FIG. 20A is a schematic representation of a side section view of deposition of a magnetic material having a trench on a wafer.
Figure 20B:
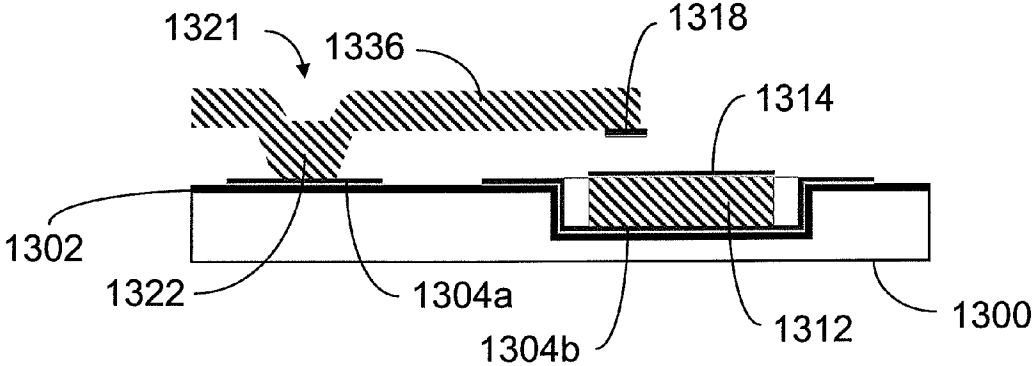
FIG. 20B is a schematic representation of a side section view of release of a mobile element having a trench on the wafer of FIG. 20A.

FIGS. 20A and 20B illustrate results in an alternative embodiment that provides for a method of manufacture of a switch that is similar to the process flow for FIGS. 10A-10T, yet this alternative embodiment uses fewer fabrication steps. As depicted, a mobile element is formed out of magnetic material 1336 and having a trench 1321 above anchoring member(s) 1322. Trench 1321 results from magnetic material 1336 having been deposited on to layer 1316 (with conductive materials 1326 and 1328 deposited on to layer 1316), where a previously formed via in layer 1316 had not been filled with extra magnetic material.

In this embodiment, the same steps as provided above for FIGS. 10A-10F are carried out. After removal of photoresist, similar to that shown in FIG. 10F, conductive material (e.g., corresponding to conductive materials 306 and 308 of FIG. 10F) that had covered portions of surface 1302 and conductive materials 1304*a* and 1304*b* is removed. As an example, Cu and Ti are removed using a wet etching technique.

Continuing on, as described above, the step corresponding to FIG. 10K where magnetic material is deposited into a via formed in layer 1316 is not performed. Accordingly, FIG. 20A corresponds to FIG. 10O, except, in this embodiment, magnetic material 1336 is deposited in a manner that gives rise to trench 1321. Further, portions of surface 1302 are in contact with layer 1316 as conductive material corresponding to 306 and 308 has been removed. As provided herein, it can be appreciated that alternative fabrication methods may be employed, as not every fabrication step described is necessarily required for switches herein to be manufactured. Finally, FIG. 20B illustrates a switch in an open configuration where the mobile element includes a trench 1321.

FIGS. 21A-21D depict another embodiment that describes a method for manufacturing a switch having portions of a mobile element being thicker than other portions of the mobile element.

Figure 21A:
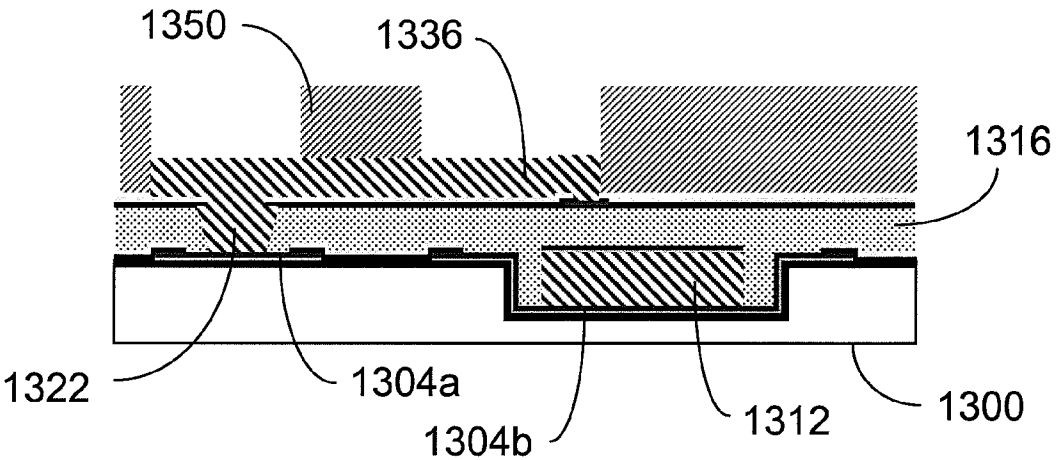
FIG. 21A is a schematic representation of a side section view of deposition of a photoresist on portions of a wafer.
Figure 21B:
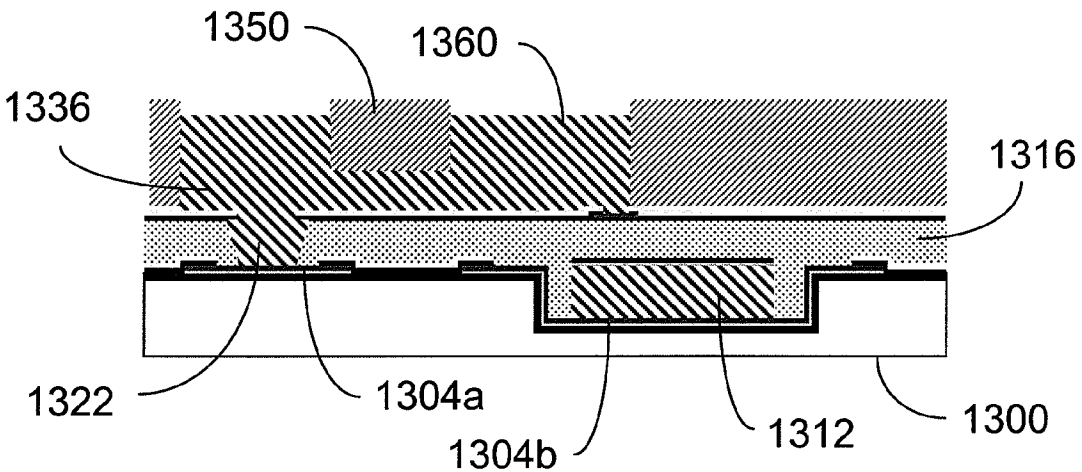
FIG. 21B is a schematic representation of a side section view of deposition of a magnetic material on portions of the wafer of FIG. 21A.

As illustrated in FIG. 21A, after magnetic material 1336 is deposited on layer 1316, a patterned photoresist 1350 is deposited on to layer 1316 and a portion of magnetic material 1336. FIG. 21B depicts deposition of magnetic material 1360 on to portions of magnetic material 1336. As a result, from the extra plating step, certain regions of the mobile element are thicker than other regions of the mobile element. For example, a beam portion of a mobile element may have magnetic material that is thicker than flexures of the mobile element.

Figure 21C:
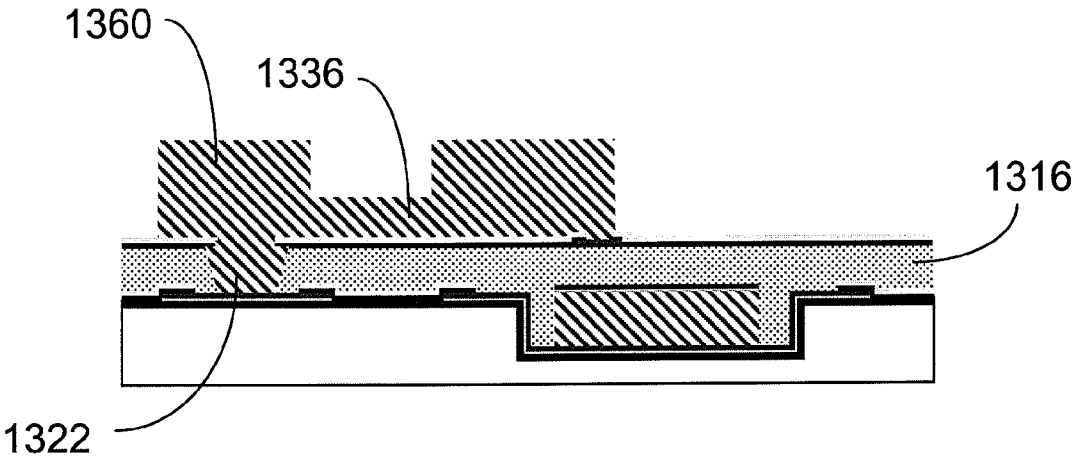
FIG. 21C is a schematic representation of a side section view of removal of the photoresist of FIG. 21B.
Figure 21D:
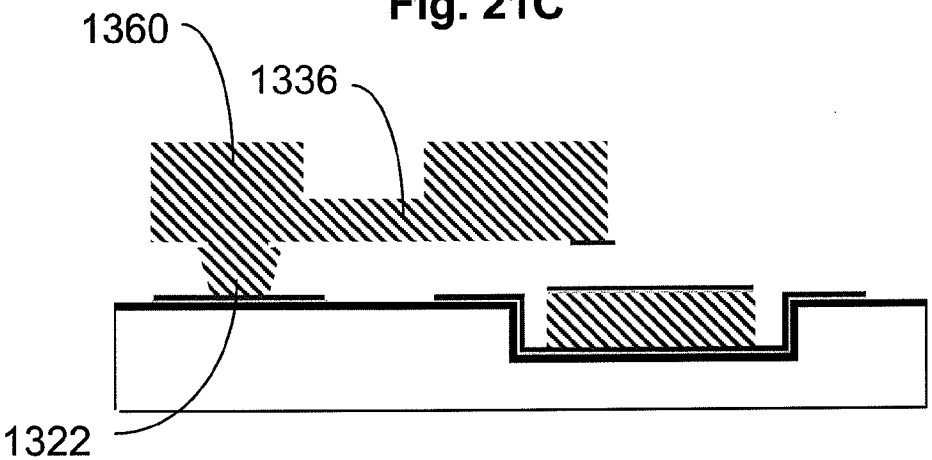
FIG. 21D is a schematic representation of a side section view of release of a mobile element on the wafer of FIG. 21C.

Once magnetic material 1360 is deposited on to the device, photoresist 1350 is removed, as provided by FIG. 21C. The mobile element is then released, as shown in FIG. 21D. In one embodiment, layer 1316 is formed of undoped silicate glass, and is etched and dried using a carbon dioxide critical point dryer system.

Figure 22B:
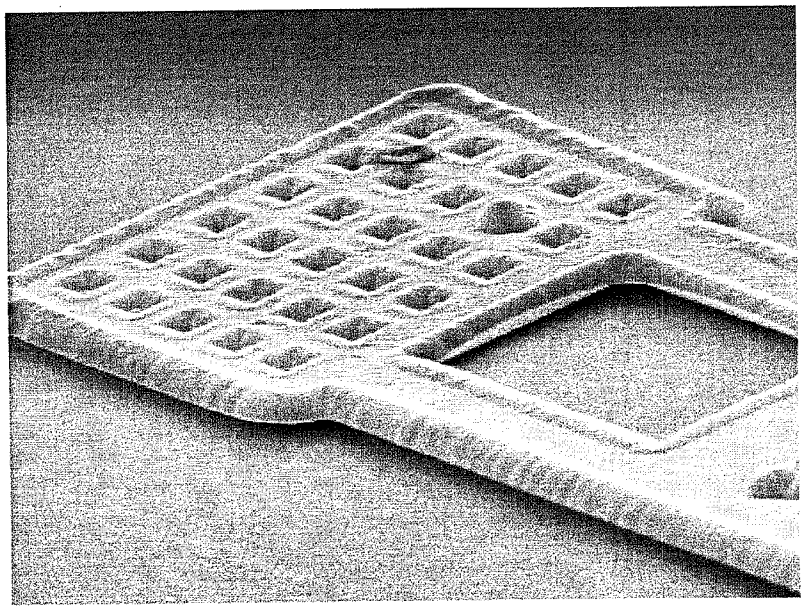
FIGS. 22A are 22B are micrographs of a cantilever-type magnetic switch.
Figure 22A:
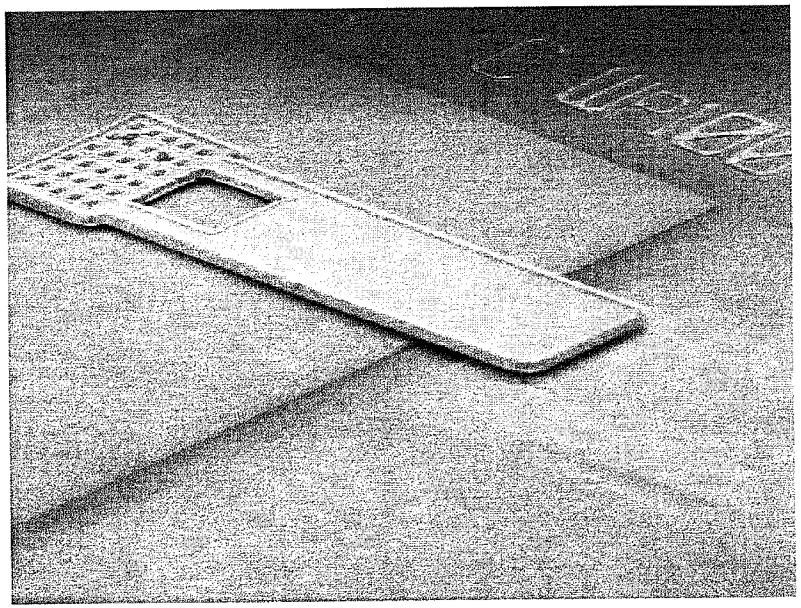

FIGS. 22A and 22B depict two scanning electron microscope micrographs of an example of a cantilever magnetic switch having a plurality of anchoring members. The plurality of anchoring members include a 5×6 via grid that was fabricated using a plating process similar to that described above for FIGS. 20A and 20B.

Switches described herein may exhibit advantageous device characteristics. Below is a table that lists performance parameters for switches set forth in various embodiments provided above:

| Parameters | Value |
|---|---|
| Package/Die size (wafer level package with cap) | <2 mm × 2 mm |
| Sensitivity | 0.1-2 mT |
| Contact Resistance | <10 ohms |
| Operating Magnetic Field | <10 mT |
| Durability (number of cycles) | >30,000,000 @ 1-2 mA |
| Isolation Resistance (open) | >100 megaohms |
| Switching-on Time | <3 ms |
| Switching-off Time | <2 ms |

Having thus described several aspects of at least one embodiment of this invention, it is to be appreciated various alterations, modifications, and improvements will readily occur to those skilled in the art. Such alterations, modification, and improvements are intended to be part of this disclosure, and are intended to be within the spirit and scope of the invention. Accordingly, the foregoing description and drawings are by way of example only.

What is claimed is:

1. A switch comprising:

a substrate having a first conductive portion and a second conductive portion; and a mobile element disposed on the substrate, the mobile element comprising:

an anchoring member disposed on the substrate and in contact with the first conductive portion of the substrate; and a beam attached to the anchoring member, the beam including a plurality of strips and a connection portion, each strip extending substantially along an entire length of the beam and being attached to another strip by the connection portion such that an opening that is fully enclosed within a plane is formed by adjacent strips and the connection portion, and the beam having an end portion that is adapted to move toward the second conductive portion upon exposure to an external force, wherein when the end portion of the beam is in contact with the second conductive portion, an electrical pathway is formed between the first and second conductive portions of the substrate.

2. The switch of claim 1, further comprising a plurality of flexures that are attached to the beam and the anchoring member, the plurality of flexures configured to accommodate increased displacement in the mobile element.

3. The switch of claim 1, wherein at least one of the plurality of strips is longer than another of the plurality of strips.

4. The switch of claim 1, wherein the beam includes 3 strips.

5. The switch of claim 1, wherein the second conductive portion comprises a fixed element disposed on the substrate.

6. The switch of claim 1, wherein the fixed element includes a plurality of strips.

7. The switch of claim 1, wherein the end portion of the beam is adapted to move toward the second conductive portion upon exposure to a magnetic field.

8. The switch of claim 7, wherein the electrical pathway between the first and second conductive portions is formed from contact between the beam and the second conductive portion when the magnetic field is less than about 20 mT.

9. The switch of claim 7, wherein the electrical pathway between the first and second conductive portions is formed from contact between the beam and the second conductive portion when the magnetic field is less than about 10 mT.

10. The switch of claim 7, wherein the electrical pathway between the first and second conductive portions is formed from contact between the beam and the second conductive portion when the magnetic field is less than about 5 mT.

11. The switch of claim 7, wherein the electrical pathway between the first and second conductive portions is formed from contact between the beam and the second conductive portion when the magnetic field is about 2 mT.

12. The switch of claim 1, wherein the anchoring member comprises one of a plurality of anchoring members that cooperate to minimize deformation resulting from residual stress in the mobile element.

13. The switch of claim 2, wherein the plurality of flexures are attached to a side portion of the beam.

14. The switch of claim 1, further comprising a plurality of flexures attached to the anchoring member and extending from a side portion of the beam.

15. The switch of claim 12, wherein the plurality of anchoring members are disposed on the substrate and in contact with the first conductive portion of the substrate.

16. The switch of claim 15, wherein the plurality of anchoring members are spaced apart from one another.

17. The switch of claim 15, wherein the plurality of anchoring members have contact surface areas in electrical contact with the first conductive portion of the substrate, each of the contact surface areas being substantially equal to one another.

18. The switch of claim 15, wherein the plurality of anchoring members have contact surface areas in electrical contact with the first conductive portion of the substrate, the contact surface area of at least one of the anchoring members being unequal from the contact surface area of another anchoring member.

19. The switch of claim 15, wherein the plurality of anchoring members include a first anchoring member having a first contact surface area and a second anchoring member having a second contact surface area, the first contact surface area being greater than the second contact surface area.

20. The switch of claim 19, wherein the first anchoring member is a central anchoring member that is disposed adjacent to each of the other anchoring members, the first contact surface area being greater than each contact surface area of the other anchoring members.

21. The switch of claim 15, wherein the plurality of anchoring members have contact surface areas in electrical contact with the first conductive portion of the substrate, the contact surface areas of the anchoring members being disposed in a grid pattern.

22. The switch of claim 21, wherein the contact surface areas of the anchoring members are patterned in a 3×4 grid.

23. The switch of claim 21, wherein the contact surface areas of the anchoring members are patterned in a 4×5 grid.

24. The switch of claim 21, wherein the contact surface areas of the anchoring members are patterned in a 5×6 grid.

25. The switch of claim 1, wherein the anchoring member reduces bending of the beam away from the second conductive portion.

26. The switch of claim 12, wherein the plurality of anchoring members are constructed and arranged to reduce upward bending of the beam.

27. The switch of claim 1, wherein an uppermost surface of the anchoring member is substantially coplanar with an uppermost surface of the beam.

28. The switch of claim 1, wherein a maximum width of the beam is less than a maximum width of a contact region between the substrate and the anchoring member.

29. The switch of claim 14, wherein the side portion of the beam is spaced from opposing ends of the beam.

30. The switch of claim 14, wherein the plurality of flexures comprise crab leg-type flexures.

31. The switch of claim 1, wherein the anchoring member is in fixed contact with the first conductive portion of the substrate.

* * * * *

UNITED STATES PATENT AND TRADEMARK OFFICE

CERTIFICATE OF CORRECTION

PATENT NO. : 8,581,679 B2
APPLICATION NO. : 12/713390
DATED : November 12, 2013
INVENTOR(S) : Tang Min et al.

It is certified that error appears in the above-identified patent and that said Letters Patent is hereby corrected as shown below:

**In the Claims:

At column 29, claim 6, line 21, should be corrected to depend upon claim --5--.**

Signed and Sealed this
Twenty-fifth Day of February, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,581,679 B2
APPLICATION NO. : 12/713390
DATED : November 12, 2013
INVENTOR(S) : Tang Min et al.

It is certified that error appears in the above-identified patent and that said Letters Patent is hereby corrected as shown below:

On the Title Page, Item (73) should read:
(73) Assignee: STMicroelectronics Pte. Ltd.
STMicroelectronics N.V.

Signed and Sealed this
Fourteenth Day of April, 2015

Michelle K. Lee

Michelle K. Lee
*Director of the United States Patent and Trademark Office*